US010730047B2

(12) United States Patent
Richardson

(10) Patent No.: US 10,730,047 B2
(45) Date of Patent: Aug. 4, 2020

(54) MICRO-CHANNEL FLUID FILTERS AND METHODS OF USE

(71) Applicant: Imagine TF, LLC, Los Gatos, CA (US)

(72) Inventor: Brian Edward Richardson, Los Gatos, CA (US)

(73) Assignee: Imagine TF, LLC, Los Gatos, CA (US)

( * ) Notice: Subject to any disclaimer, the term of this patent is extended or adjusted under 35 U.S.C. 154(b) by 669 days.

(21) Appl. No.: 14/313,924

(22) Filed: Jun. 24, 2014

(65) Prior Publication Data

US 2015/0367257 A1 Dec. 24, 2015

(51) Int. Cl.
*B01L 3/00* (2006.01)

(52) U.S. Cl.
CPC . *B01L 3/502753* (2013.01); *B01L 2300/0645* (2013.01); *B01L 2300/0803* (2013.01); *B01L 2300/0816* (2013.01); *B01L 2300/0864* (2013.01); *B01L 2300/0874* (2013.01); *B01L 2300/0883* (2013.01); *B01L 2400/0415* (2013.01); *B01L 2400/086* (2013.01)

(58) Field of Classification Search
CPC ..... B01D 63/00; B01D 46/40; B03C 3/00
USPC ..... 210/498, 346
See application file for complete search history.

(56) References Cited

U.S. PATENT DOCUMENTS 1,977,174 A 10/1934 Crawford
3,250,396 A 5/1966 Armstrong et al.
3,335,946 A 8/1967 Putterlik
3,884,805 A 5/1975 Bagdasarian et al.
3,948,779 A 4/1976 Jackson
4,267,045 A 5/1981 Hoof
4,410,430 A 10/1983 Hagler, Jr.
4,423,090 A 12/1983 Hammond, Jr. et al.
4,430,232 A 2/1984 Doucet
4,478,769 A 10/1984 Pricone et al.
(Continued)

FOREIGN PATENT DOCUMENTS

CN 201094877 Y 8/2008
CN 203139755 U 8/2013
(Continued)

OTHER PUBLICATIONS

Patent Cooperation Treaty Application No. PCT/US2016/040878, "International Search Report" and "Written Opinion of he International Searching Authority," dated Sep. 19, 2016, 11 pages.
(Continued)

*Primary Examiner* — Bobby Ramdhanie
*Assistant Examiner* — Michael J An
(74) *Attorney, Agent, or Firm* — Keith Kline; The Kline Law Firm PC

(57) ABSTRACT

Micro-channel fluid filters and methods of use are provided herein. In one embodiment a fluid film may include a plurality of dividing walls extending from an upper surface of a film, the plurality of dividing walls forming a plurality of tapered inlet channels, a plurality of cross channels formed along a length of each of the plurality of dividing walls, an inlet channel for each of the plurality of tapered inlet channels, and an outlet channel for each of the plurality of tapered inlet channels.

14 Claims, 72 Drawing Sheets

(56) References Cited

U.S. PATENT DOCUMENTS 4,486,363 A 12/1984 Pricone et al.
4,592,839 A * 6/1986 Rosenberg ..... B01D 29/46 210/352
4,601,861 A 7/1986 Pricone et al.
4,620,917 A * 11/1986 Nozawa ..... B01D 25/24 204/665
4,668,558 A 5/1987 Barber
4,797,175 A 1/1989 Ellion et al.
4,816,150 A * 3/1989 Pierrard ..... B01D 63/082 210/321.82
4,842,739 A 6/1989 Tang
4,842,794 A 6/1989 Hovis et al.
4,891,120 A 1/1990 Sethi et al.
4,902,420 A 2/1990 Pall et al.
4,960,449 A 10/1990 Yonushonis
4,971,769 A 11/1990 Haerle
5,009,857 A 4/1991 Haerle
5,100,551 A 3/1992 Pall et al.
5,200,073 A 4/1993 Steere et al.
5,204,690 A 4/1993 Lorenze, Jr. et al.
5,207,962 A 5/1993 Hovis et al.
5,262,107 A 11/1993 Hovis et al.
5,290,447 A 3/1994 Lippold
5,458,664 A * 10/1995 Ishii ..... B01D 39/2051 55/282
5,505,852 A 4/1996 van Rossen
5,552,046 A 9/1996 Johnston et al.
5,568,819 A 10/1996 Gentry et al.
5,645,704 A 7/1997 Axtman
5,985,164 A 11/1999 Chu et al.
6,273,938 B1 8/2001 Fanselow et al.
6,274,035 B1 8/2001 Yuan et al.
6,284,072 B1 9/2001 Ryan et al.
6,306,300 B1 10/2001 Harding et al.
6,346,192 B2 2/2002 Buhr et al.
6,375,870 B1 4/2002 Visovsky et al.
6,391,097 B1 * 5/2002 Rosenberg ..... B01D 29/46 210/492
6,471,746 B2 * 10/2002 Hagglund ..... B03C 3/12 55/521
6,524,488 B1 2/2003 Insley et al.
6,589,317 B2 7/2003 Zhang et al.
6,632,357 B1 10/2003 Barger et al.
6,685,833 B2 2/2004 Lippold
6,685,841 B2 2/2004 Lopez et al.
6,746,890 B2 6/2004 Gupta et al.
6,748,978 B2 6/2004 Pezzuto et al.
6,752,889 B2 6/2004 Insley et al.
6,761,962 B2 7/2004 Bentsen et al.
6,827,906 B1 12/2004 Bjornson et al.
6,846,413 B1 1/2005 Kadel et al.
6,872,302 B2 3/2005 Aste
6,915,566 B2 7/2005 Abbott et al.
6,936,086 B2 8/2005 Harkonen et al.
7,032,426 B2 4/2006 Durney et al.
7,048,848 B2 5/2006 Assion
7,081,208 B2 7/2006 McCullough et al.
7,104,406 B2 9/2006 Chen et al.
7,122,068 B2 10/2006 Tate et al.
7,163,733 B2 1/2007 Bourdelais et al.
7,217,562 B2 5/2007 Cao et al.
7,223,364 B1 5/2007 Johnston et al.
7,238,255 B2 7/2007 Derand et al.
7,282,148 B2 10/2007 Dalton et al.
7,323,105 B1 1/2008 Janikowski et al.
7,425,227 B1 9/2008 Hutchison et al.
7,442,303 B2 10/2008 Jacobson
7,531,120 B2 5/2009 Van Rijn et al.
7,569,139 B2 8/2009 Mihlbauer et al.
7,588,619 B2 9/2009 Chilton et al.
7,645,383 B2 1/2010 Kadel et al.
7,784,619 B2 8/2010 Jacobson
7,857,978 B2 12/2010 Jensen et al.
7,901,758 B2 3/2011 Rasmussen
7,922,795 B2 4/2011 Striemer et al.
7,959,780 B2 6/2011 Hawkins et al.
7,988,840 B2 8/2011 Huang et al.
8,025,854 B2 9/2011 Ohman et al.
8,083,941 B2 12/2011 Chien
8,179,381 B2 5/2012 Frey et al.
8,186,913 B2 5/2012 Toner et al.
8,197,775 B2 6/2012 Johnston et al.
8,273,245 B2 9/2012 Jovanovic et al.
8,277,759 B2 10/2012 Sundberg et al.
8,282,799 B2 10/2012 Huang et al.
8,297,449 B2 10/2012 Afzali-Ardakani et al.
8,304,230 B2 11/2012 Toner et al.
8,328,022 B2 12/2012 Mbadinga-Mouanda et al.
8,679,336 B2 3/2014 Hongo et al.
9,555,346 B2 * 1/2017 Holm ..... B01D 29/073
2002/0060183 A1 5/2002 Paul et al.
2002/0125192 A1 9/2002 Lopez et al.
2002/0174770 A1 * 11/2002 Badeau ..... C04B 38/0083 95/273
2002/0185003 A1 12/2002 Potter
2003/0104170 A1 6/2003 Johnston et al.
2003/0118781 A1 6/2003 Insley et al.
2004/0159319 A1 8/2004 Kadel et al.
2005/0179150 A1 8/2005 Bharadwaj et al.
2006/0219627 A1 10/2006 Rodgers et al.
2007/0020772 A1 1/2007 Cao et al.
2007/0151920 A1 7/2007 Kay
2007/0246433 A1 10/2007 Zuberi
2007/0251867 A1 11/2007 Mihlbauer et al.
2008/0012151 A1 1/2008 Kemppainen et al.
2008/0014410 A1 1/2008 Johnston et al.
2008/0296238 A1 12/2008 Haldopoulos et al.
2009/0102094 A1 4/2009 Golden et al.
2009/0120874 A1 5/2009 Jensen et al.
2009/0149345 A1 6/2009 Nishi et al.
2010/0028604 A1 2/2010 Bhushan et al.
2010/0216126 A1 8/2010 Balachandran et al.
2010/0317132 A1 12/2010 Rogers et al.
2011/0100900 A1 5/2011 Drury et al.
2011/0240476 A1 10/2011 Wang et al.
2012/0006760 A1 1/2012 Toner et al.
2012/0037544 A1 2/2012 Lane et al.
2012/0244311 A1 9/2012 Manninen
2012/0244314 A1 9/2012 Scheibner et al.
2012/0261331 A1 10/2012 Ter Horst et al.
2012/0261333 A1 10/2012 Moran
2012/0267249 A1 10/2012 Cotte et al.
2012/0273990 A1 11/2012 O'Donnell et al.
2013/0008848 A1 * 1/2013 Jonsson ..... B01D 29/46 210/488
2013/0078163 A1 3/2013 Chung et al.
2013/0240438 A1 9/2013 Willis et al.
2014/0221544 A1 8/2014 Lichtenhan et al.
2014/0224658 A1 8/2014 Richardson
2016/0067634 A1 3/2016 Richardson
2016/0236120 A1 8/2016 Richardson
2017/0008781 A1 1/2017 Richardson
2017/0050407 A1 2/2017 Richardson

FOREIGN PATENT DOCUMENTS

CN 106029202 A 10/2016
EP 0639223 B1 3/1996
EP 1196242 A1 4/2002
EP 1197255 A1 4/2002
EP 1449585 A1 8/2004
EP 1254689 B1 9/2010
EP 2505047 A2 10/2012
JP 2001518377 10/2001
JP 2005144375 6/2005
JP 2007530279 11/2007
JP 2009109232 5/2009
WO WO2005069927 8/2005
WO WO2011066055 A2 6/2011
WO WO2013063567 5/2013
WO WO2014116183 A1 7/2014
WO WO2015105524 A1 7/2015
WO WO2015199663 A1 12/2015

(56) References Cited

FOREIGN PATENT DOCUMENTS

| | | | |
|---|---|---|---|
| WO | WO2016037150 | A1 | 3/2016 |
| WO | WO2016133929 | A1 | 8/2016 |
| WO | WO2017007734 | A1 | 1/2017 |

OTHER PUBLICATIONS

International Search Report and Written Opinion dated May 19, 2016 in Application No. PCT/US2016/018119, filed Feb. 16, 2016, 10 pages.
International Search Report and Written Opinion dated Aug. 28, 2014 in Application No. PCT/US2014/036439, filed May 1, 2014.
International Search Report and Written Opinion dated Dec. 1, 2014 in Application No. PCT/US2014/043942, filed Jun. 24, 2014.
International Search Report and Written Opinion dated Dec. 17, 2015 in Application No. PCT/US2015/048723, filed Sep. 4, 2015.
Chinese Patent Application No. 201480076095.3, "Office Action," dated Feb. 21, 2017, 8 pages [20 pages including translation].
Brown, R.C., "Electrically Charged Filter Materials," Engineering Science and Education Journal 1.2 (1992): 71-79.
Search Report dated Jan. 3, 2018 for European Application No. 14896220.0.
Office Action dated Apr. 3, 2018 for Japanese Application No. 2017520861.

* cited by examiner

Only vertical flow

Only cross flow

Close-up of forces on particles

Tapered surface

MICRO-CHANNEL FLUID FILTERS AND METHODS OF USE

FIELD OF THE PRESENT TECHNOLOGY

The present technology relates generally to fluid filters, and more specifically, but not by limitation, to fluid filters substrates that comprise micro-structured channels, complex flow orifices, cross channels, and various types of filters manufactured from these substrates.

SUMMARY OF THE PRESENT TECHNOLOGY

According to some embodiments, the present technology may be directed to a filter film, comprising: (a) a plurality of dividing walls extending from an upper surface of a film, the plurality of dividing walls forming a plurality of tapered inlet channels; (b) a plurality of cross channels formed along a length of each of the plurality of dividing walls; (c) an inlet channel for each of the plurality of tapered inlet channels; and (d) outlet channel for each of the plurality of tapered inlet channels.

According to some embodiments, the present technology may be directed to a filter device, comprising a plurality of filter films, the plurality of filter films being disposed in a stacked and mating relationship.

According to some embodiments, the present technology may be directed to a filter film comprising: (a) a first row of a plurality of inlet dividing walls extending from an upper surface of a film, the plurality of inlet dividing walls in fluid communication with a plurality of filter inlet channels, the plurality of inlet dividing walls being spaced apart from one another to form a plurality of channels, each of the plurality of inlet dividing walls comprising a curved section proximate the bottom of the inlet dividing walls; and (b) a second row of a plurality of inlet dividing walls, the plurality of inlet dividing walls being spaced closer together than the plurality of inlet dividing walls of the first row to form filter inlet channels that are narrower than the plurality of filter inlet channels of the first row.

According to some embodiments, the present technology may be directed to a filter film comprising: a cylindrical housing for retaining a filter disk, the cylindrical housing comprising a top cover comprising a plurality of radial inlet channels and a plurality of radial outlet channels, the plurality of radial inlet channels being disposed in an alternating relationship with the plurality of radial outlet channels, the top cover comprising a cover inlet channel for receiving a fluid, the radial outlet channels collecting concentrated or filtered fluid from the filter disk.

According to some embodiments, the present technology may be directed to a filter device, comprising: (a) a plurality of panels, each of the plurality of panels comprising: (b) a filtering front surface and a flat back surface, the filtering front surface comprising: (c) a first row of vertically extending protrusions spaced apart from one another to form vertical channels, the first row proximate an inlet of the filter device; (d) a second row of vertically extending protrusions spaced apart from one another to form vertical channels, the second row proximate an exit of the filter device; (e) one or more rows of filtering protrusions, the one or more of rows being vertically spaced apart from one another and extending between the first and second rows of vertically extending protrusions, each row of filtering protrusions comprising filtering protrusions that are spaced from one another to form filter channels having a size that is configured to receive and retain objects of a given size; and (f) wherein the plurality of panels are stacked in a mating configuration such that the filtering front surface of one panel is in mating contact with the flat back surface of an adjacent panel.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

DESCRIPTION OF EXEMPLARY EMBODIMENTS

Figure 1:
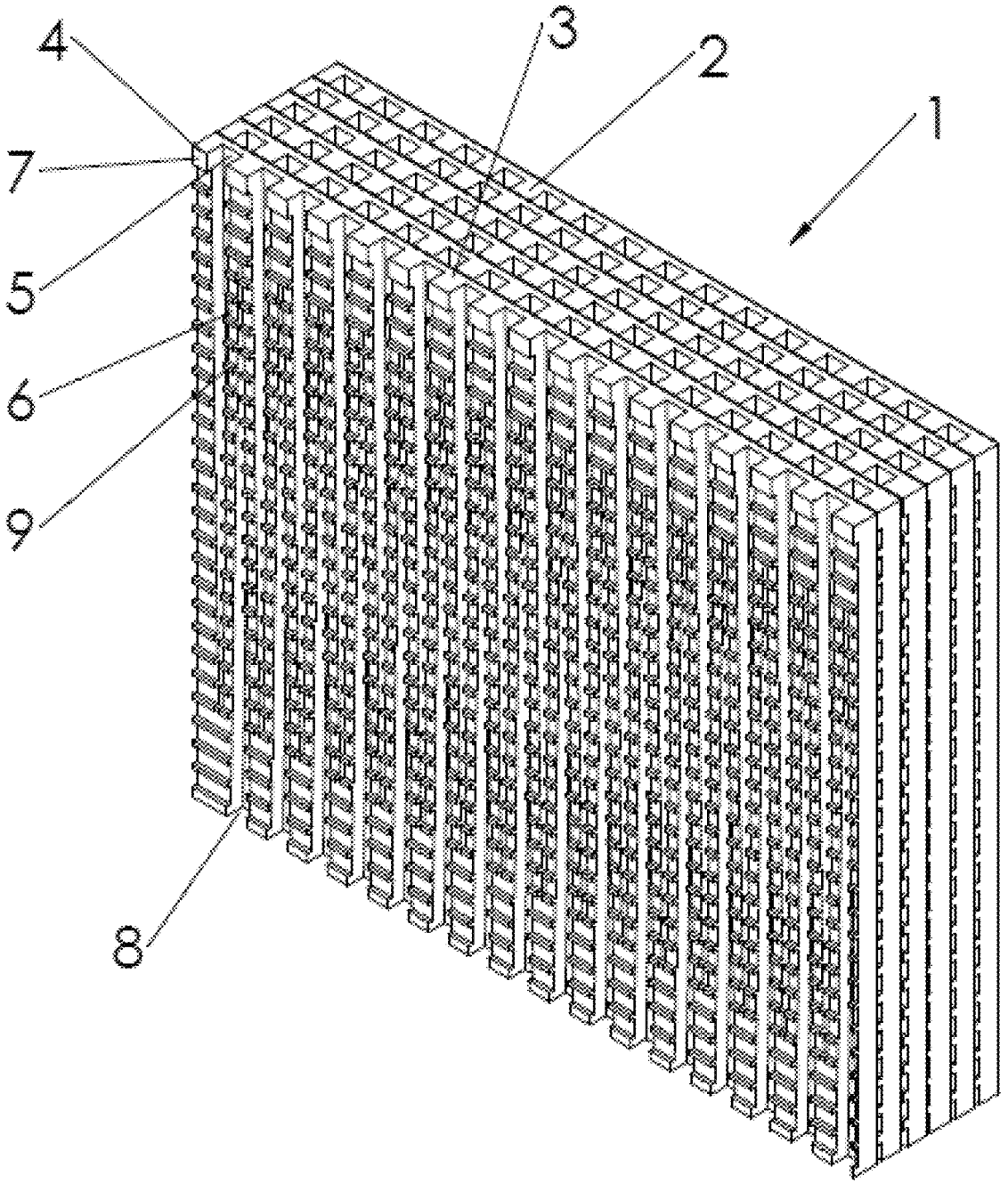
FIG. 1 is an isometric view of the deionizing panel, constructed in accordance with the present technology.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

The terminology used herein is for the purpose of describing particular embodiments only and is not intended to be limiting of the present technology. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

It will be further understood that while various configurations are described with respect to certain applications—i.e. deionization, desalinization, filtering, etc.—the configurations are generally applicable to multiple applications even though they may be described with respect to a specific application.

FIGS. 1-19 collectively illustrate deionization panels with micro-structured channels. In some embodiments, the present technology relates to the deionization of fluids with embossed micro-structured channels. The embossed micro-structured channels are precisely replicated on a plastic film from tooling made with semiconductor processing techniques. Alternatively, a wafer processed with semiconductor manufacturing techniques could be used in place of the film. The channeled films are layered on top of one another to form enclosed channels. Selected walls of the channels are electrically conductive so an electric field can be created across the channels. By charging selected walls with opposing charges, charged particles flowing through the channels are attracted to the one of the charged surfaces. Many types of particles can be removed from both liquid and gaseous fluids. Removing salt and heavy metals from water is an area where there is great need for an efficient low cost system.

In some embodiments, the present technology deploys a number of layers of films with structured elements laminated together forming a series of channels to isolate charged molecules or compounds from a fluid. The films have an entrance region with relatively wide channels. Following the entrance region are a series of narrower channels that form narrow passages. The height of these channels can be extremely small. The surfaces of these channels are charged during operation by an external source to attract and retain charged particles to these surfaces. With an external source the charge can be removed to release the particles from the surfaces. This would be done when a large amount of particles are attracted to the surface and it is desired to remove them.

Capacitive deionization (CDI) is a term used to describe the process of desalinization by charged plates. The disclosed invention can be used for CDI.

Referring first to FIG. 1, the deionization panel 1 is shown. Fluids, either liquid or gas, flow into the deionization panel 1 from the top surface 2 of the deionization panel 1. The embossed films 3 are layered together where the top edge 4 of the embossed films 3 forms the top surface 2 of the deionization panel 1. The number of embossed films 3 layered together would be much greater than what is shown. The number of embossed films 3 may be in the hundreds or thousands. The width of the embossed films 3 would also typically be much greater than what is shown. The deionization panel 1 is shown as a linear array. The embossed film 3 could be arranged in other geometries. Several other geometries are disclosed later in this document.

Figure 2:
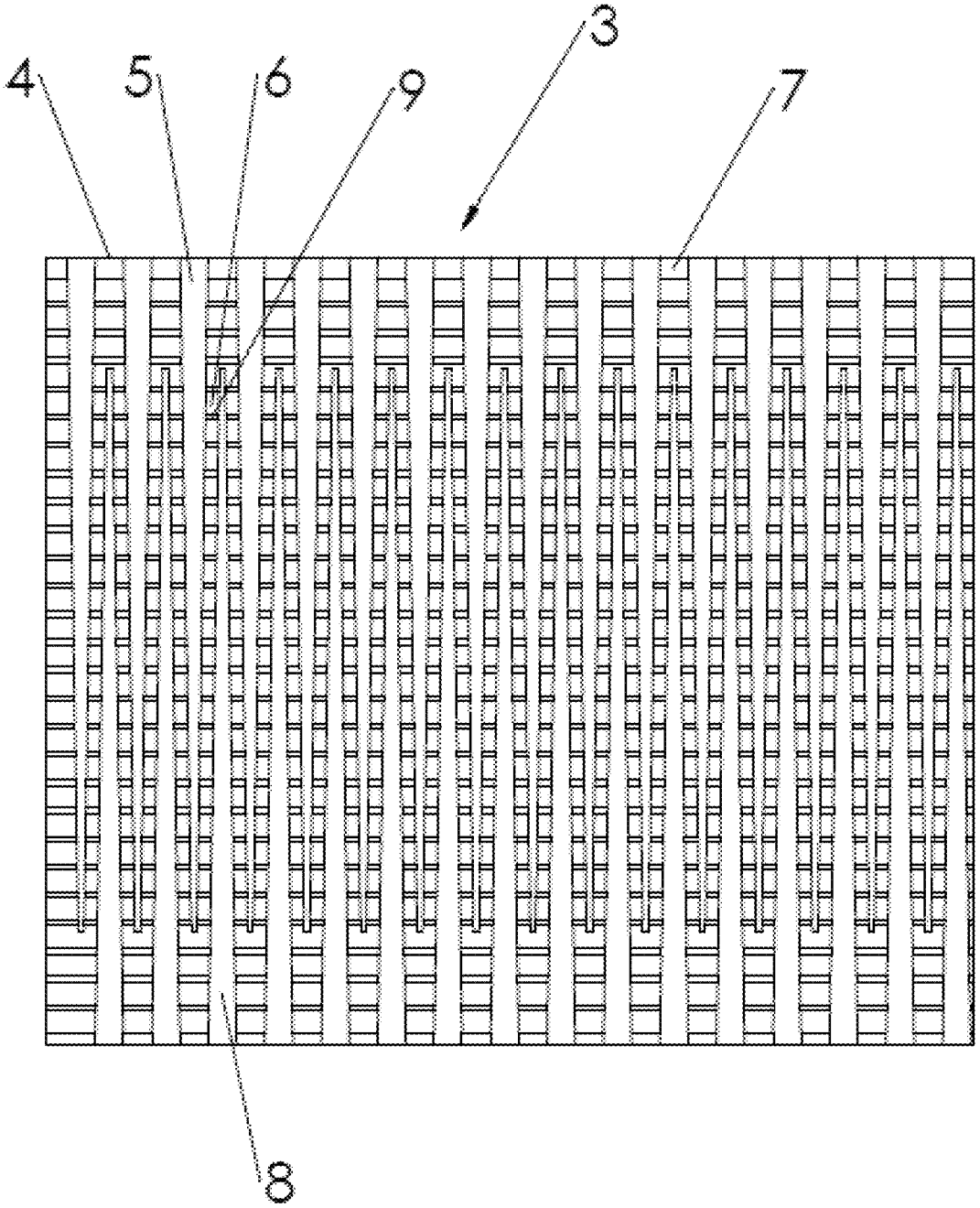
FIG. 2 is a front view of one embossed film of the deionizing panel of FIG. 1.
Figure 3:
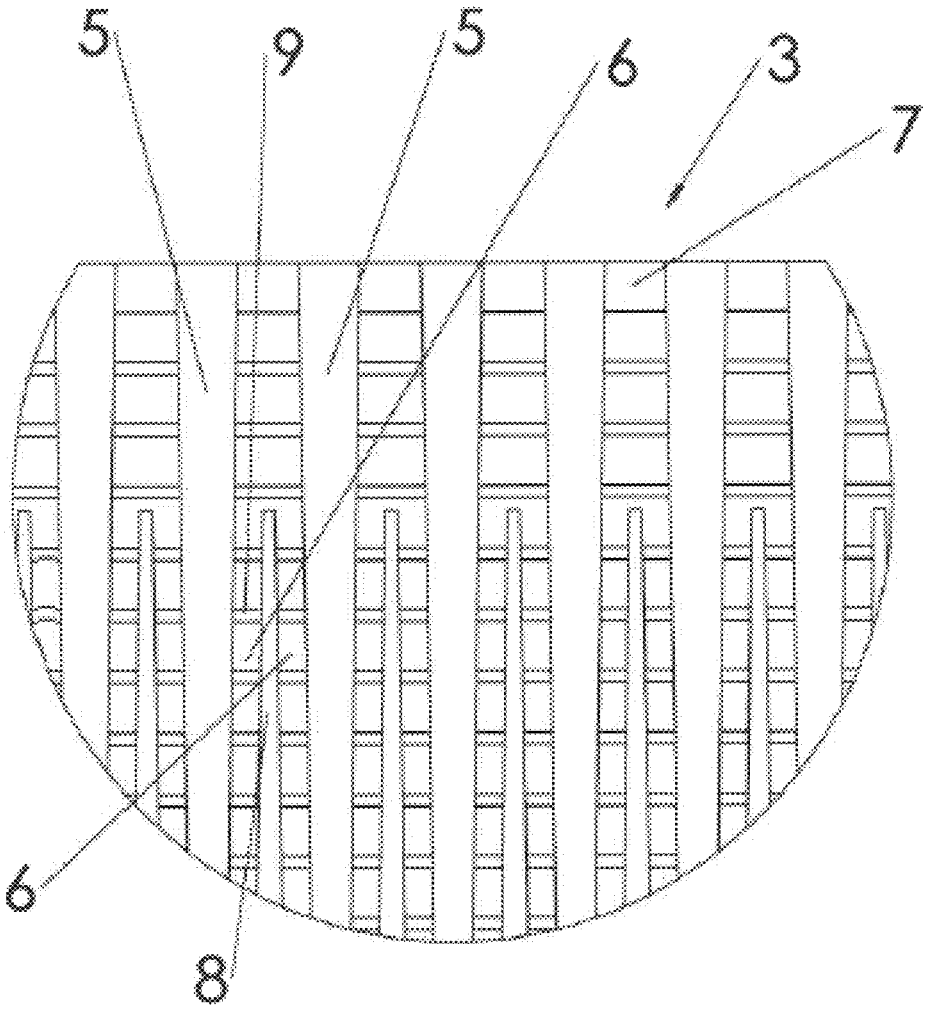
FIG. 3 is a close-up of the top area of the deionizing panel shown in FIG. 2.
Figure 4:
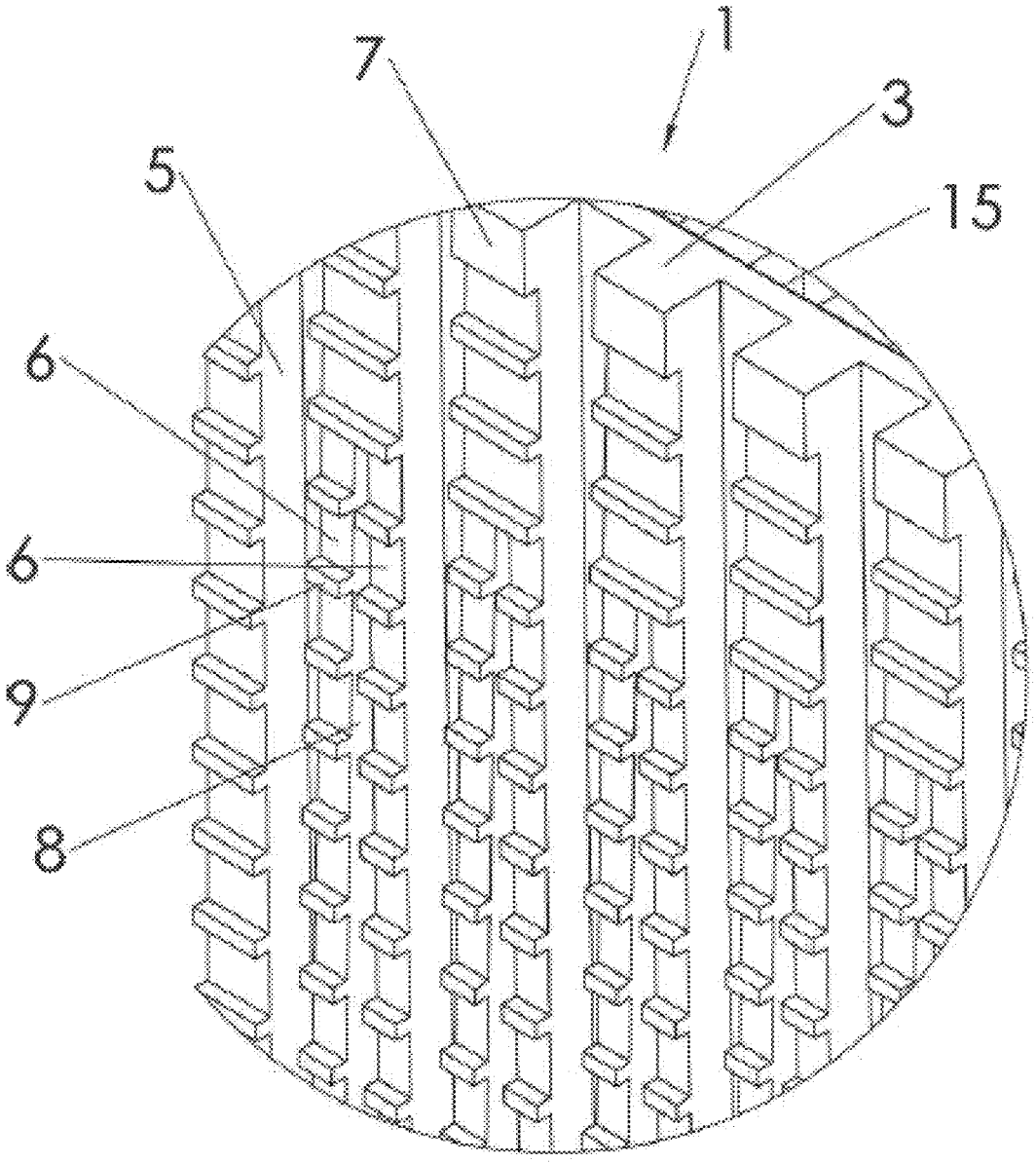
FIG. 4 is a close-up isometric view of the deionizing panel shown in FIG. 1.

Referring to FIG. 2, close-up FIG. 3 and FIG. 4, collectively, where only one embossed film 3 is shown. The inlet channels 5 are generally equally spaced along the top edge 4 of the embossed film 3. The inlet channels 5 extend from the top of the embossed film 3 to near the bottom of the embossed film 3. The inlet channels 5 might be 200 microns in width at the top surface 2 and taper down to a width of only 50 microns or less at the bottom. The input channels 5 might be spaced 300 microns from center to center along the length of the film. These dimensions are given as reference. The actual dimensions would be engineered for the specific application.

The thickness of the embossed film 3 might be 300 microns. The depth of the inlet channels 5 might be 150 microns. This relative large dimension allows for variations in the manufacturing process of the embossed film 3. This large dimension also allows for relatively unrestricted flow of fluids down the inlet channel 5.

The embossed film 3 can easily be manufactured by embossing a film or bulk plastic material over a drum shaped or flat tool. The tool would be a negative of the structures on the embossed film 3. The tool might be manufactured by any one or combination of processes.

Conventional machining can be used to produce features in the 100+ micron range. For smaller features, semiconductor or MEMS (MicroElectroMechanical Systems) processing equipment and methods could be deployed. These types of processes have been used to create features with widths and heights in the low nanometer range. Just as important, the tolerance of the width and height of features can be controlled in the low nanometer range. The depth of structures created with these methods can be controlled with even greater accuracy. The depth of the cross channels 6 is where extremely small and accurately controlled dimensions might be required. Semiconductor and MEMS processes can be used to create extremely small and accurate cross channels 6 in the single digit and fractions of a nanometer range.

The cross channels 6 allow the fluid to flow from the inlet channels 5 to the output channels 8. They are generally located orthogonal to the inlet channels 5. The cross channels 6 are separated by cross channel dividing walls 9. The cross channel dividing walls 9 are preferably much shorter than the cross channels 6 to allow for a tall area for flow. The size of the cross channel dividing wall 9 defines the depth of the cross channels 6.

The upper origin of the output channels 8 is of similar width to the lower end of the input channels 5. They originate approximate 500 microns from the top edge 4 of the embossed film 3. The output channel 8 extends to the bottom of the embossed film 3 and tapers to a width similar to the starting width of the inlet channels 5, 200 microns. It is open at the bottom edge to allow fluids to exit the embossed film 3.

Figure 5:
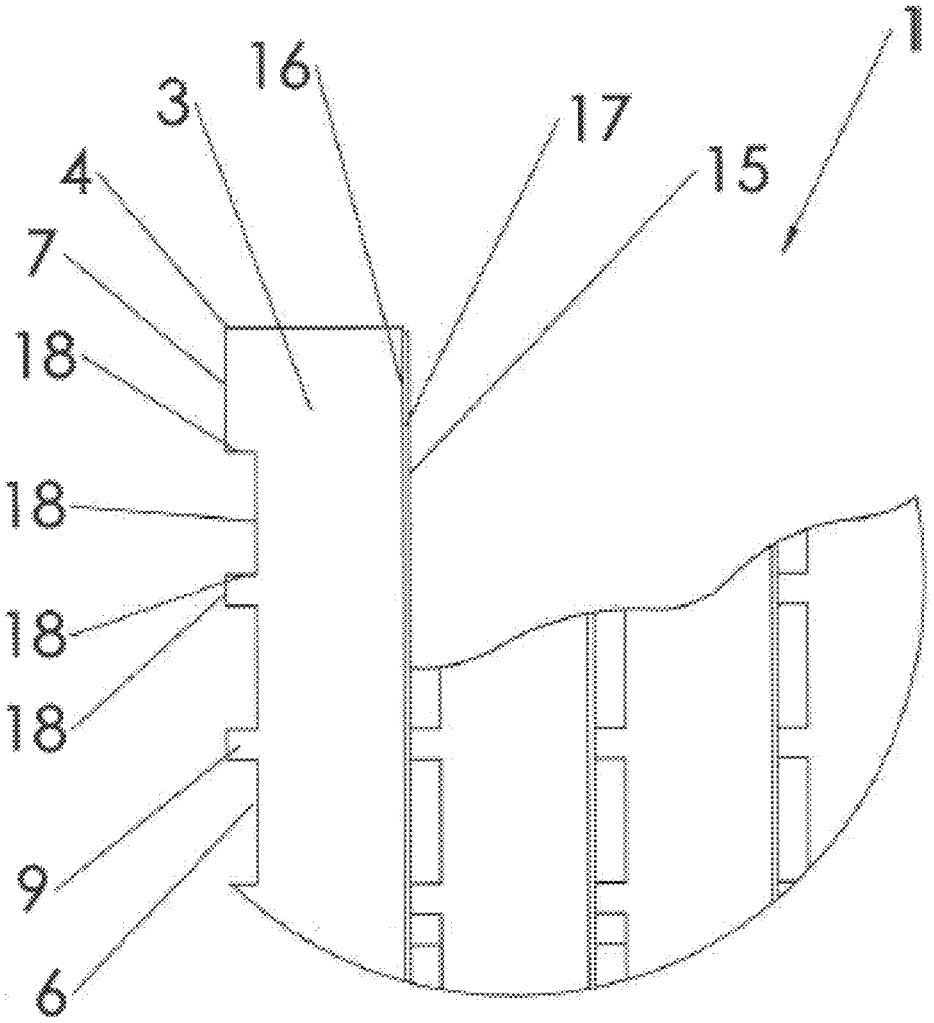
FIG. 5 is a side section view of the deionizing panel shown in FIG. 1.

Referring to FIG. 5, the cross section of the cross channels 6 can be seen. The back side 15 of the embossed film 3 mates with the front surface 7 of an adjoining embossed film 3. The back side 15 encloses the fourth wall of the cross channels 6 of the adjoining embossed film 3. From the prospective of FIG. 4, the 3 dimensional aspect of the cross channels 6 can be seen. To allow maximum flow, the channels should be tall in relationship to the dividing walls.

All of the channels and the front face of the embossed film 3 would be coated with an electrically conductive coating forming a conductive front layer 18 (see FIG. 5). The conductive front layer 18 may be over coated with a protective coating to increase its durability to the fluids flowing in the various channels. The coating may also be applied to isolate the conductive front layer 18 electronically from neighboring conductors (if applicable). For electronic isolation the coating would only be required on the front face.

As mentioned earlier, the front surface 7 including the cross channels 6 of the embossed film 3 are coated with an electrically conductive layer. The back side 15 of the embossed film 3 is also coated with the electronically conductive layer forming the conductive back layer 16. For ease of manufacturing the entire back surface may be coated. The entire back surface does not necessarily need to be coated. The conductive back layer 16 is shown covered with an electrically insulating layer 17. A layer of this type is required to keep the conductive front layer 18 and the conductive back layer 16 from making electrical contact.

Alternately the electronically insulating layer could be eliminated if an insulation layer was applied to the front surface 7 of the embossed film 3.

Figure 6:
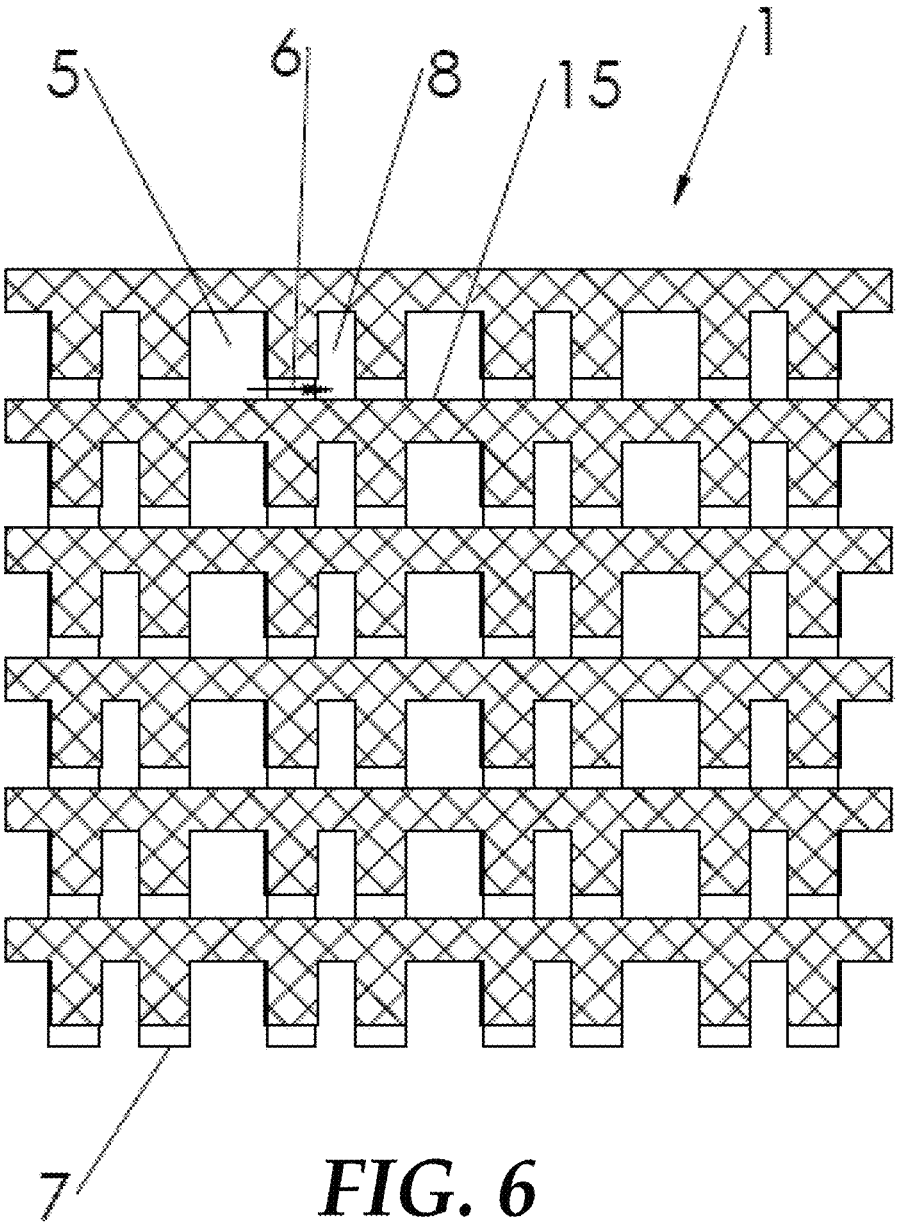
FIG. 6 is a top partial section view of the deionizing panel shown in FIG. 1.
Figure 7:
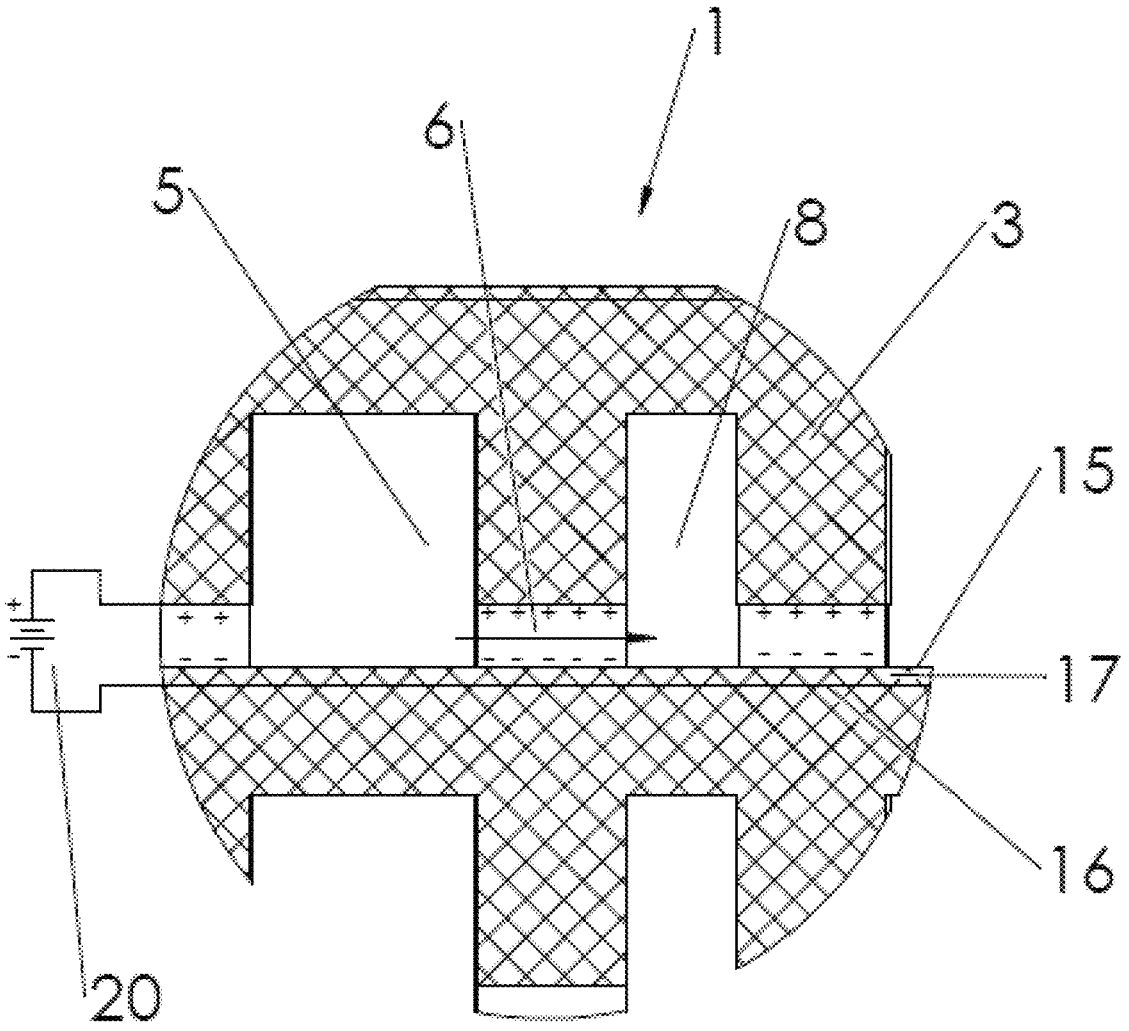
FIG. 7 is a close-up of the view shown in FIG. 6 that includes an electrical schematic.

Referring to FIGS. 6 and 7, a top section view of the deionization panel 1 shows the width of the inlet channels 5 and outlet channels 8 in relation to the cross channels 6. Note the width of the inlet channels 5 and outlet channels 8 vary at different heights along the film. This particular view is towards the top of the deionization panel 1 where the inlet channel 5 is wider than the outlet channels 8.

Referring specifically to FIG. 7, the electrical state of the system is shown. The back side 15 of the embossed film 3 is shown to be negatively charged. This is accomplished by connecting the conductive back layer 16 to a voltage source. The positive side of the voltage source is connected to the conductive front layer 18 on the front surface 7 of the embossed film 3. An opposite connection of the voltage source to the electrically conductive layers could also be made.

The charges could alternately be embedded in the embossed films 3. Embedding charges in plastic films is commonly done on films used in microphones. One knowledgeable in the art of charged plastic could engineer a charged film to meet the needs of a particular deionization system. It should be noted that charges created by an external source can be turned on and off. Embedded charges cannot be switched off.

By applying opposing charges to opposing surfaces of the cross channels 6 either positive or negatively charged particles are attracted to at least one of the surfaces of the cross channels 6. The distance between the charged surfaces is controlled by the height of the cross channel dividing walls 9.

As mentioned earlier, when manufacturing was discussed, the dimension and the tolerance of the depth of these channels may be extremely small and controlled with great accuracy when semiconductor and MEMS equipment and processes are used to make the tool for film fabrication.

Figure 8:
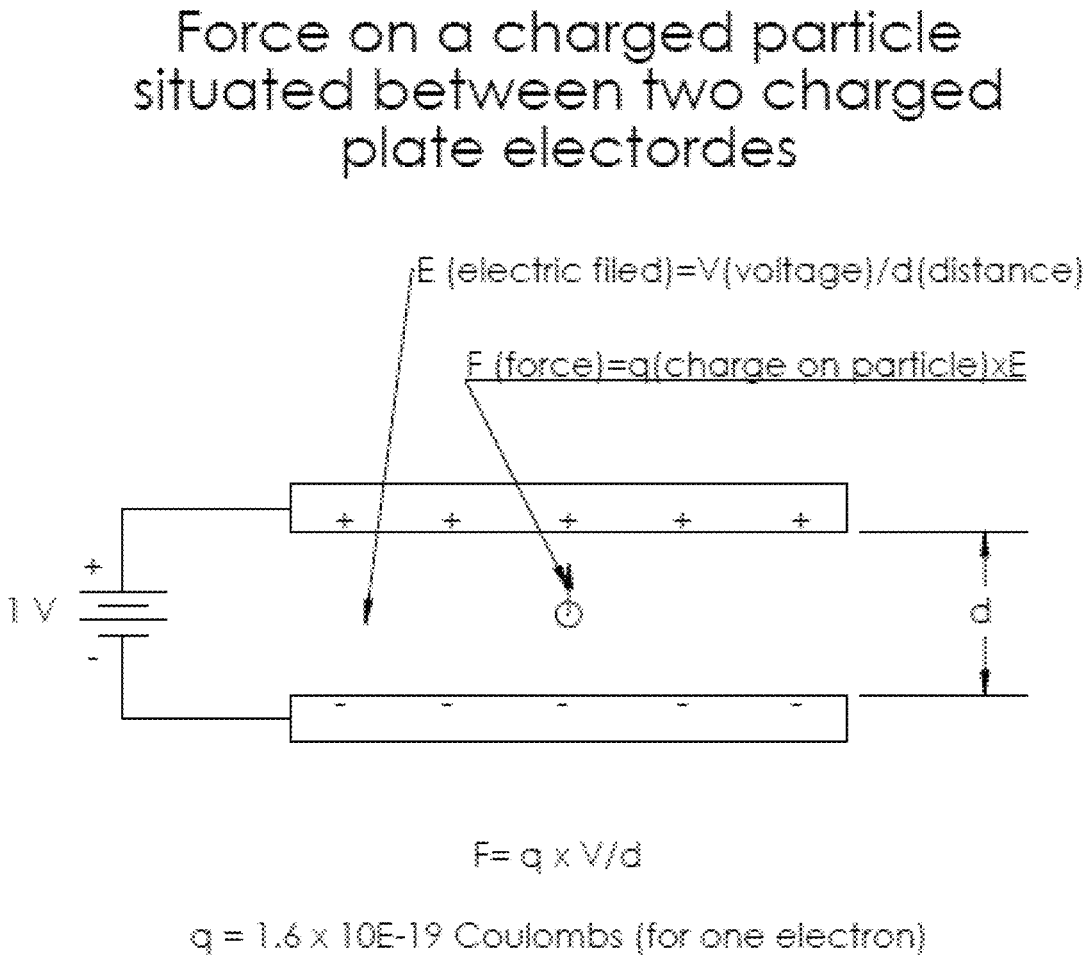
FIG. 8 is an electronic schematic diagram describing the electrical operation of the deionization system.

Referring to FIG. 8, the equation for the force on a particle when located between two charged surfaces is shown. From the equation it can be seen that the distance between the charged surfaces greatly affects the force. With a potential of 1 volt and a distance of 50 microns between the charged plates a force of 3.2×10E-15 Newtons. 3.2×10E-15 (Newtons)=1.6×10E-19 (Coulombs of charge)×1 (volt)/5×10E-5 (meters)

Newtons are exerted on a particle with a change of one electron. When the distance is reduced to 20 microns the force is increased to 8.0×10E-15 Newtons. From this equation it can be seen that having a small distance creates greater force which is typically desirable. A small distance does restrict fluid flow. This restriction is mitigated by the fact that there are a large number of cross channels 6 and that they are tall in relation to the depth of the cross channel dividing walls 9.

Another advantage to having a small distance between the charged plates is reduced power consumption. Reducing the distance a charged particle has to move along the electric field decreases the energy required to deionize a fluid.

The distance the fluid flows along the cross channel 6 also affects the required power. The viscosity of the fluid effects the time it takes for a charged particle to travel to the surface of one of the charged plates. The length of the cross channel 6 would preferably would be designed to be at least as long as it takes for a particle to be drawn to one of the charged plate. It may be longer than what is required to allow for the buildup of particles. The length of the cross channel 6 effects the restriction of flow through the deionization panel 1. This restriction can be mitigated by incorporating a large number of flow channels.

Figure 9:
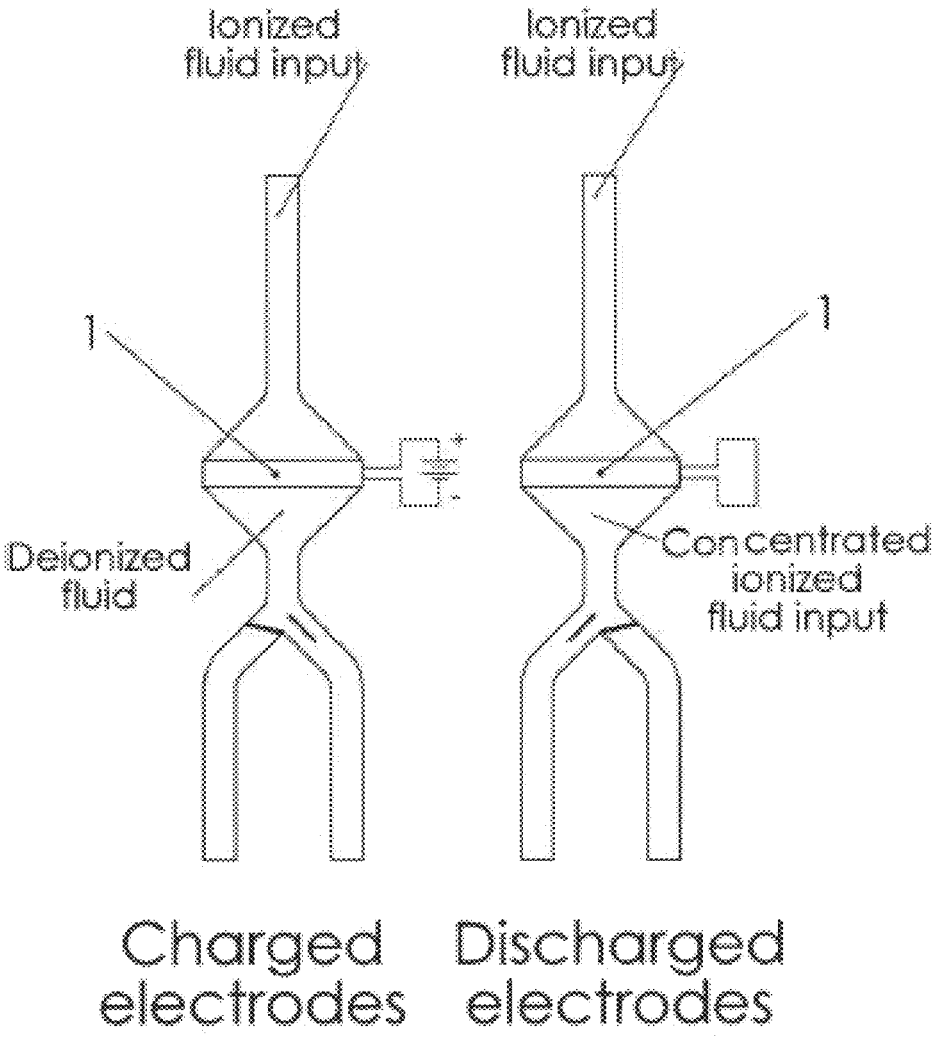
FIG. 9 is a system diagram of the deionization panel deployed in a deionization system.
Figure 10:
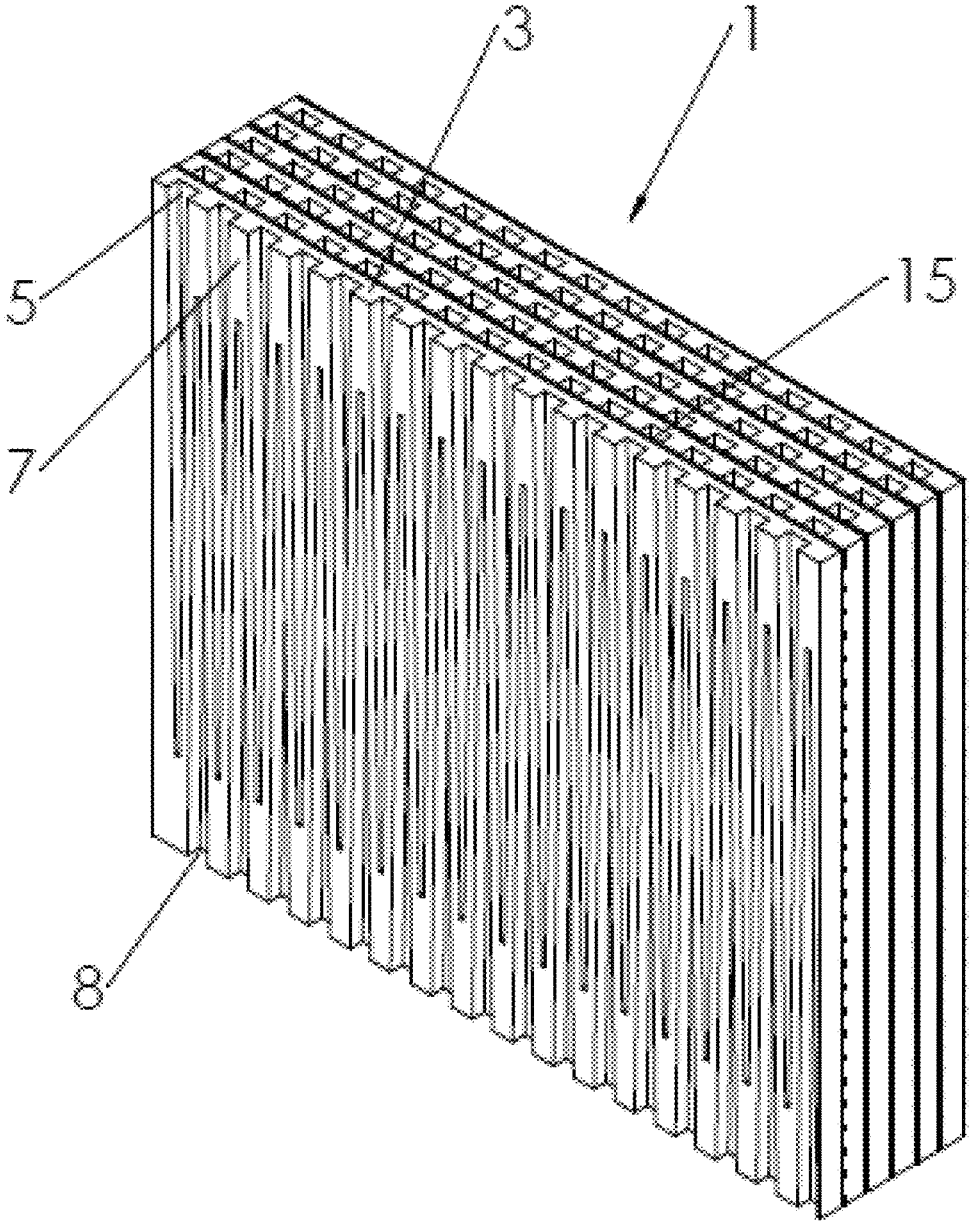
FIG. 10 is an isometric view of an alternate configuration of the cross channels in a deionization panel.
Figure 11:
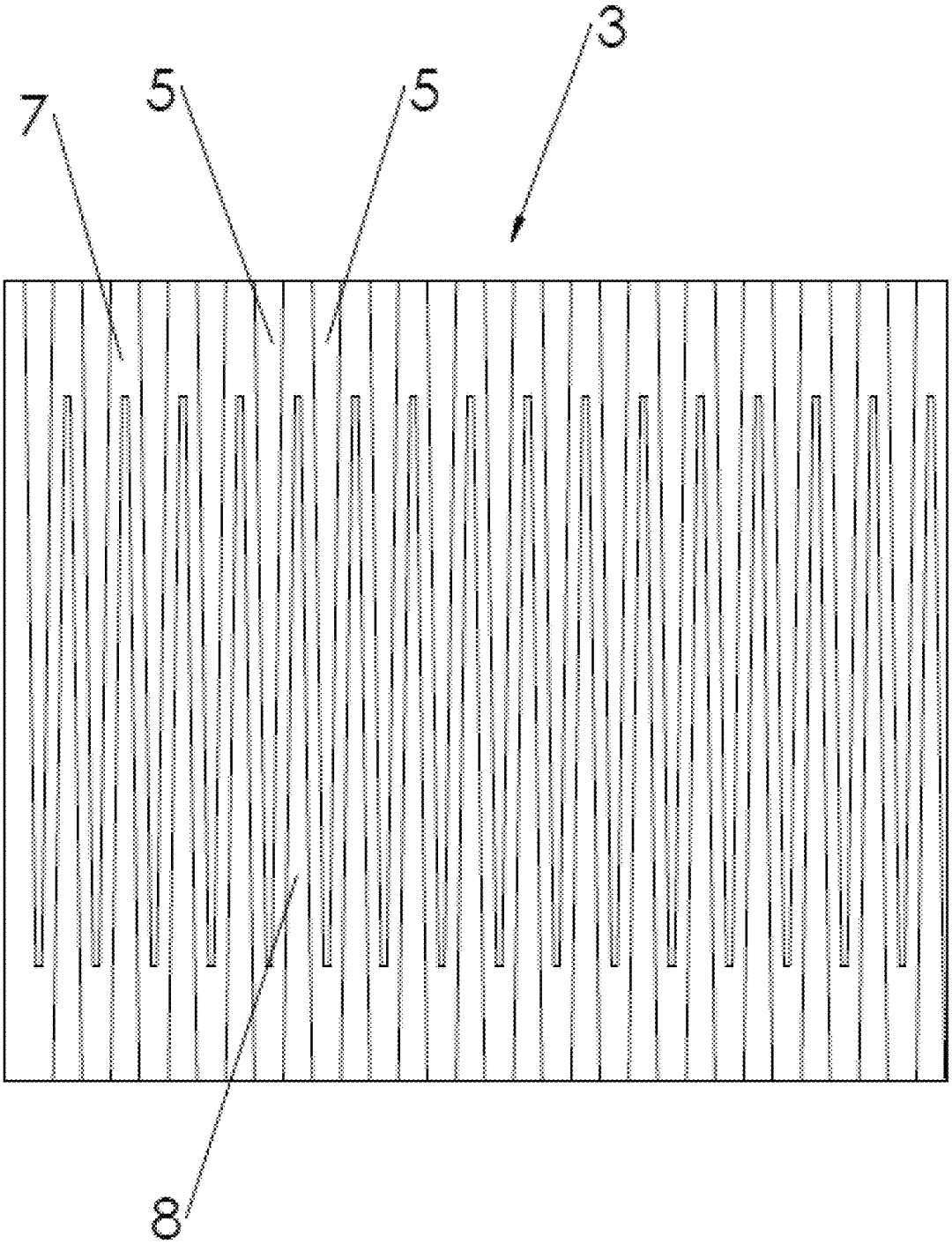
FIG. 11 is a front view of one embossed film of the alternate embossed film FIG. 10.
Figure 12:
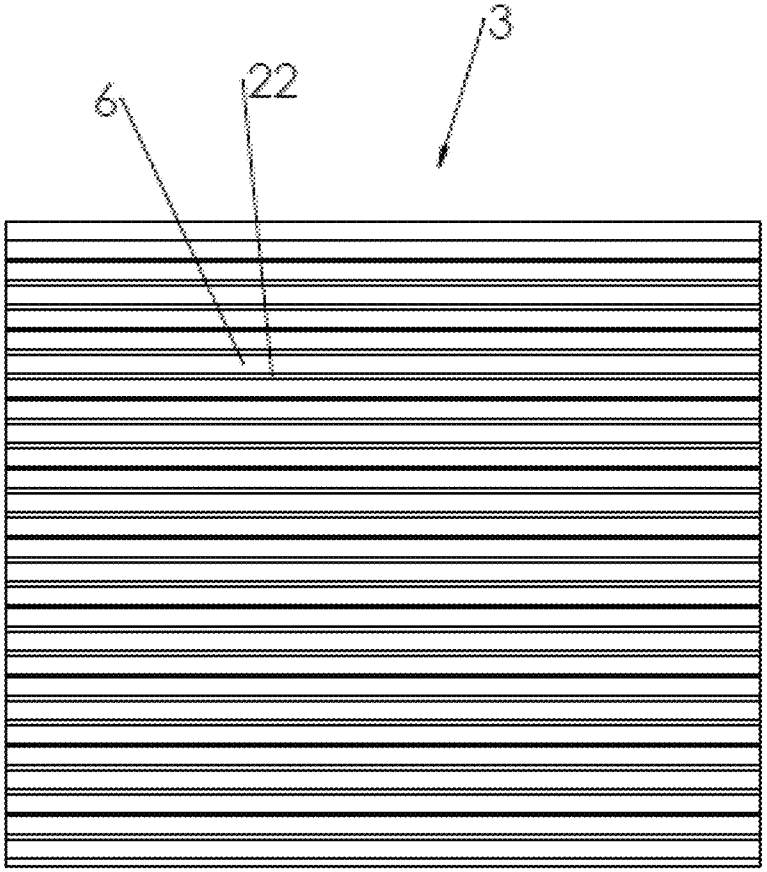
FIG. 12 is a back side view of the alternate embossed film shown in FIG. 11.
Figure 13:
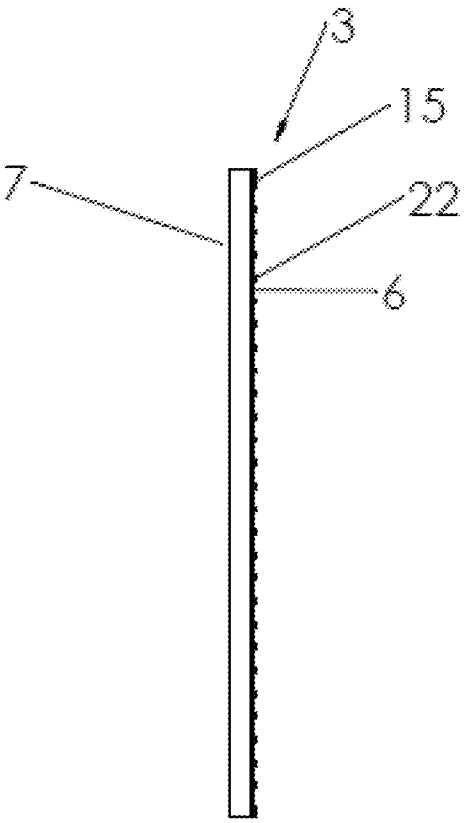
FIG. 13 is a side view of the alternate embossed film shown in FIG. 11.

Referring to FIG. 9, a system diagram of a deionization system is shown utilizing the deionization panel 1. When the deionization panel 1 is charged, it deionizes the fluid that flows into the deionization panel 1. A valve may be used to direct this fluid to a reservoir or another system. Over time, ionized particles collect on the surfaces of the charged plates of the embossed film 3. At some point the number of ionized particles becomes great enough that the performance of the system is reduced. At some point it becomes necessary to purge the particles.

A second valve in conjunction with the 1st valve can be reconfigured to direct the flow to a second system or reservoir. After the valve configuration is changed the electrical charge on the plates is removed and the ionized particles flow with the fluid to the second system or reservoir. This fluid would have a high concentration of ionized particles. The deionization panel would then be charged and the valves returned to the original configuration.

The fluid with a high concentration of ionized particles may be processed further to extract specific elements or compounds from the fluid for use elsewhere.

Referring to FIGS. 10, 11, 12 and 13, collectively, an alternate configuration of the deionization panel 1 is shown. The cross channels 6 are located on the back side 15 of the embossed film 3 rather than the front side. The back side 15 configuration can best be seen in FIG. 13.

Figure 14:
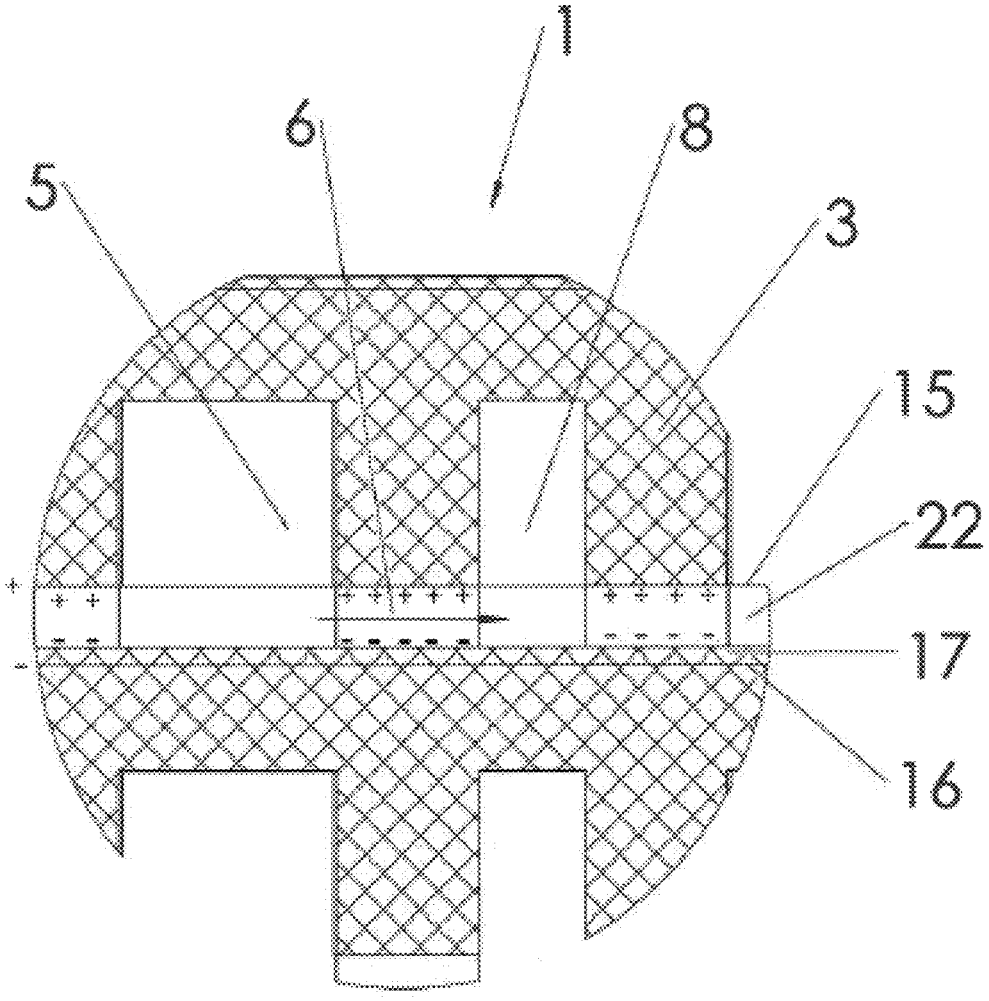
FIG. 14 is a top partial section view of the alternate deionization panel shown in FIG. 10 that also shows an electrical schematic.

Referring to FIG. 14, the location of the charged surfaces can be seen for the alternate configuration. In this configuration, the backside channel walls 22 are located on top of the insulation layer 17.

Figure 15:
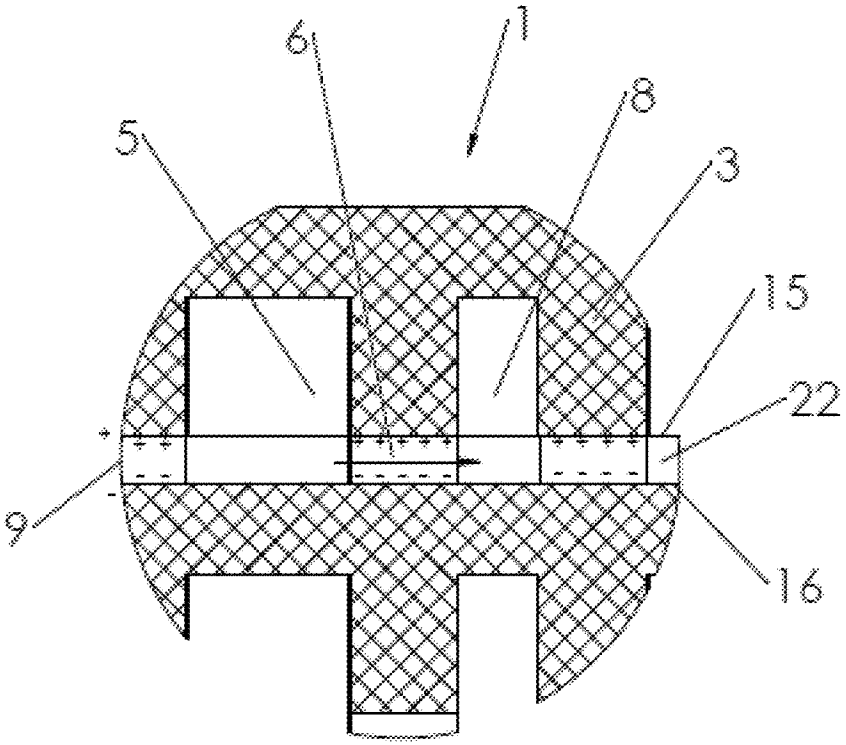
FIG. 15 is a top partial section view of the alternate deionization panel shown in FIG. 14 configured without an insulating layer.

Referring to FIG. 15, another alternate configuration of the charged surface is shown. When the cross channel dividing walls 9 are formed on the back side 15 of the embossed film 3 they can also serve the purpose of electrically insulating the conductive front layer 18 (see FIG. 5 for an example conductive front layer illustration) from the conductive back layer 16. With this configuration, insulation layer 17 is not shown and is not required.

Figure 16:
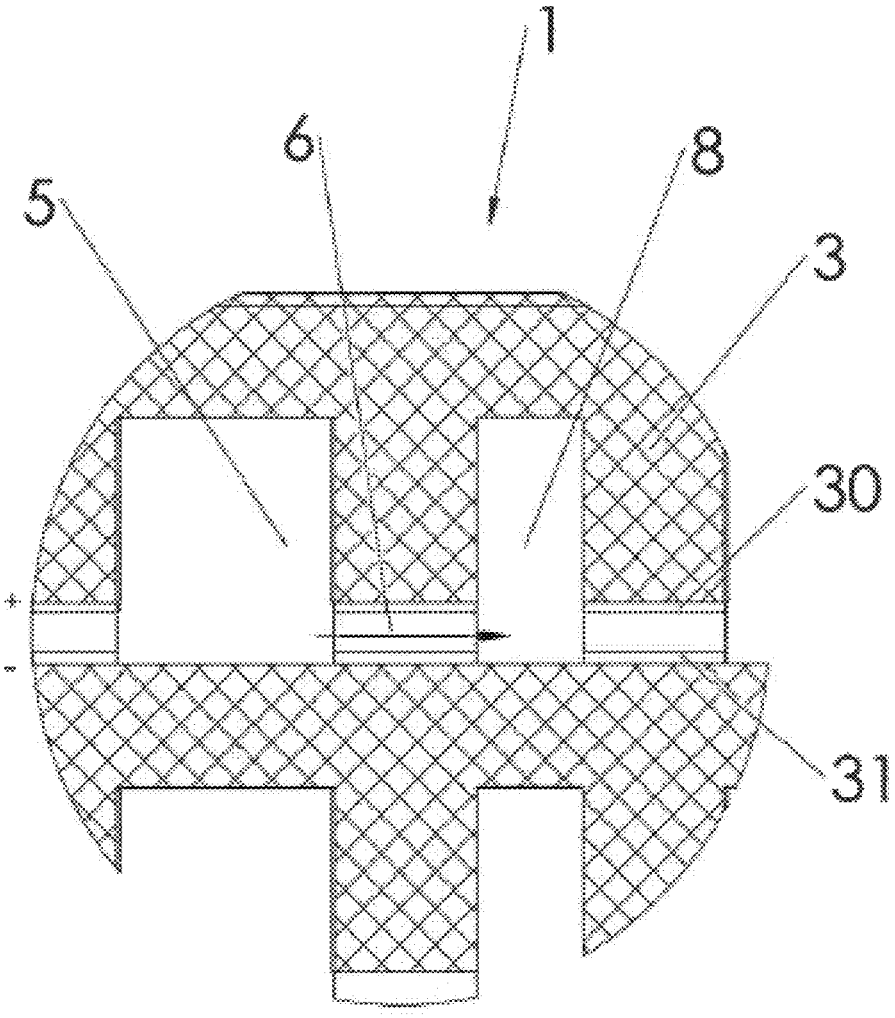
FIG. 16 is a top partial section view of the deionizing panel with coated channel walls.

Referring to FIG. 16, the cross channels 6 are shown to be coated with an additional material 30 and 31. This material might be a porous electrically conductive material such as carbon particles. Small carbon particles might be used to increase the surface area and collection of charged particles. Alternately the surface may be textured to create more surface area. The surfaces may also be coated with an inert material to reduce the deterioration of the conductive layers.

Figure 17:
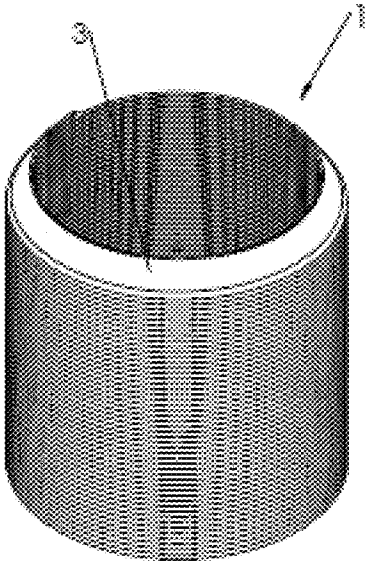
FIG. 17 is an isometric view of a cylindrical configuration of the deionizing panel.

Referring to FIG. 17, an alternate configuration of the deionization panel 1 is shown. Previous Figures depicted the film laminated in linear layers. FIG. 17 shows the layers of film configured in the shape of a cylinder. In this configuration the flow would be from either the inside of the cylinder to the outside or in reverse. The embossed film 3 would be wound into the cylindrical shape and could be one long continuous piece of material. This configuration would allow roll to roll processes for fabrication. Roll to roll processes are the most cost efficient method of manufacturing embossed films 3.

Figure 18:
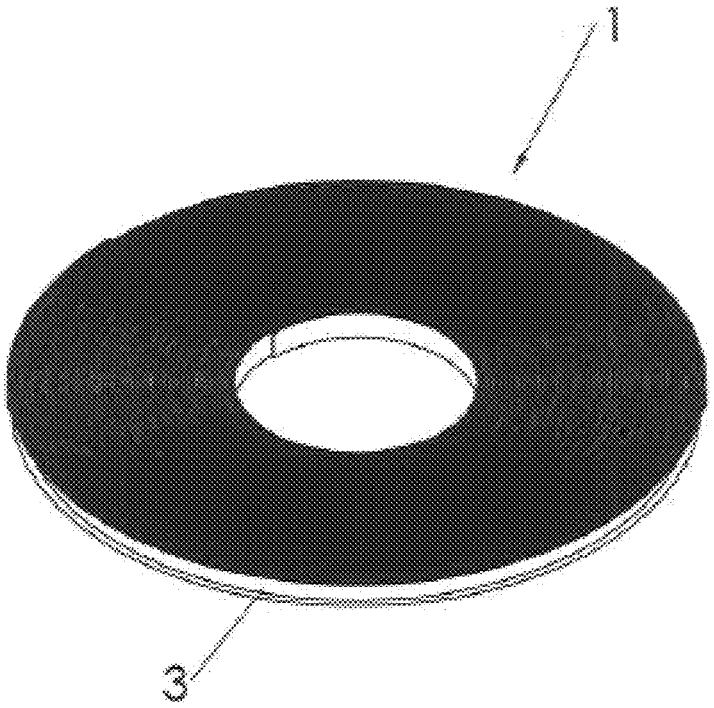
FIG. 18 is an isometric view of a spiral configuration of the deionizing panel.

Referring to FIG. 18, another alternate configuration is shown. The deionization panel 1 is shown rolled into a spiral where again, one long length of film is wound over itself to create a disk. Roll to roll processes work well with this configuration too.

Another alternate configuration of the deionization system would be to assemble more than one deionization panel 1 in series. This might be done to add redundancy. Further a filter or series of filters may be added upstream of the deionization panel 1 to eliminate other types of particles that would either not be collected by the deionization section or might clog the deionization section of a deionization system.

Figure 19:
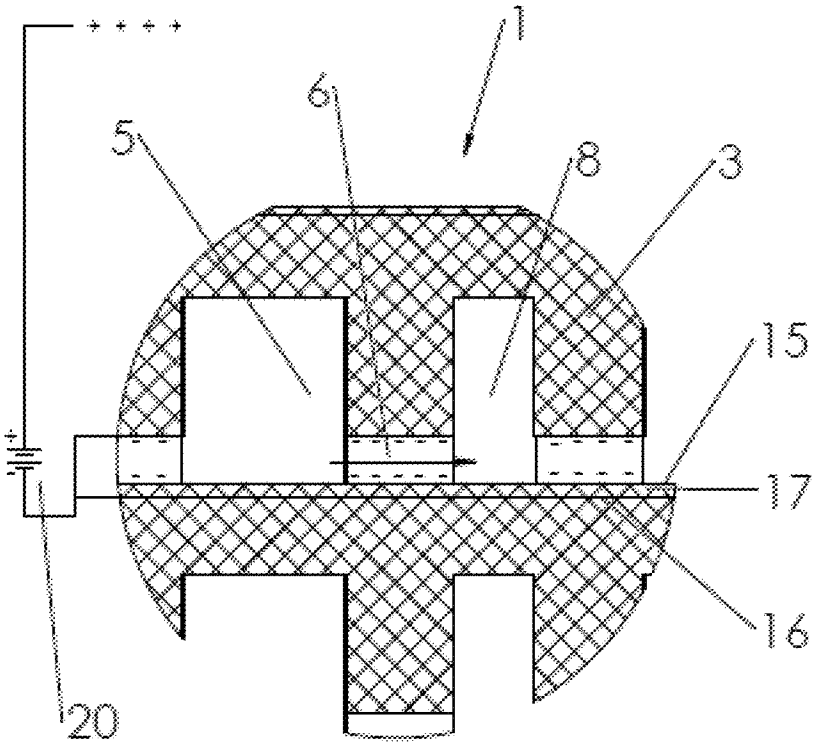
FIG. 19 is another alternate configuration of the charged plates.

Another alternate configuration of the invention is shown in FIG. 19. Both of the plates on the cross channels 6 are charged negatively. In this case, only positively charged particles would be attracted to the surfaces. The positive side of the voltage source could be used to induce a positive charge on particles before they flow through the deionization system. The potential of the plates could, with the same effect be charged positively with the upstream flow charged negatively.

FIGS. 20-37 collectively illustrate micro-structured filters with cross channels that can be used for the selection of specific sized particles and/or for cleaning purposes.

Figure 20:
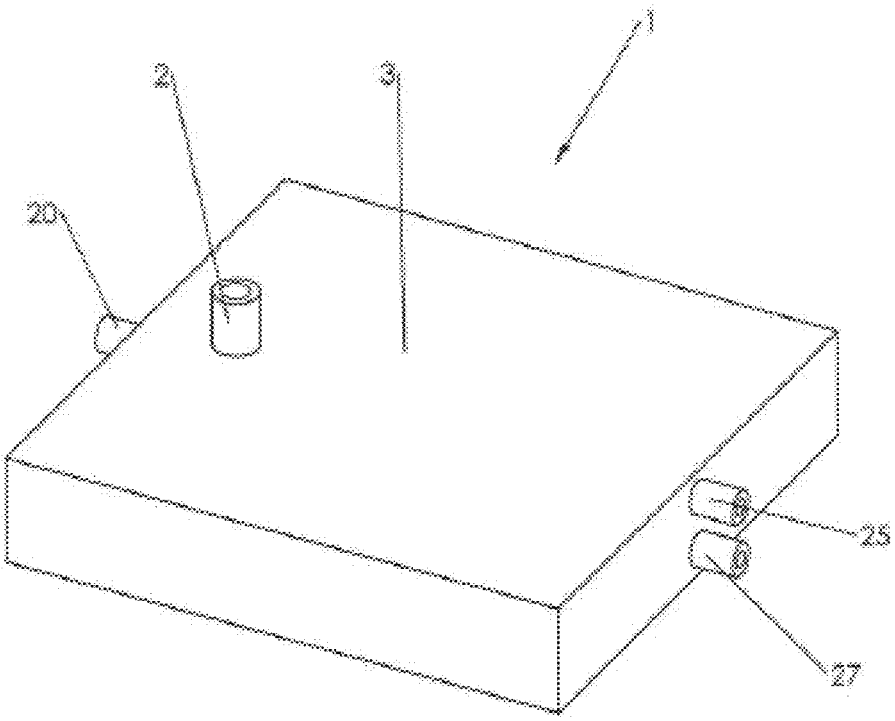
FIG. 20 is a perspective view of the selective filter system of the present invention.
Figure 21:
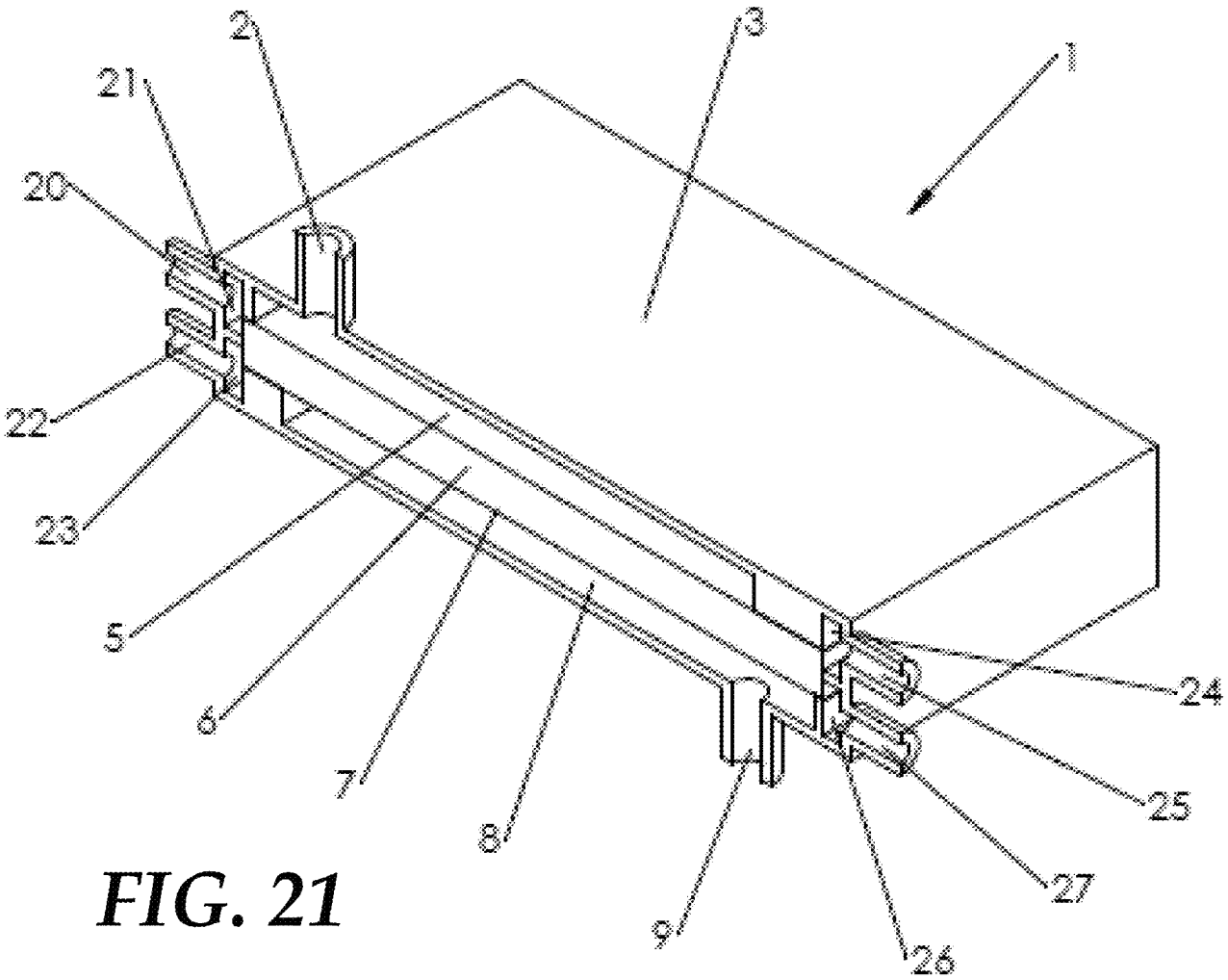
FIG. 21 is a sectioned perspective view of the selective filter system shown in FIG. 20.
Figure 22:
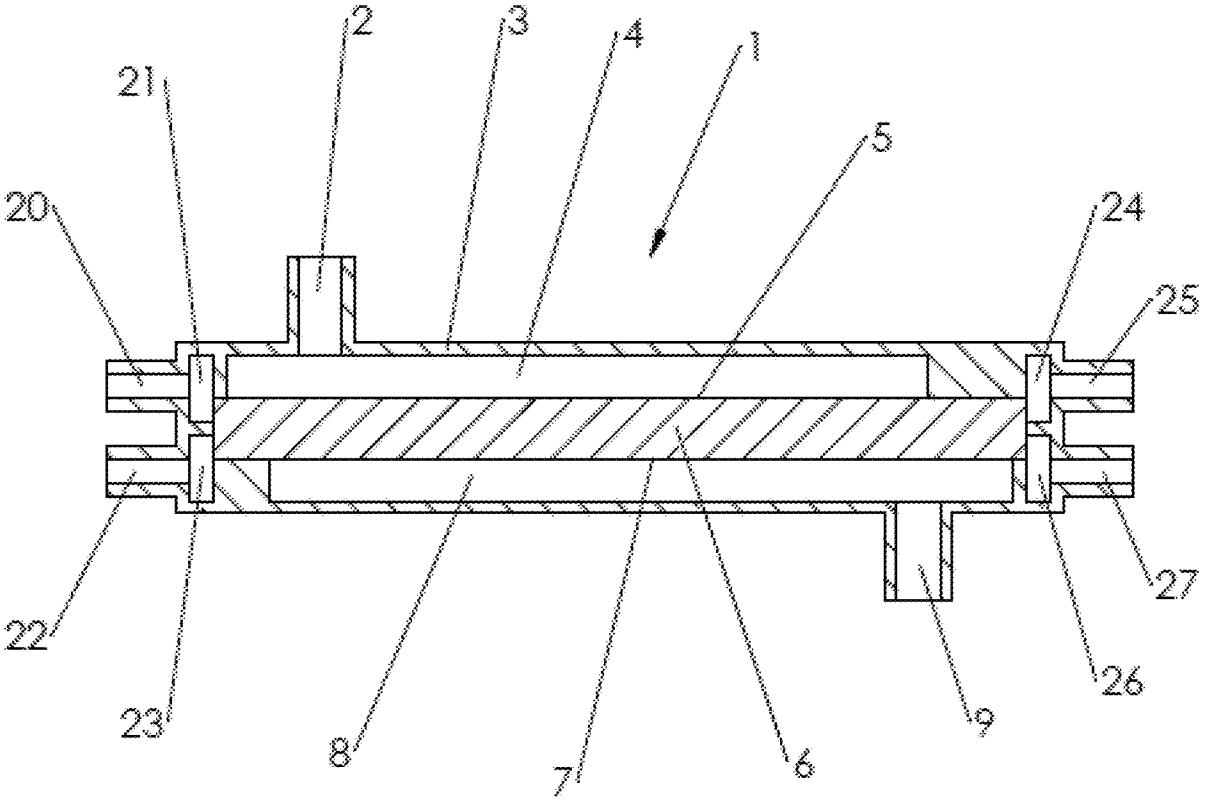
FIG. 22 is a front view of the section shown in FIG. 21.

With reference to FIGS. 20, 21 and 22, collectively, the selective filter system 1 is shown. Fluid or gas flows into the selective filter system 1 from the fluid inlet 2 located on the top surface of the housing 3. The housing 3 encloses the upper plenum 4, filter panel 6, and the lower plenum 8. It should be noted that the filter fluid can be a gas, a liquid or a flow of small particles acting as a liquid. Examples of a flow of small particles are grains, seeds, sand or gravel. The upper plenum 4 constrains the flow of the fluid from the fluid inlet 2 to the filter panel top surface 5 of the filter panel 6. It does not allow flow to other areas of the system. The top and side surfaces of the housing 3 seal with the filter panel top surface 5 of the filter panel 6 to form the upper plenum 4. The interface of the sides of the housing 3 to the filter panel top surface 5 of the filter panel 6 might include a gasket or an adhesive to take up variations in the surface topography of these components and seal them together. No gasket is shown. Similarly the lower plenum 8 constrains the flow of fluid exiting the filter panel bottom surface 7 of the filter panel 6. It directs the flow from the filter panel 6 to the fluid outlet 9.

The left and right sides of the filter panel 6 are mated to the cross flow plenums. The current selective filter system 1 is shown with the upper cross flow inlet 20 supplying cross flow fluid to the upper left hand side of the filter panel 6 by the way of the upper cross flow plenum 21. The lower cross flow inlet 22 and lower cross flow plenum 23 supply the lower left hand side with lower cross flow fluid.

In summary, selected fluid flow can be delivered to the filter panel 6 from the top surface and multiple locations from the side. The current configuration shows two fluids being delivered from the left side. This could be increased in quantity or could be reduced to one. The number of side inputs would be an engineering decision based on the fluid and the type of particle being filtered.

Figure 23:
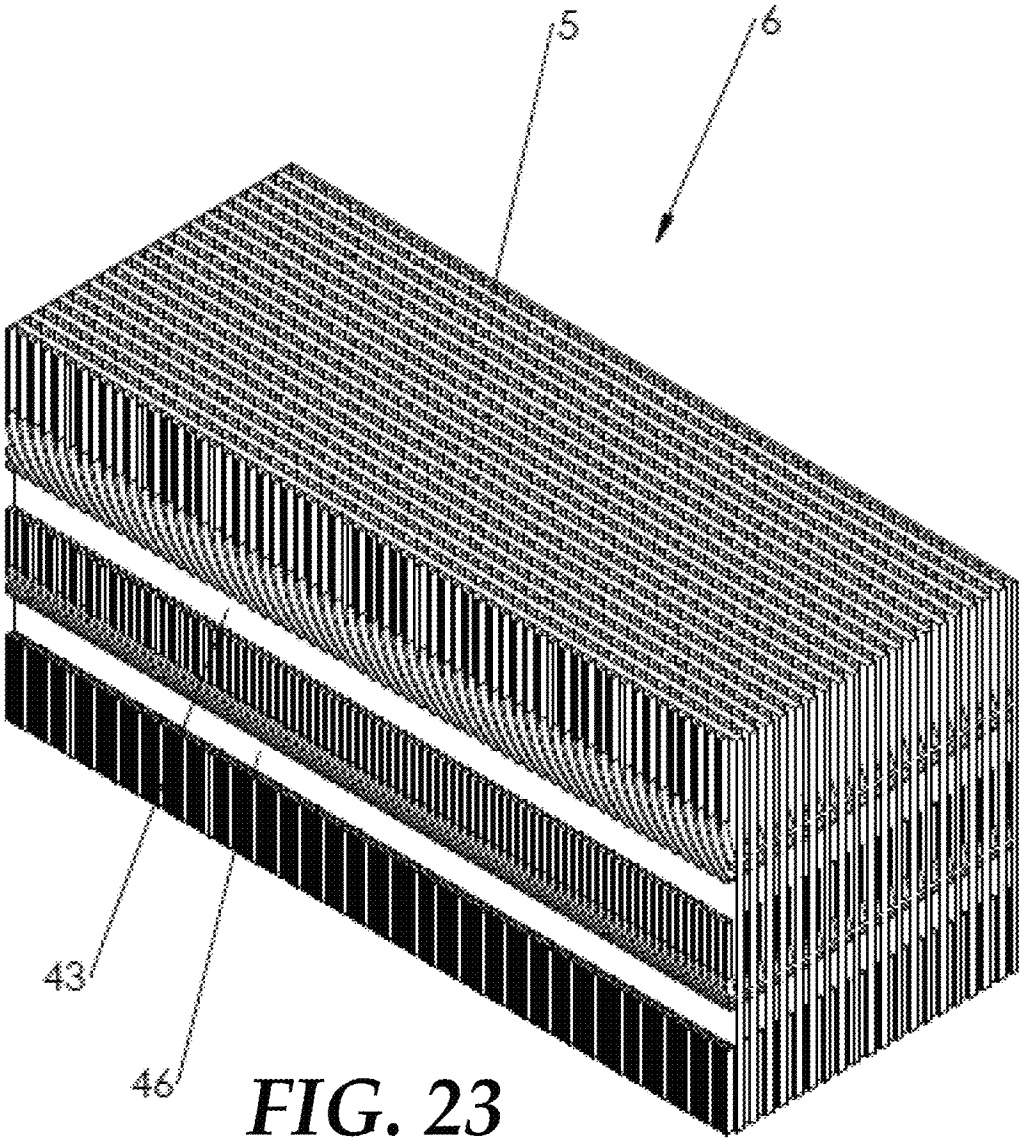
FIG. 23 is a perspective view of the filter panel.

With reference to FIG. 23, a section of the filter panel 6 is shown. The filter panel 6 is made by laminating a number of filter layers 40 together. It should be noted that for the system to function at least one layer is required. From a system throughput standpoint, it would be likely that a filter panel 6 would have a large number of filter layers 40. For large systems the number may be in the thousands.

The preferred materials for the filter layers 40 are polymers. Polymers are inexpensive materials and are typically inexpensive to manufacture. Other materials such as metals and ceramics might be used when the filter is being used at elevated temperatures. The selection of the filter layer material would be an engineering decision.

Figure 24:
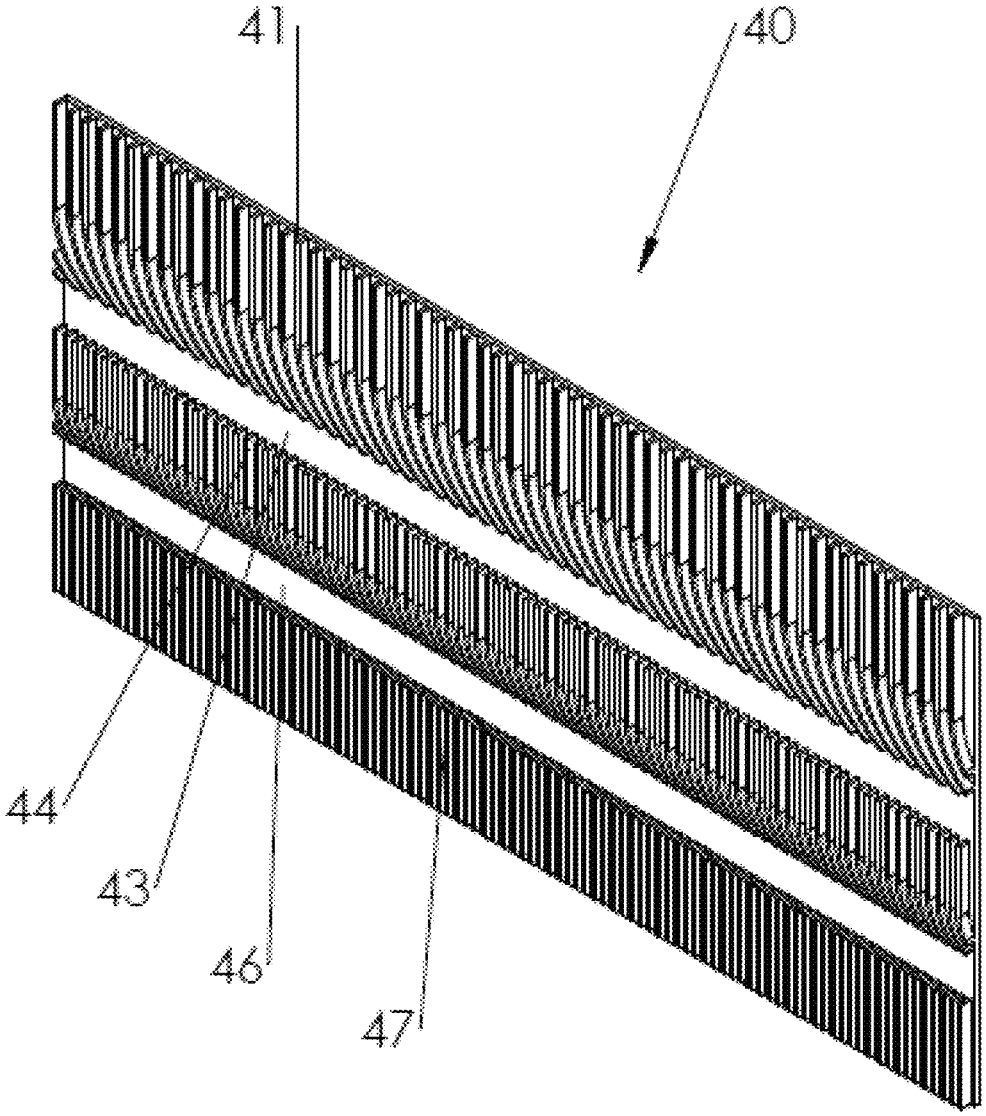
FIG. 24 is a perspective view of one layer of the filter panel.
Figure 25:
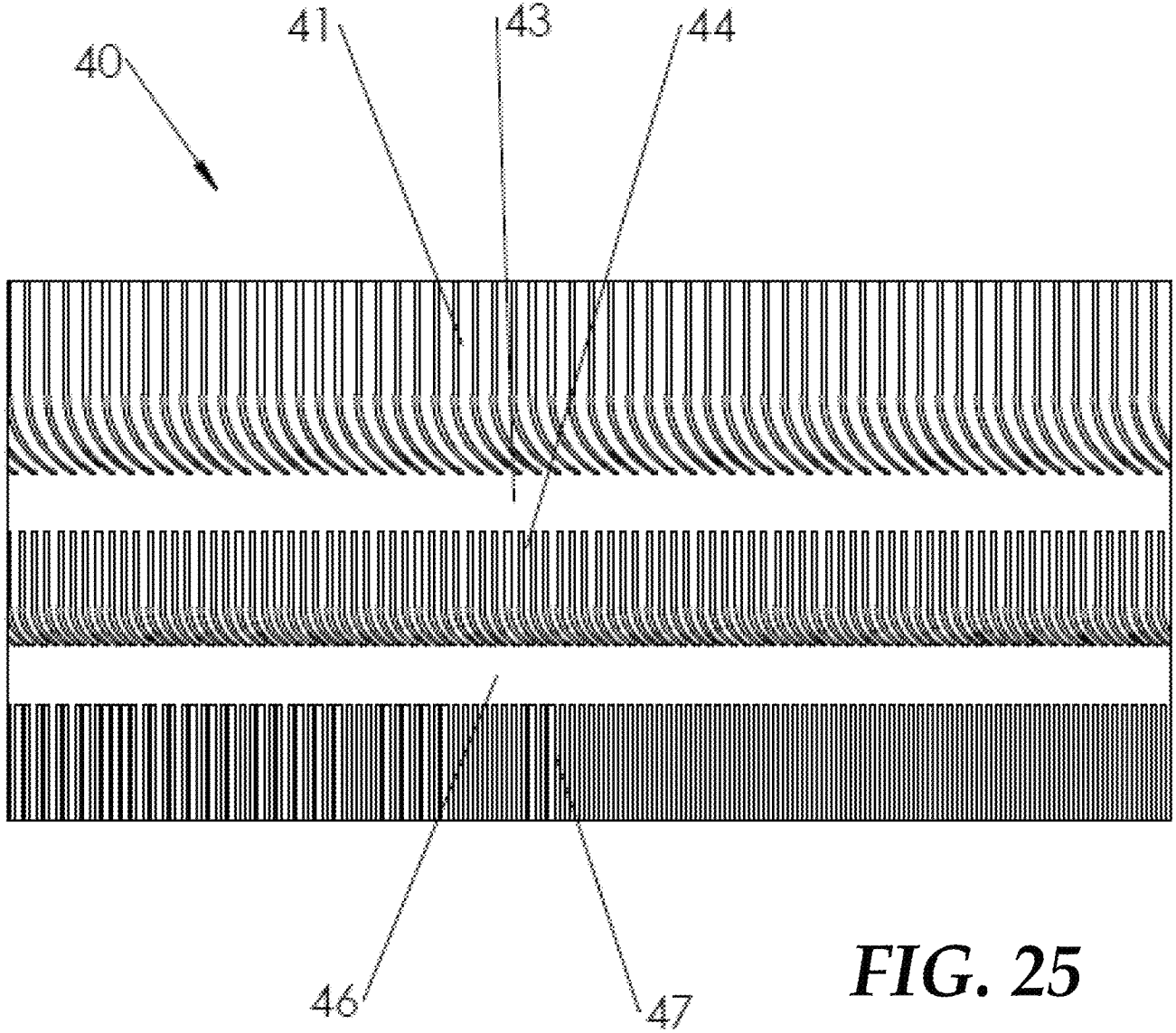
FIG. 25 is a front view of the of the filter panel shown in FIG. 24.
Figure 26:
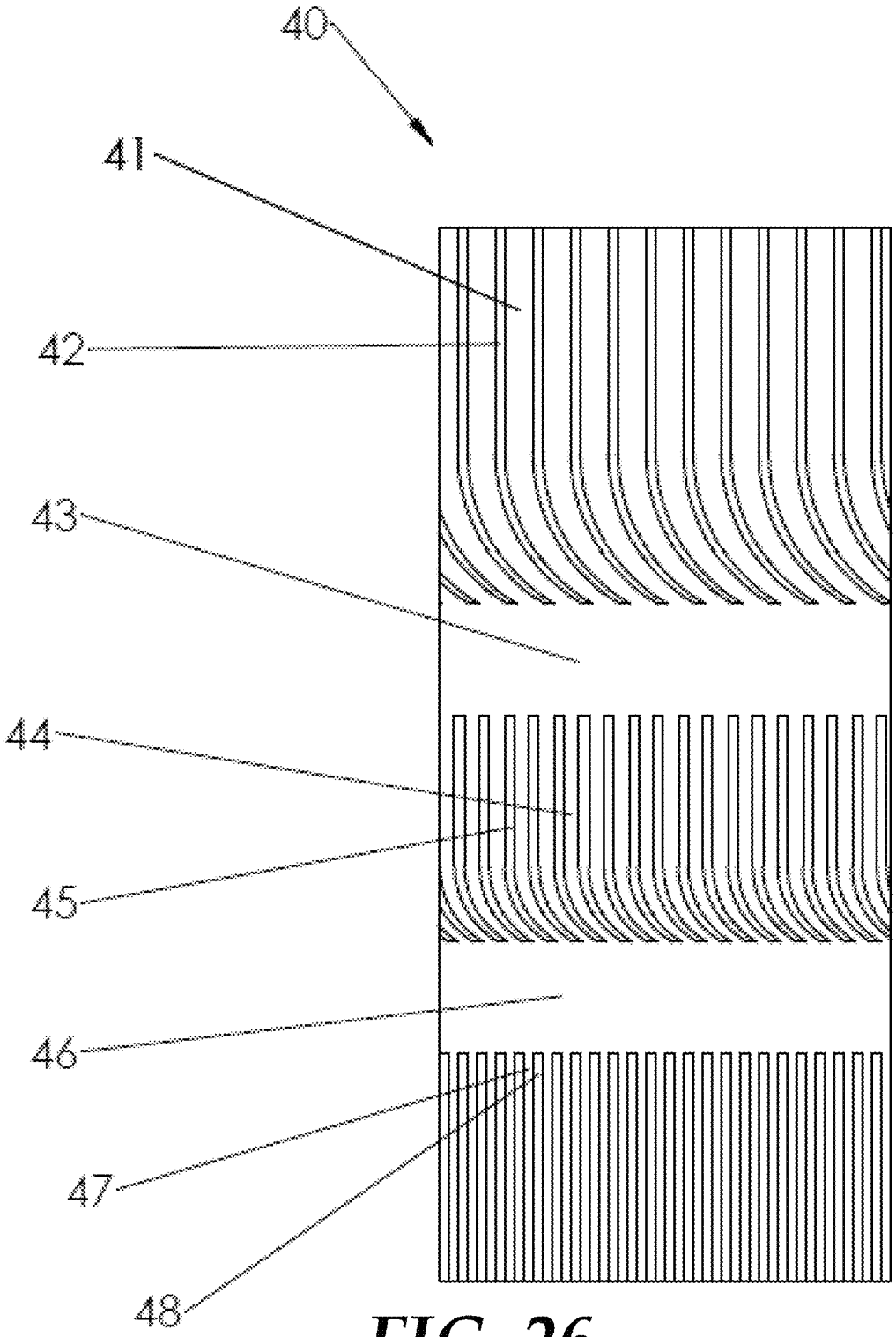
FIG. 26 is a close-up view of the of the filter panel shown in FIG. 25.

With reference to FIG. 24, only one filter layer 40 is shown. FIG. 25 and close-up FIG. 26 show the details of the filter panel 6.

As discussed earlier the input fluid flows into the filter layer 40 from the top surface 5. The fluid flows down the filter inlet channels 41. The channels are separated by inlet dividing walls 42. To aid the cross flow of fluids the filter inlet channels 41 and inlet dividing walls 42 may want to be angled or at least be angled where the fluid exits them. The actual design of the angle and geometry would be a function of the fluid and particles being filtered. The channels depicted have a curved section at the bottom to create the angle at the bottom where they exit into the upper cross channel 43. All of the flow in the filter inlet channels 41 exits into the upper cross channel 43. The upper cross channel 43 extends from the left side of the filter panel 6 to the right side of the filter panel 6.

The fluid within the upper cross channels 43 can continue to flow along the channel or it can flow into the second filter channels 44 located along the bottom of the upper cross channels 43. The second filter channels 44 are smaller than the inlet filter channels 41. They are separated by second dividing walls 45. The second filter channels 44 and the second dividing walls 45 have also have an angled geometry at the bottom.

Only particles smaller than the fluid inlet channels 41 are found in the upper cross channels 43. If any of these particles are larger than the second filter channels 44 they will be kept from entering the upper cross channels 43. Particles that are smaller than the second filter channels 44 will flow through the second filter channels to the lower cross channel 46.

The lower cross channel 46 functions the same as the upper cross channel 43. The fluid in the lower cross channel 46 can continue to flow along the channel or it can flow into the third filter channels 47. The third filter channels 47 are smaller than the second filter channels 44. So particles smaller than the third filter channels 47 flow through them and exit the filter layer 40. Particles that are larger than the third filter channels 47 are constrained to the lower cross channel 46.

By adjusting the width of the various vertical channels different sized particles can be selected and or sorted in the cross channels. It should be noted that the cross channels are fed by the cross flow plenums.

As fluid flows through the filter panel 6 as it is used, particles collect in the cross channels. When the quantity of the particles gets large the flow through the filter panel 6 becomes more restrictive. At some point it may be desirable to reduce or eliminate the restriction. A system where this condition would exist is the case of a waste water treatment system.

If the selective filter system 1 is being used to collect and retrieve a particular sized particle for use in another process or analysis the particles may want to be extracted even before the restriction is increased but when the quantity of particles gets to be large enough for the process or analysis. A system where sorting particles by size is one that would be used to sort blood cells by their size.

Figure 29:
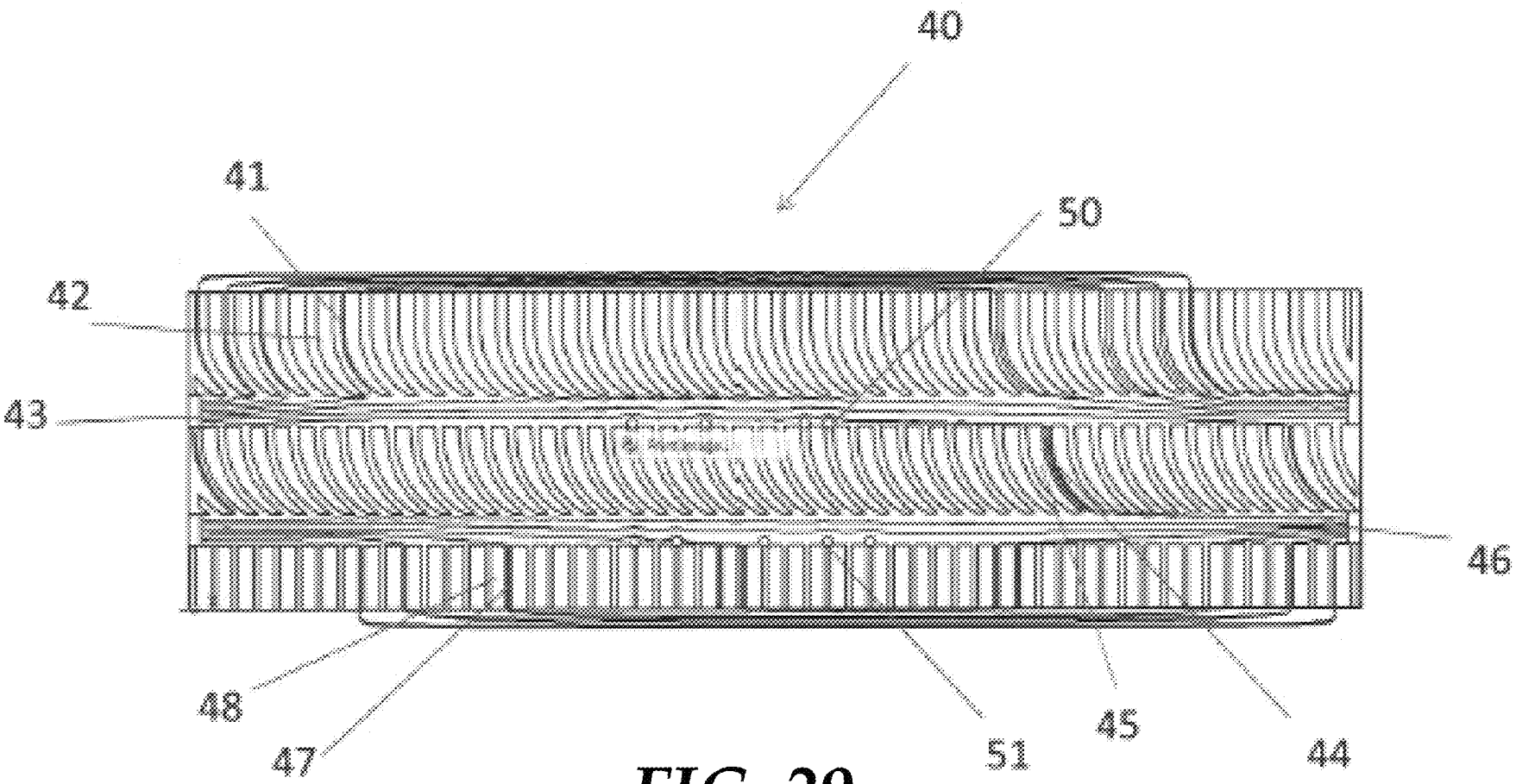
FIG. 29 is a front view of the filter layer shown in FIG. 27 with fluid flow lines with only horizontal flow.

By reconfiguring the flows into the filter panel 6 particles can be purged and collected from the filter panel 6. The preferred method to remove particles is to terminate flow from the fluid inlet while supplying flow to the cross channels. Flow lines of this state are shown in FIG. 29. The fluid used in the cross channels could be the same as the fluid flowing in the fluid inlet 2 or it could be an alternate fluid. For the case of waste water treatment the cross flow fluid may be air.

Once the particles are flushed from the cross channels the inlet fluid flow can be restarted. Vibration of the filter system or the filter panel may be deployed to increase the rate of particle removal during the purging process. Further, a slight amount of backflow of fluid from the filter outlets to the filter inlets or to the cross channels may be deployed to aid in the purging of particles. Backflow would be deployed when fluid flow through the filter inlet is stopped.

Figure 27:
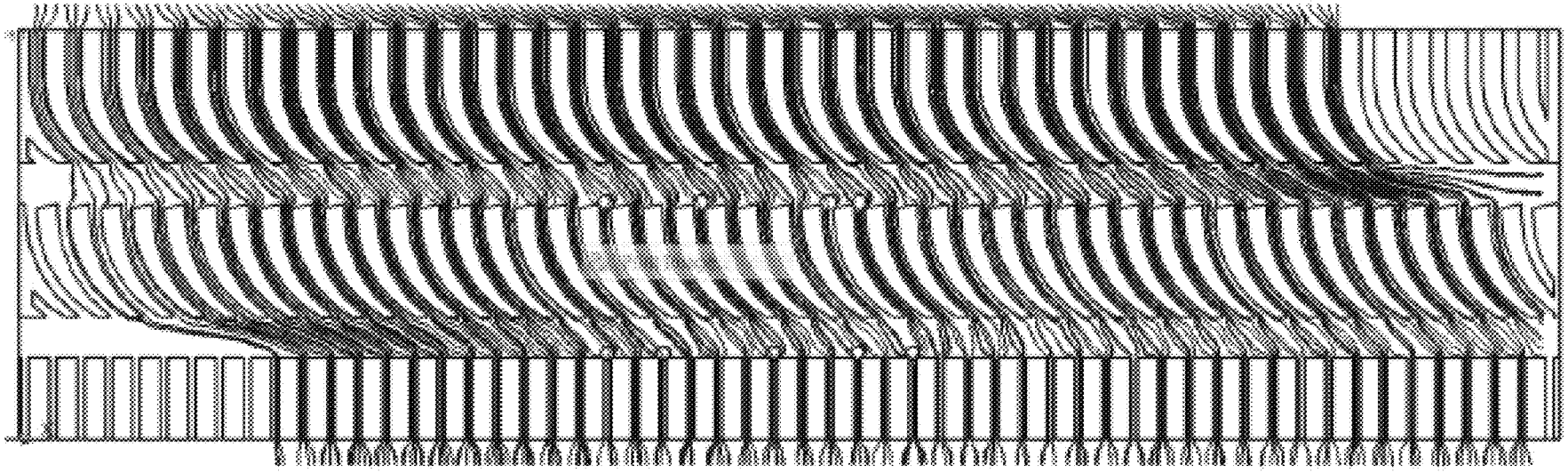
FIG. 27 is a front view of the filter layer shown in FIG. 26 with fluid flow lines with both vertical and horizontal flow.

FIG. 27 shows flow lines of flow created by a Computational Fluid Dynamics or CFD flow simulation program. The simulation was configured to have flow in both the vertical and horizontal directions. This configuration would be deployed when it is desirable to remove particles in a continuous process.

Figure 28:
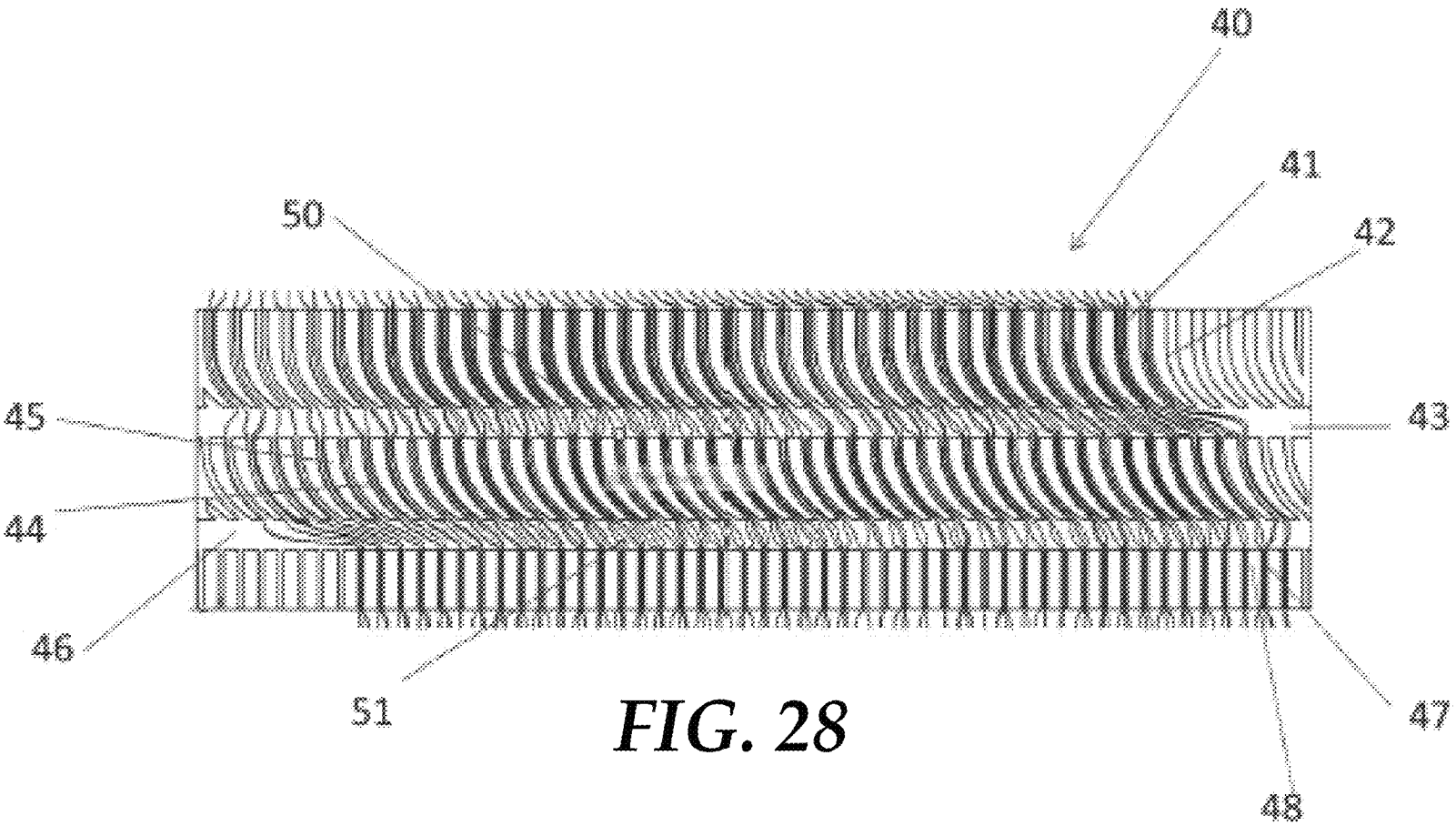
FIG. 28 is a front view of the filter layer shown in FIG. 27 with fluid flow lines from only vertical flow.

FIG. 28 shows flow lines created by flow from a CFD flow simulation program. The simulation was configured to have flow in only the vertical direction. In this configuration particles would collect at and continue to build up in the cross channels.

FIG. 29 shows flow lines of flow created by a CFD flow simulation program. The simulation was configured to have flow in only the horizontal direction. In this configuration there would be no inlet flow while particles would be removed via the cross channels.

Figure 30:
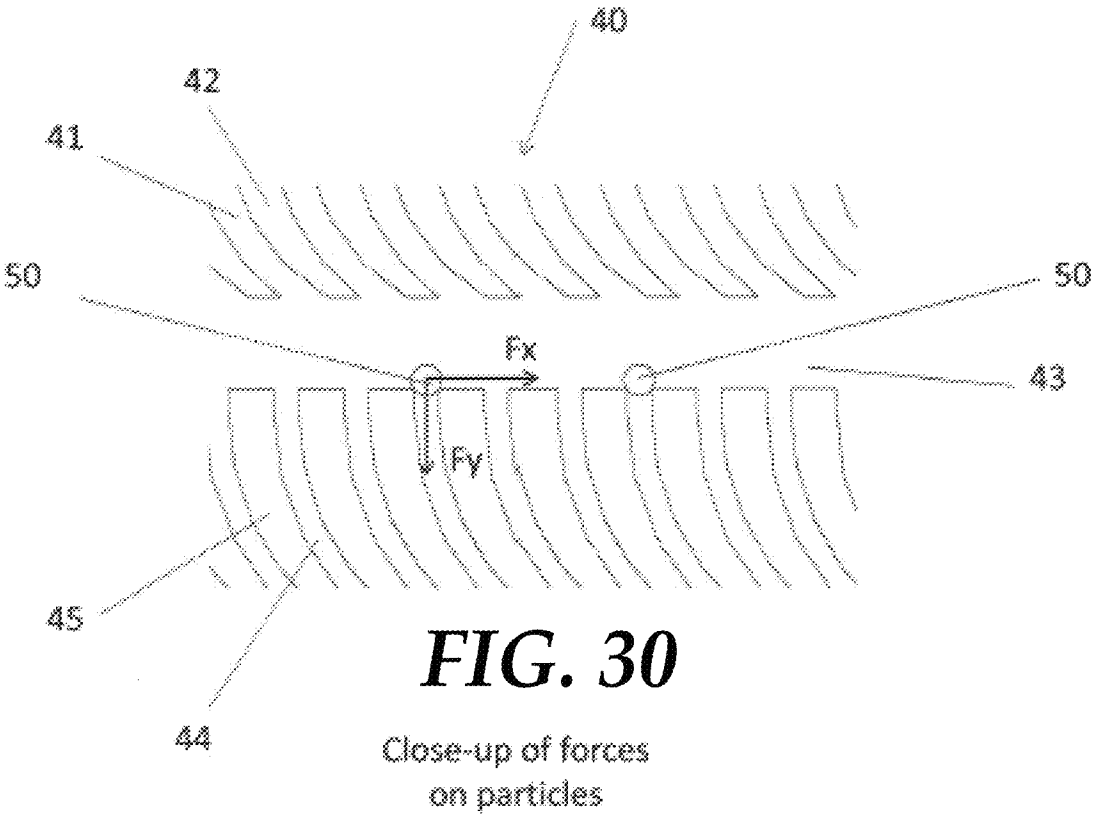
FIG. 30 is a close-up front view of a particle used to discuss the forces acting upon it.

FIG. 30 shows the forces acting on a particle. Forces acting on the particle were analyzed in both the horizontal (Fh) and vertical (Fv) directions. They were analyzed for the three different flow conditions: (1) Both vertical and cross flow, Fh=2 pN Fv=12 pN; (2) Vertical flow only, Fh=0.4 pN Fv=12 pN; and (3) Only cross flow, Fh=4 pN Fv=0.06 pN.

From the analysis in the case of 1 it can be seen that there is a substantial amount of force acting on the particles to drive them along the cross channel to the to the cross flow output. Case 2 shows that when there is vertical flow only, a small amount of force acts on the particles to move them to the cross flow output. Case 3 shows there is a lot of force acting on the particle when there is only a cross flow.

Figure 31:
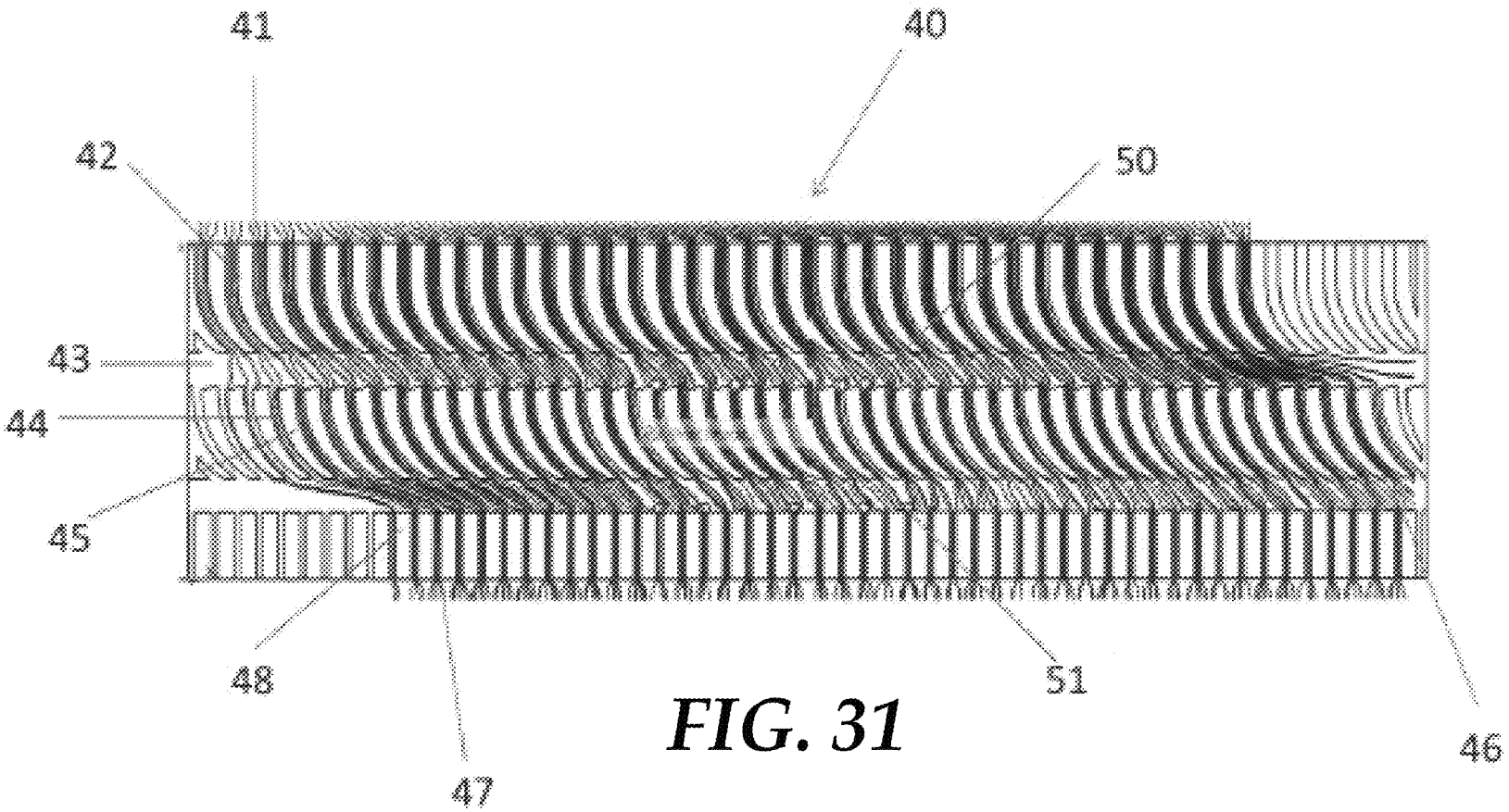
FIG. 31 is a front view of the filter layer with tapered input surfaces.
Figure 32:
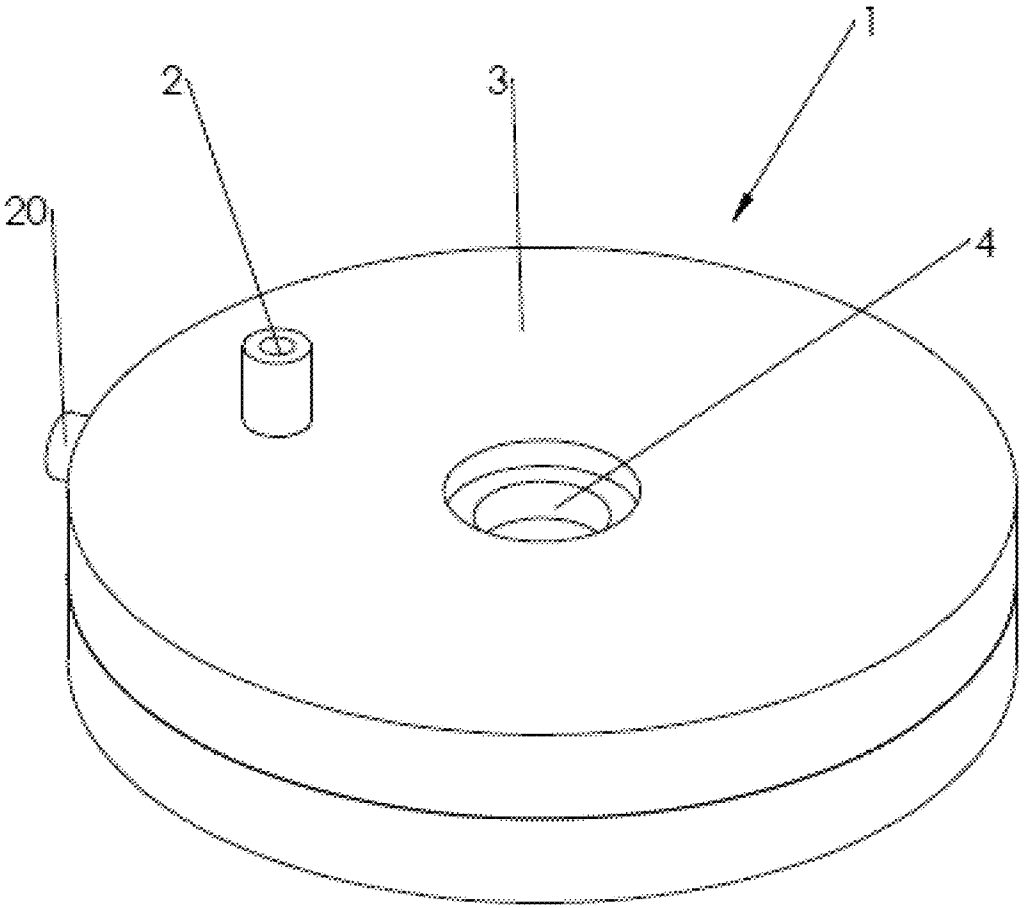
FIG. 32 alternate round system isometric view.
Figure 33:
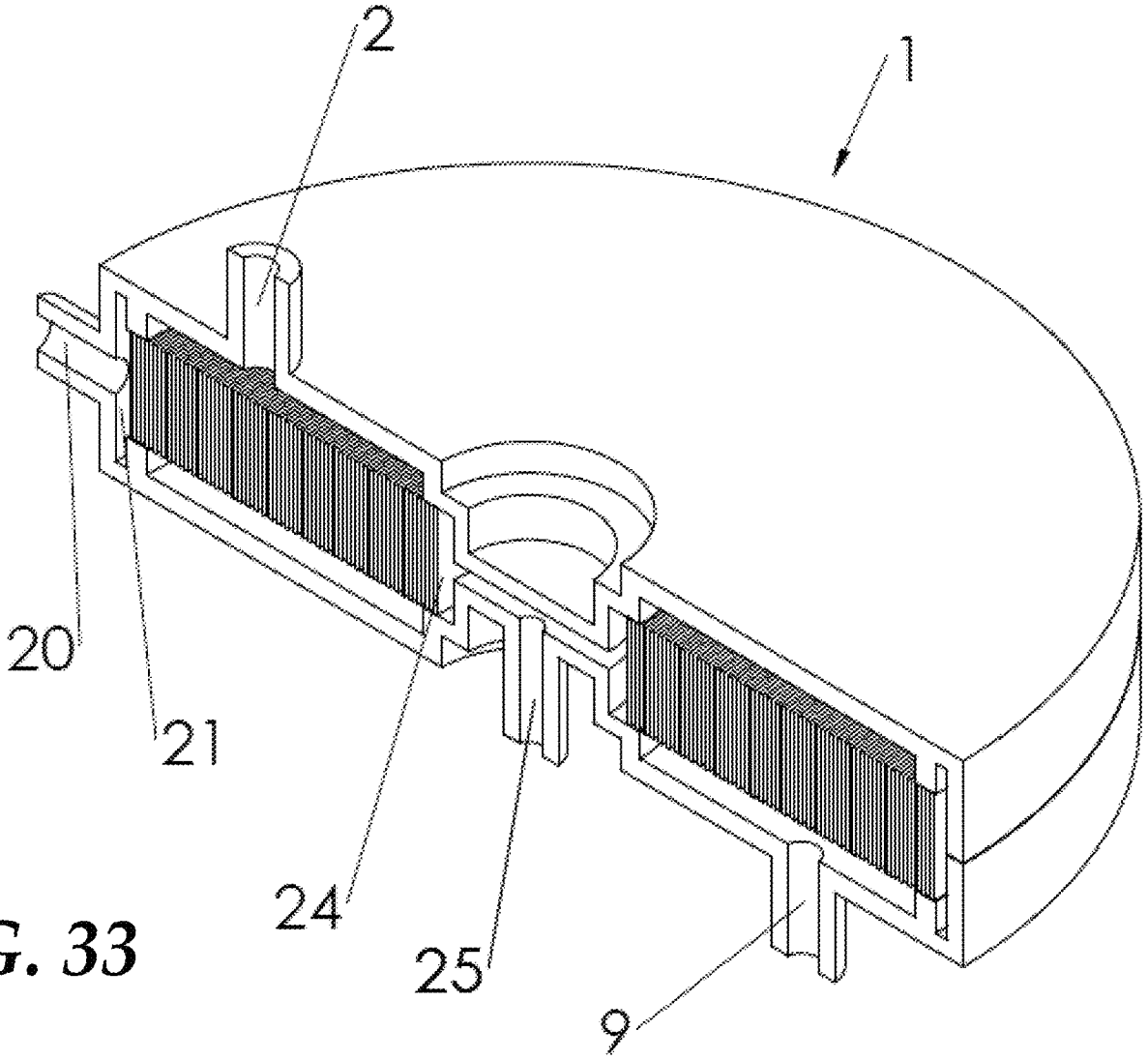
FIG. 33 alternate round isometric system cross sectional view.
Figure 34:
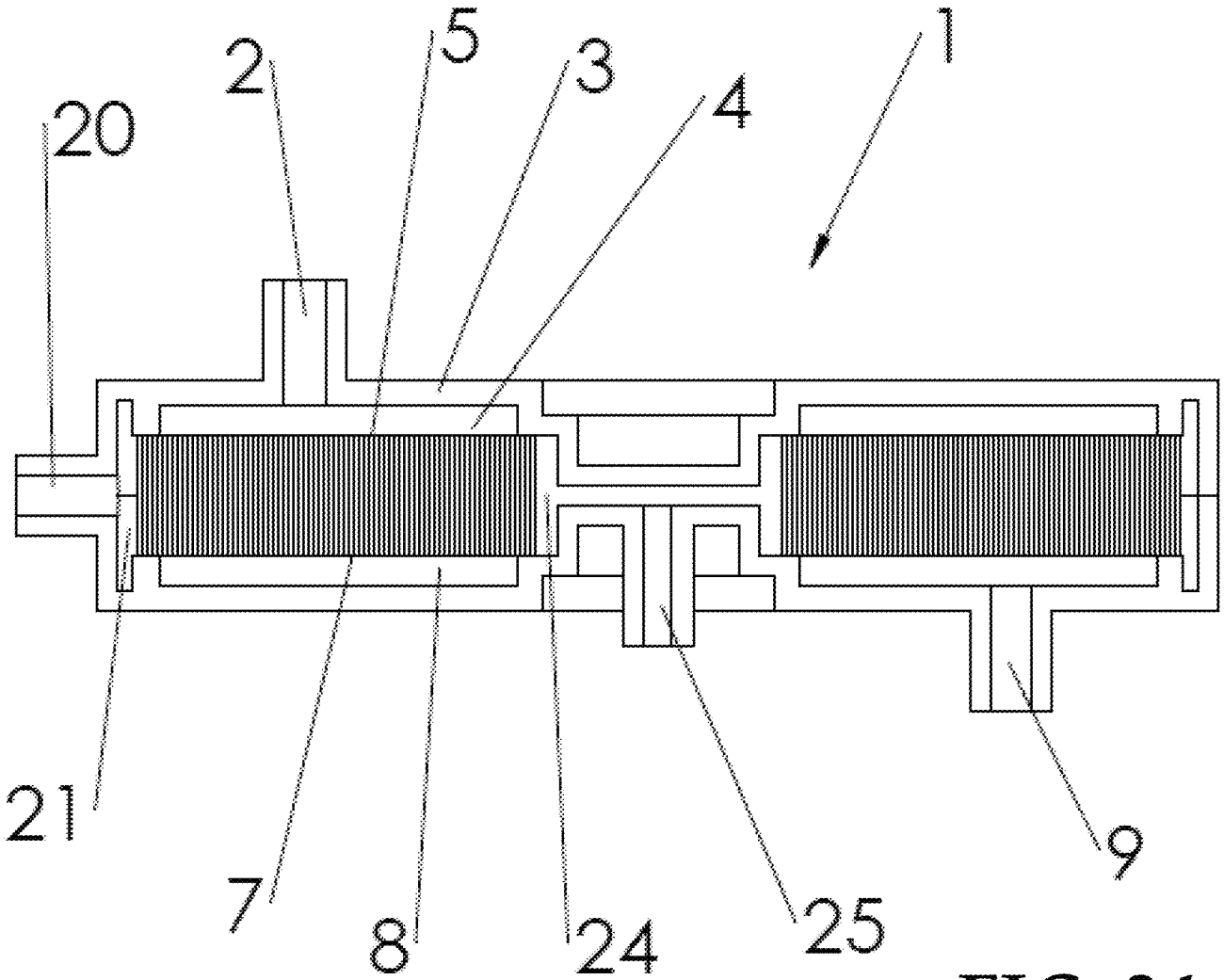
FIG. 34 alternate round system cross sectional view.
Figure 35:
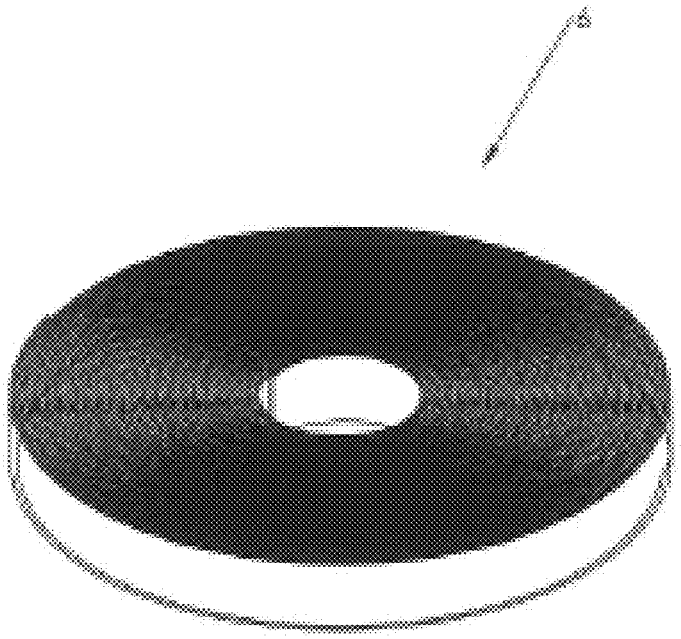
FIG. 35 alternate round system filter panel.

Referring to FIG. 31, an alternate configuration of the second inlet dividing wall is shown. By adding a taper to the top surface of the dividing wall the horizontal force acting on the particle is moved closer to the top side of the particle. This geometry requires less force to move the particles along the cross channels.

Referring to FIG. 32-36, collectively, a spiral configuration of the filter system is shown. In this configuration cross flow is from the interior diameter of the filter panel to the outer diameter of the filter panel. Alternately it could be in reverse of this direction.

Figure 36:
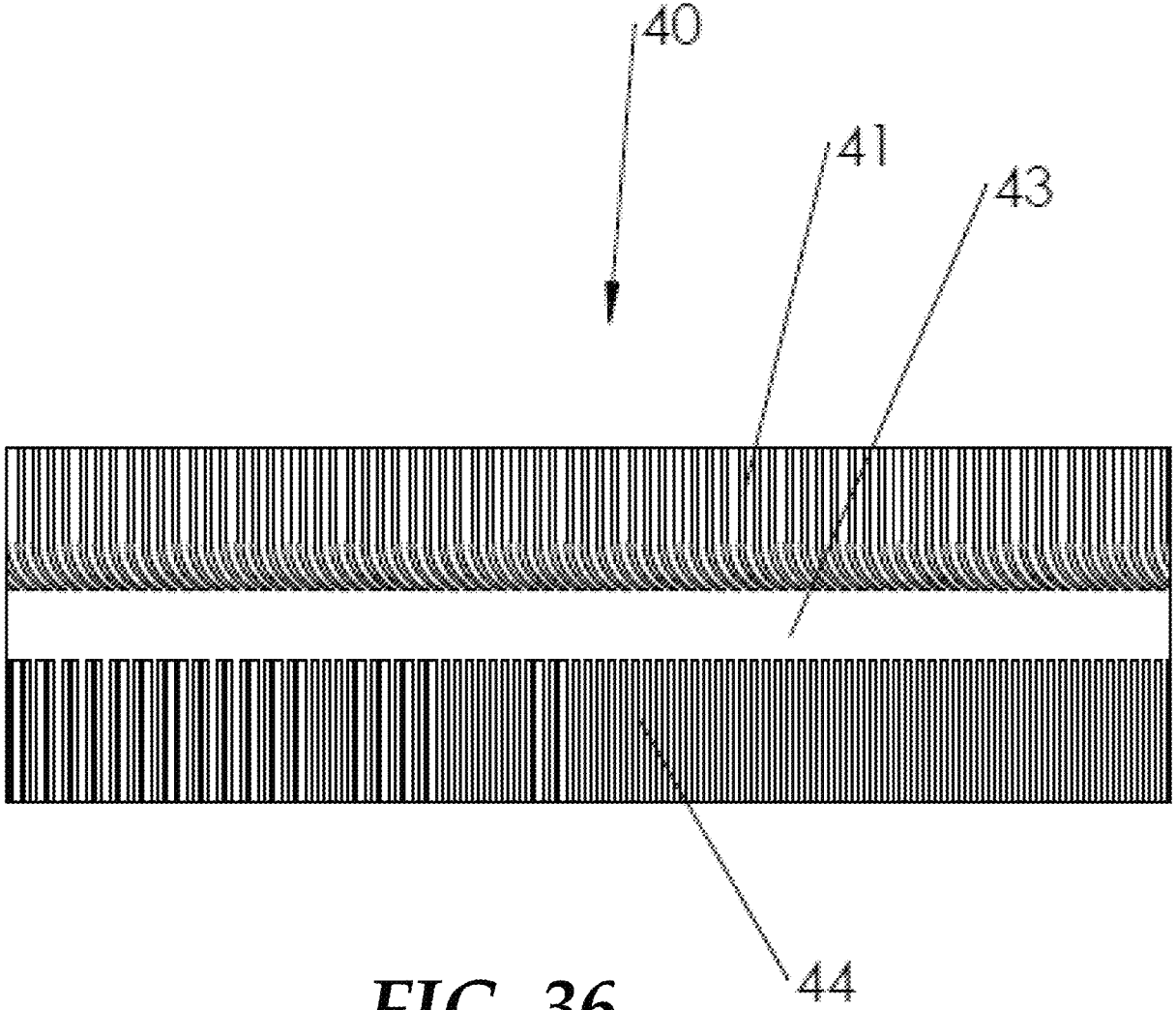
FIG. 36 alternate shows a section of a round filter panel.
Figure 37:
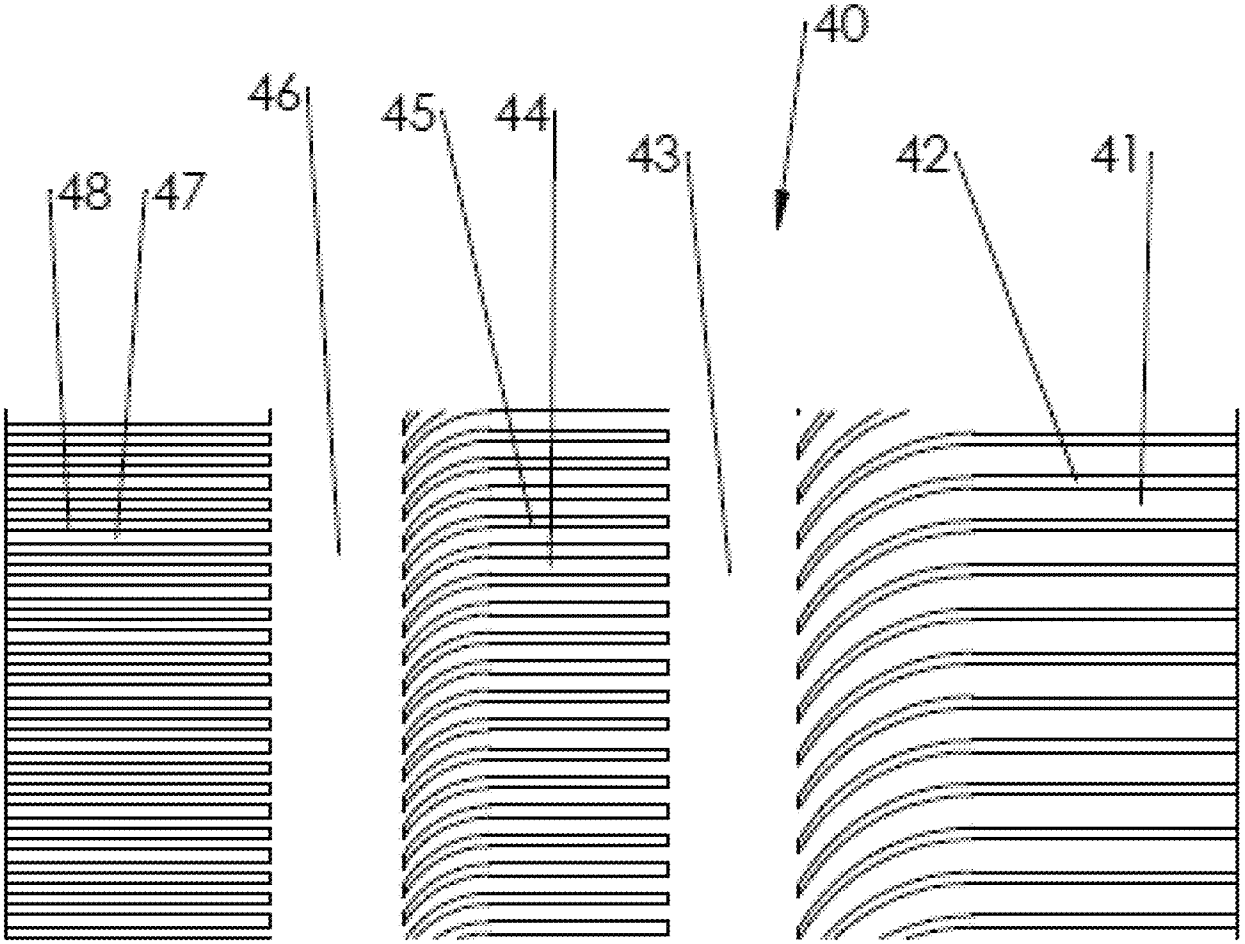
FIG. 37 is a section view of the filter layer shown in FIG. 27 rotated 90 degrees with respect to gravity.

Referring specifically to FIG. 36, only one cross channel is shown in this configuration. Others could also be deployed. Referring to FIG. 37, where the orientation of the filter is rotated 90 degrees, gravity can be used to aid in the movement of particles from the cross channels. In this configuration the particles would be denser than the fluid. It the particles were less dense than the flow fluid the filter panel would want to be inverted, top to bottom. In some systems the rotation angle may be 180 degrees or some angle between zero and 180. The angle would be engineered for the specific fluid and type of particles being filtered.

Figure 38:
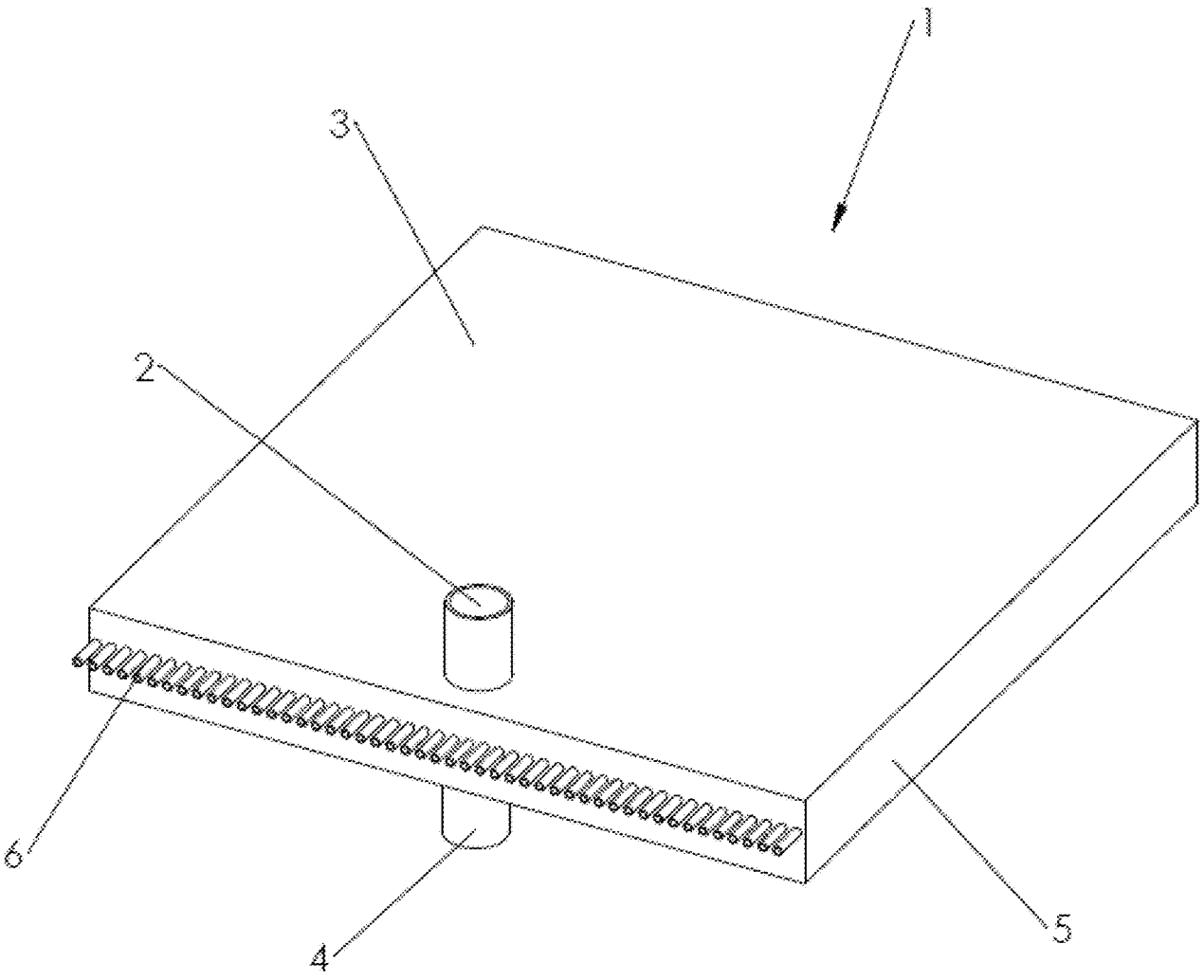
FIG. 38 is a perspective view of the selective filter system of the present invention.
Figure 39:
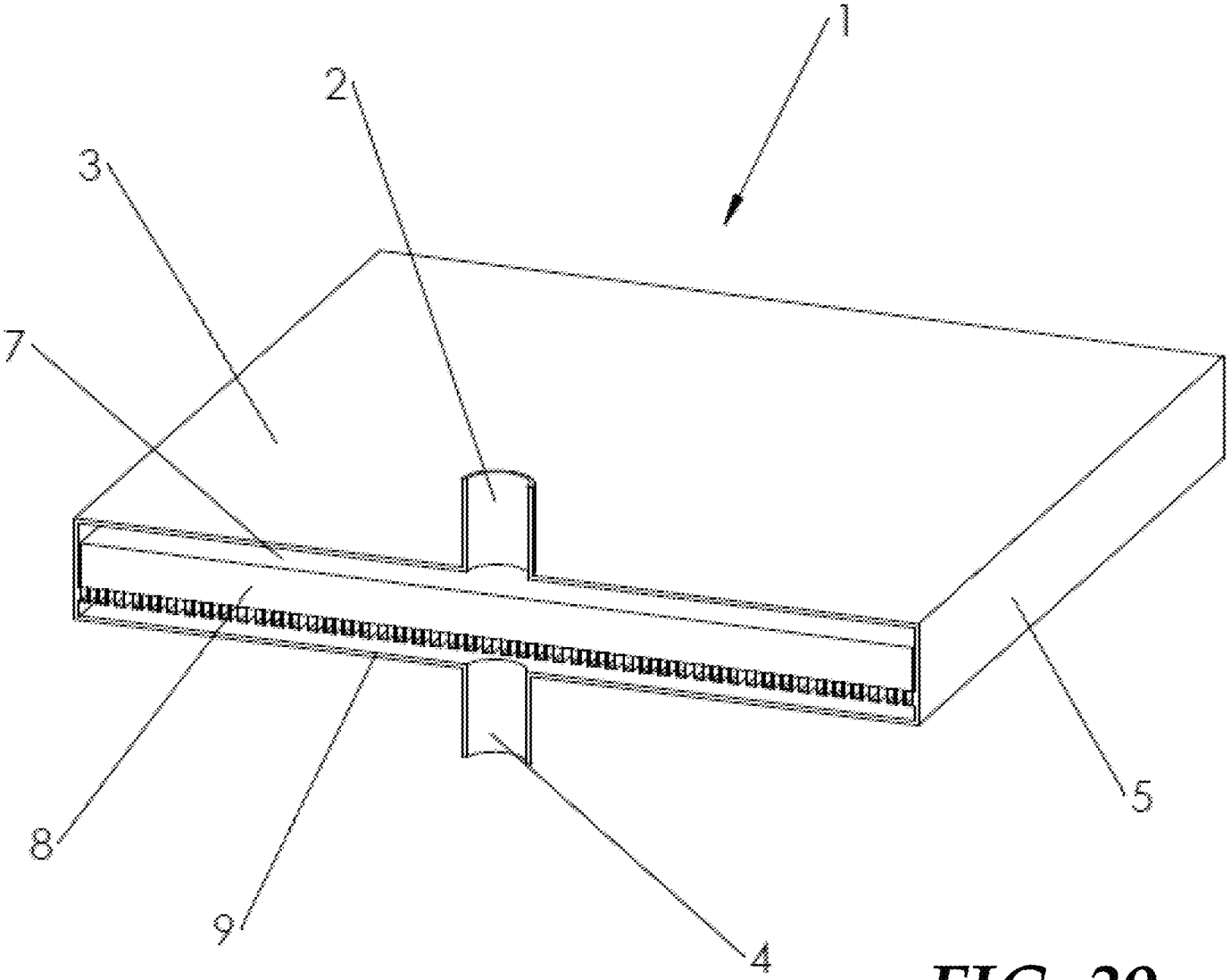
FIG. 39 is a sectioned perspective view of the selective filter system shown in FIG. 38.
Figure 40:
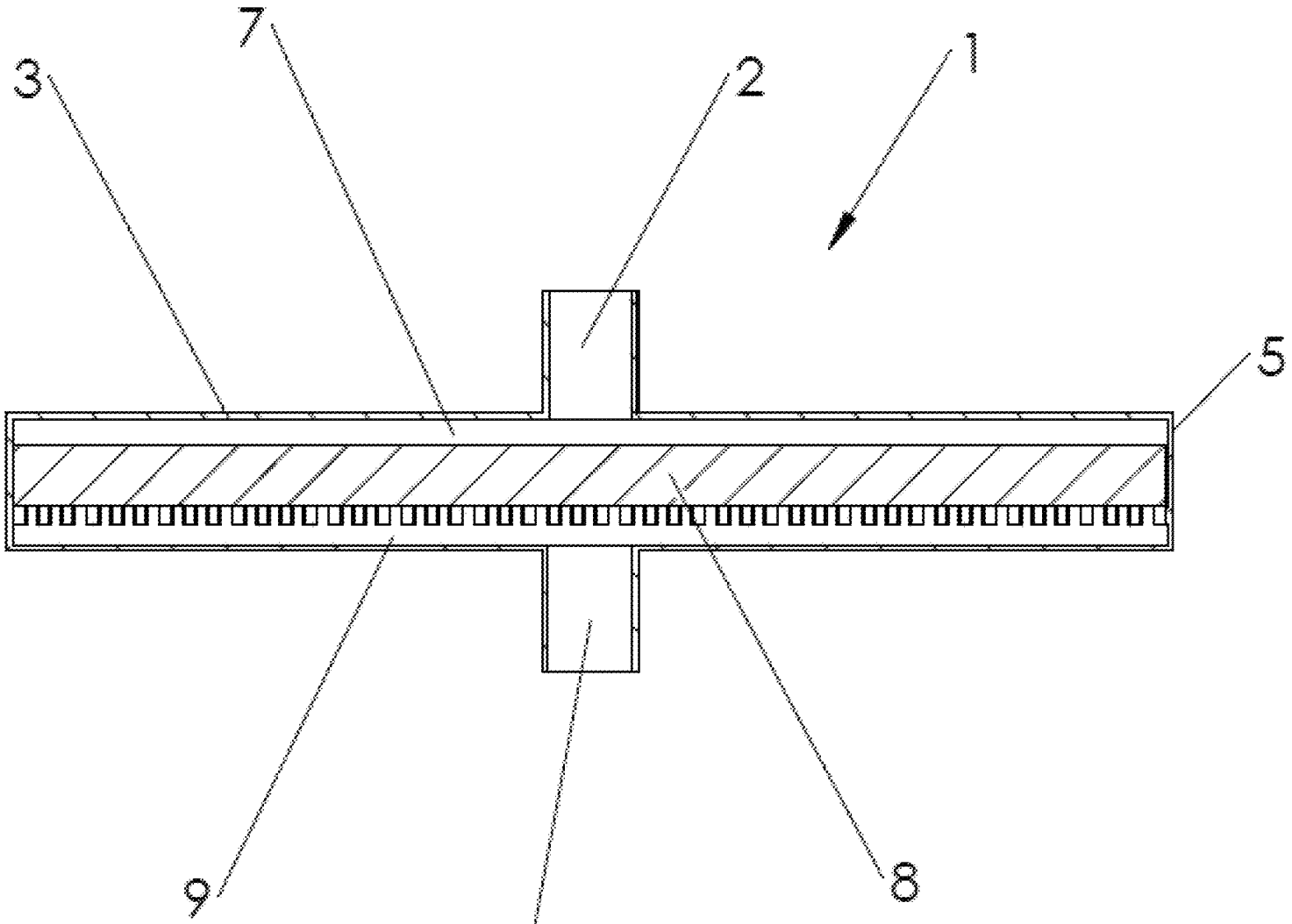
FIG. 40 is a front view of the section shown in FIG. 39.

FIGS. 38-47 collectively illustrate micro-structured filters with two outlet paths producing concentrated and filter flows. With reference to FIGS. 38, 39 and 40, the selective filter system 1 is shown. Fluid or gas flows into the selective filter system 1 from the fluid inlet 2 located on the top surface of the housing 3. The housing 3 encloses the selective filter system 1. Filtered fluid flows out of the filter fluid outlet 6 located on the bottom side of the housing 3. Concentrated fluid flows out of the concentrated fluid outlets 4 that are located on the front surface of the housing 3.

It should be noted that the filter fluid can be a gas, a liquid or a flow of small particles acting as a liquid. Examples of a flow of small particles are grains, seeds, sand, gravel or molecules.

Figure 41:
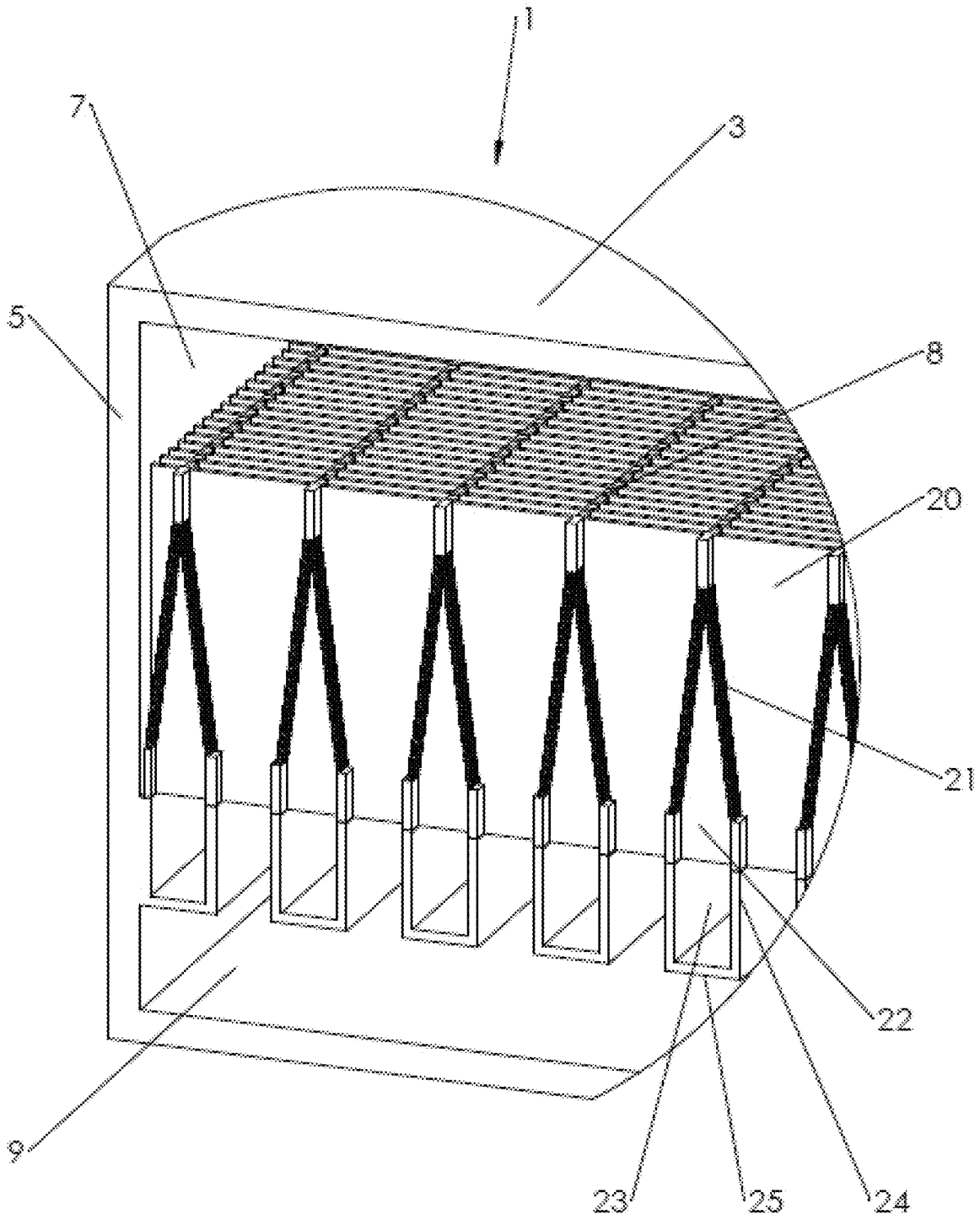
FIG. 41 is a close-up of FIG. 40.
Figure 42:
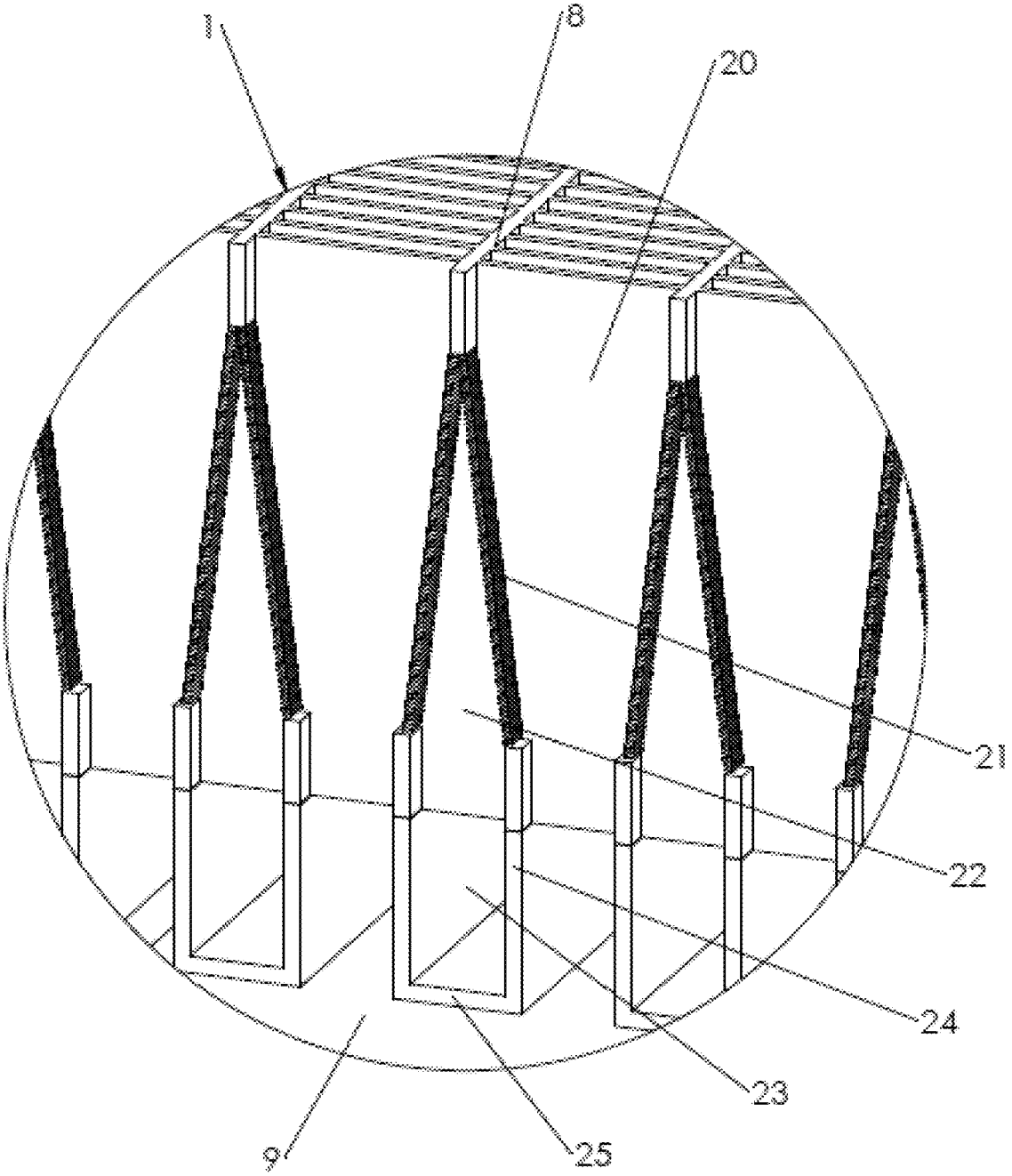
FIG. 42 is a close-up of the view shown in FIG. 40 with higher magnification than FIG. 41.
Figure 43:
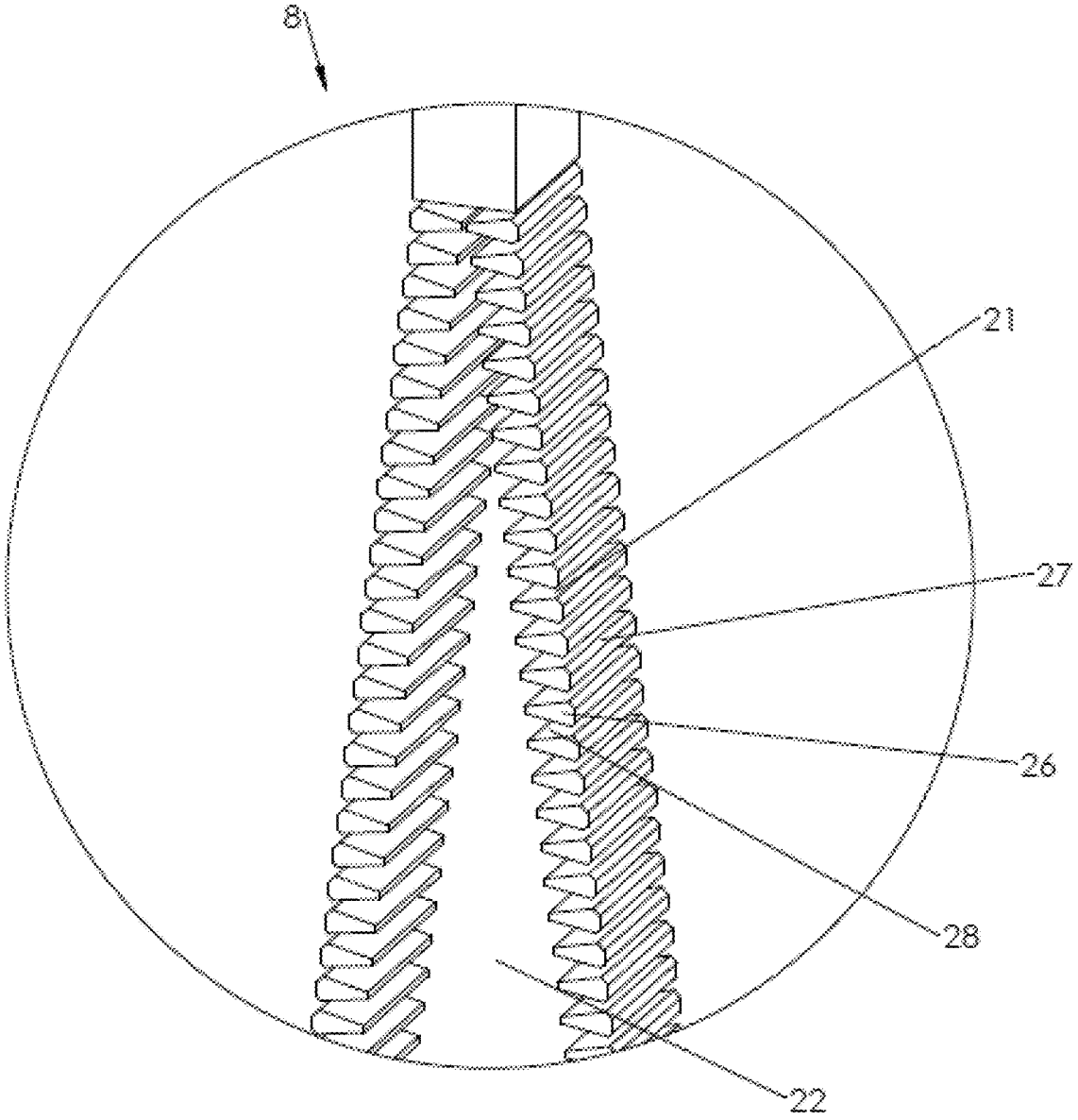
FIG. 43 is a close-up of the view shown in FIG. 40 with even higher magnification than FIG. 42 showing only the filter panel.

Referring to FIG. 41 the upper plenum 7 constrains the flow of the fluid from the fluid inlet 2 to the filter panel 8. It does not allow flow to other areas of the selective filter system 1. The top, front, back and side surfaces 5 of the housing 3 seal with the filter panel 8 to form the upper plenum 7.

The interface of the sides, front and back of the housing 3 to the filter panel 8 might include a gasket or an adhesive to take up variations in the surface topography of these components and seal them together. No gasket is shown.

Fluid entering the top surface of the filter panel 8 travels down the inlet channels 20. The inlet channels 20 can best be seen in magnified FIGS. 42 and 43. The inlet channels 20 are vertical in orientation and are tapered in shape. The taper originates at the top surface of the filter panel 8. The taper is widest at the top surface and reduces in width at the bottom of the filter panel 8.

The filter is comprised of a number of filter layers laminated together. The filter layers comprising the filter panel 8 would typically be of the same material and geometry. The back side of the filter layer shown would cover and form the fourth wall of the channels directly behind. The channels of the filter panel 8 shown would be covered (form the 4th wall) by the inside surface of the front wall of the housing 3 (not illustrated).

The lamination of the filter layers into a filter panel 8 is done for manufacturing reasons. The filter panel 8 may not easily be made from one solid object, although the filter panel 8 may, in fact, be made from a single object. Filter layers are easy and inexpensive to manufacture. They are also easily assembled into a filter panel 8. Filter layers can be made in a roll to roll process.

Most of the fluid that enters the inlet channels 20 flows into the cross channels 21. The cross channels 21 are located along the tapered sides of the inlet channels 20. The openings of the cross channels 21 are small and restrict particles of a predetermined size from passing through them. Restricted particles are therefore kept within the inlet channels 20. When the quantity of particles within the inlet channel 20 become significant they can be purged as concentrated fluid though the bottom of the filter panel 8 where the inlet channels 20 are open. This fluid is directed into the lower plenum 9.

The lower plenum 9 constrains the purged flow to exit the selective filter system 1 via the concentrated fluid outlet 4. The lower plenum 9 is enclosed by the bottom, front, back, and side walls of the housing 3. It is further constrained by the internal lateral plenum side walls 24 and the lateral bottom walls 25. The top edge of the lateral plenum side walls 24 terminate and seal to the bottom surface of the filter panel 8. The top edge of the lateral plenum side walls 24 are aligned with the walls that create the inlet channels 20 at the bottom of the filter panel 8.

The lateral plenum side walls 24 and the lateral plenum bottom walls 25 also create the lateral plenum 23. The lateral plenum 23 is located directly below the outlet channels 22. Flow from the outlet channels 22 of the filter panel 8 is constrained within and separated from the lower plenum 9 by the lateral plenum 23.

Fluid and small particles (smaller than the cross channels) flow into the outlet channels 22 from the cross channels 21.

The outlet channels 22 are tapered. The small end of the taper originates near the 'top of the filter panel 8. Fluid cannot flow directly into the outlet channels 22 from the upper plenum 7. The taper increases in width as the flow progress down the outlet channels 22. Only fluid that passes through the cross channels 21 and the outlet channels 22 is allowed to flow into the lateral plenum 23.

In summary, flow from the cross channels is eventually directed to the lateral plenums 23. This flow is further constrained to exit the selective filter system 1 through the filter fluid outlets 6 located on the front of the housing 3.

The cross channels 21 are separated with cross channel walls 26. The leading edge of the cross channel walls 26 have chamfers 27. The chamfer helps reduce the likelihood of particles getting trapped at the opening of the cross channel 21.

The trailing edge of the cross channel walls 26 have shallow tapers. The taper on this end is to reduce flow restriction and to increase the strength of the wall during fabrication and use.

Figure 44:
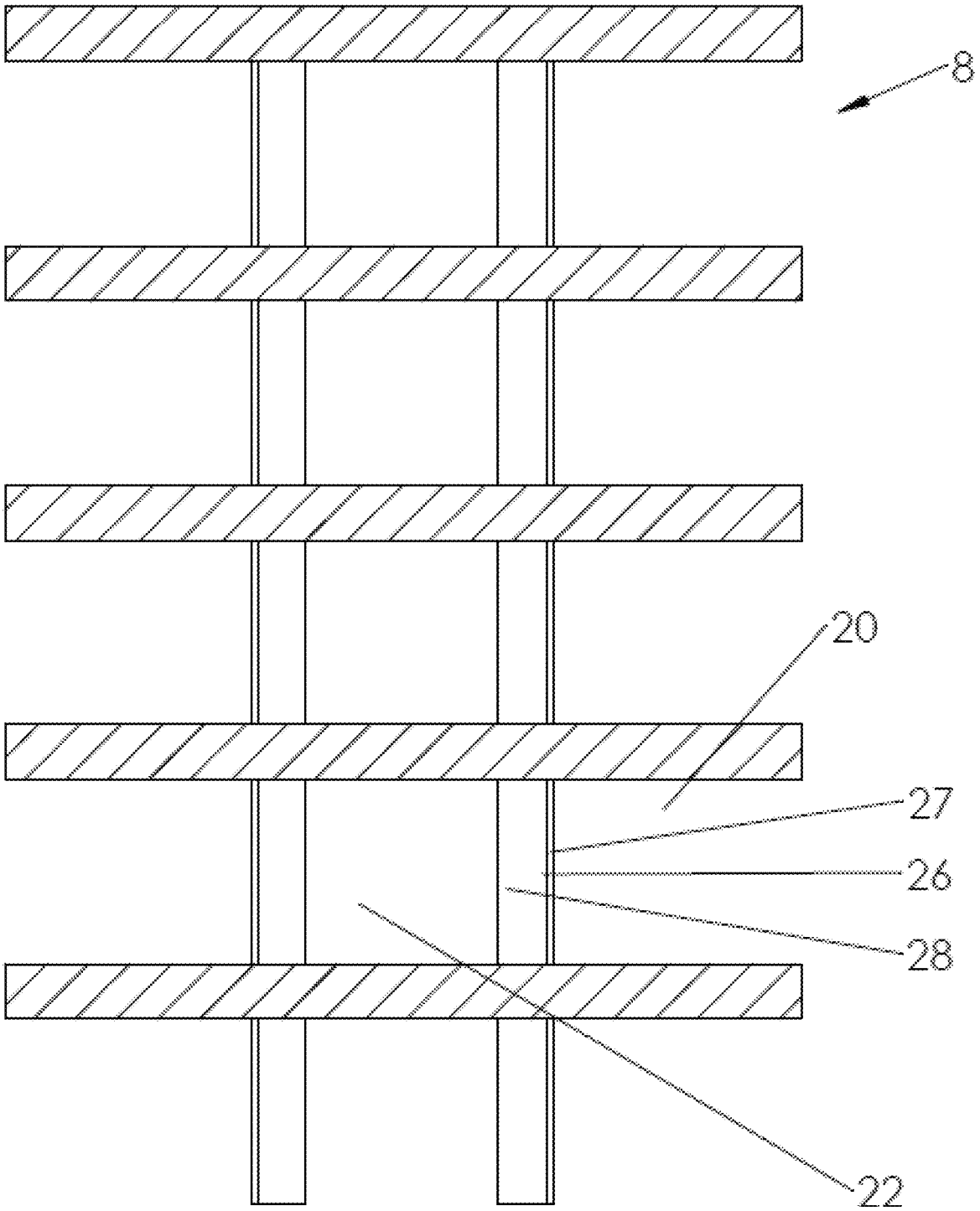
FIG. 44 is a top section view of the filter panel.

Referring to FIG. 44 the cross channels 21 can be seen in a top cross section view. The preferred material for the filter layers is a polymer. Polymers are inexpensive materials and are typically inexpensive to manufacture. Other materials such as metals and ceramics might be used when the filter is being used at elevated temperatures. For some applications paper may even be used. The selection of the filter layer material would be an engineering decision.

Over time particles collect in and build up in the cross channels. These can be purged by varying the flow of the system to the concentrated fluid outlet 4. Flow through the concentrated fluid outlet 4 can be continuous or intermittent.

If the selective filter system 1 is being used to collect and retrieve a particular sized particle for use in another process or analysis the particles may want to be extracted even before the restriction is increased but when the quantity of particles is sufficient in number for the process or analysis. A system where sorting particles by size is one that would be used to sort blood cells by their size.

To increase the expulsion of particles, gravity and or vibration of the filter panel 8 can be deployed. The orientation of the filter panel 8 would allow gravity to increase the expulsion of particles.

Figure 45:
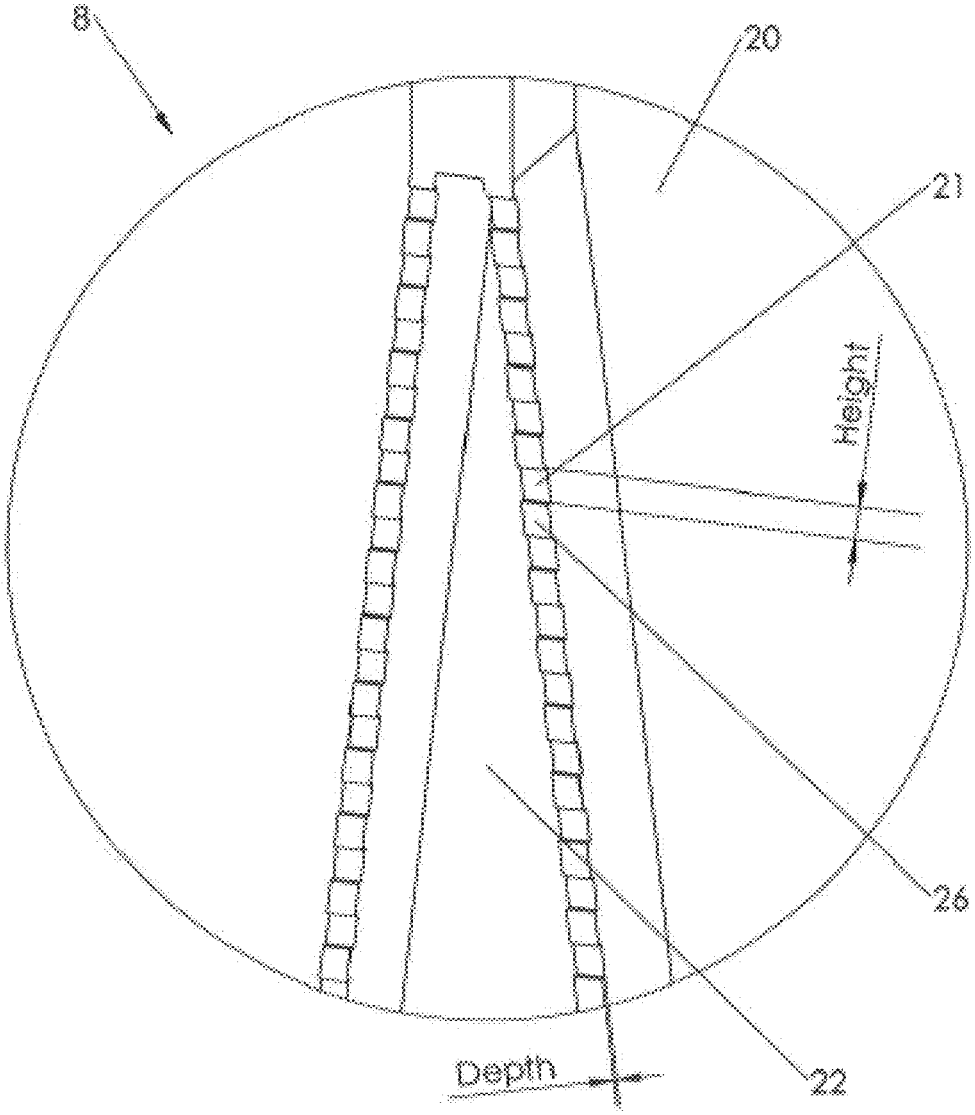
FIG. 45 is the same close-up shown in FIG. 44 with a different configuration of the cross channels' surfaces.

Referring to FIG. 45 an alternate configuration of the invention is shown. With this configuration the depth of the cross channels 21 is used to restrict particles. In the preferred disclosure the height of the cross channel 21 is what restricts the particles.

When extremely small particles are being filter filtered the alternate configuration would be deployed. Particles in the range of less than 20 nanometers would be considered extremely small. The tooling to make the preferred disclosure's cross channels 21 would be limited by the manufacturing of the tool. If the tooling to mold the film was manufactured with either precise machine tools or with semiconductor lithography processing equipment extremely small cross channels 21 could not be manufactured. Tooling made with semiconductor equipment where the depth of the deposition was used extremely small features could be created. The depth of the deposition would be replicated in the molding of the depth of the cross channels 21. Deposition of materials can be controlled to single digit nanometer depths.

Figure 46:
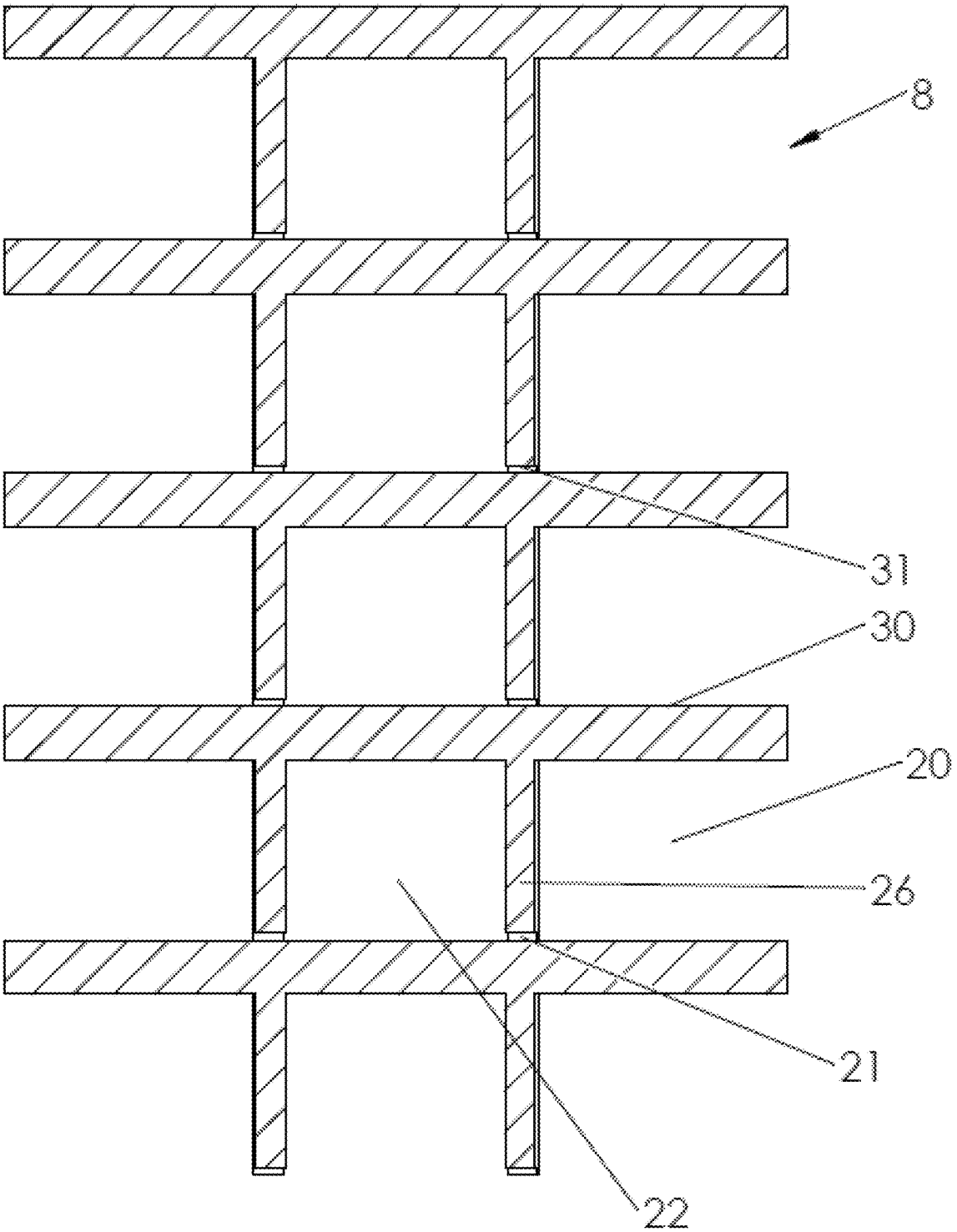
FIG. 46 is a top section view of FIG. 45 showing charged surfaces.

Referring to FIG. 46 the top view of an alternate system where the surfaces of the film layers have been coated with additional material. The coated film back surface 30 and the coated cross channel 31 are shown.

One or both the film layers could be coated with a conductive layer of metal. The conductive coatings could both be charged with a positive or negative charge or they could be charged with opposite charges. If they were charged with opposite charges there would need to be isolated with an insulation layer. An external voltage source would be applied to the conductive surfaces to create the charge.

One or both of the surfaces could alternately be coated with a material that has a negative charge when exposed to an electrolyte. In this case an electrolyte would be the fluid within the inlet channels. An example would be to at least one surface, or both, coated with titanium dioxide or silicon dioxide to create a negative charge on the surfaces. The surfaces would attract positive ions in the electrolyte. These ions will repel negative ions in the fluid. If the depth of the channel is small enough negative ions will be blocked from flowing through the cross channels by the positively charged ions.

Another example would be to coat at least one, or both, of the surfaces with a material that produces a positive charge when an electrolyte is present. The surfaces would then attract negative ions in the electrolyte. These ions will repel positive ions in the fluid. If the depth of the channel is small enough, negative ions will be blocked from flowing through the cross channels.

Yet another approach to create charge is to embed a charge into or slightly below the outer surface of one or more of the surfaces. If the embedded charge is negative, positive ions within the film would be attracted. As with the previous examples, oppositely charged particles or molecules would be blocked from flowing through the cross channels 21.

Figure 47:
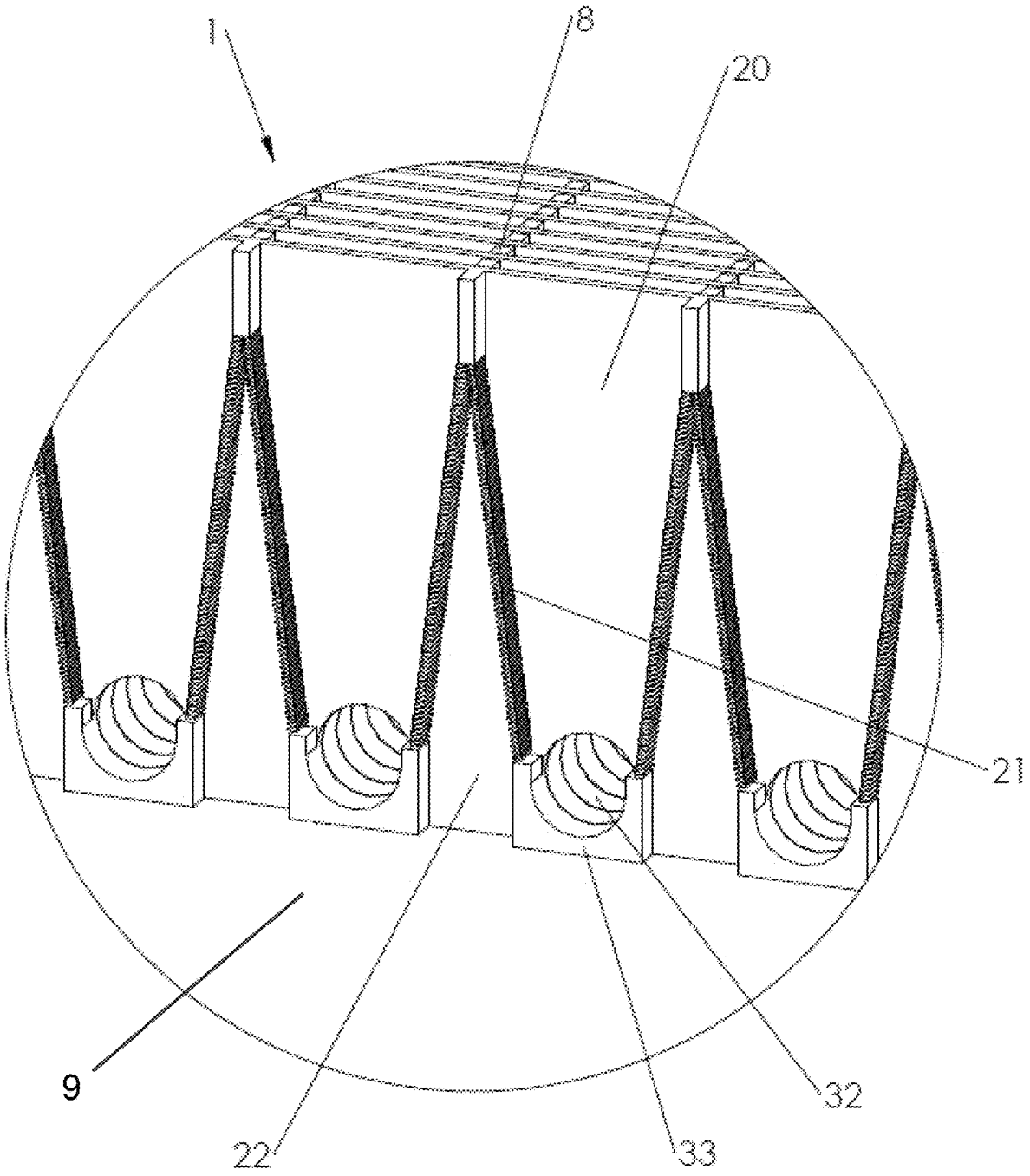
FIG. 47 is the same close-up shown in FIG. 42 showing an alternate configuration.

Referring to FIG. 47 another alternate configuration is shown. In this configuration the lateral channels are formed by holes 32 through the base of the filter layer at the bottom of the inlet channels 20. This configuration could be constructed so that all of the flow from these channels would exit the selective filter system 1 from the concentrated fluid outlet 4. The lower wall 33 at the bottom of the inlet channels 20 ensures that no concentrated fluid enters the lower plenum 9. It should also be noted that the configuration of holes to form channels can readily be applied to form input and output channels, and can be applied to both desalinization and filtering applications.

FIGS. 48-55 collectively illustrate various filters with tapered channels for increased particle collection capacity. A filtration structure that has tapered inlet channels that collect different sized particles along the different widths of the taper to greatly increase the capacity of the filter to collect particles.

Figure 48:
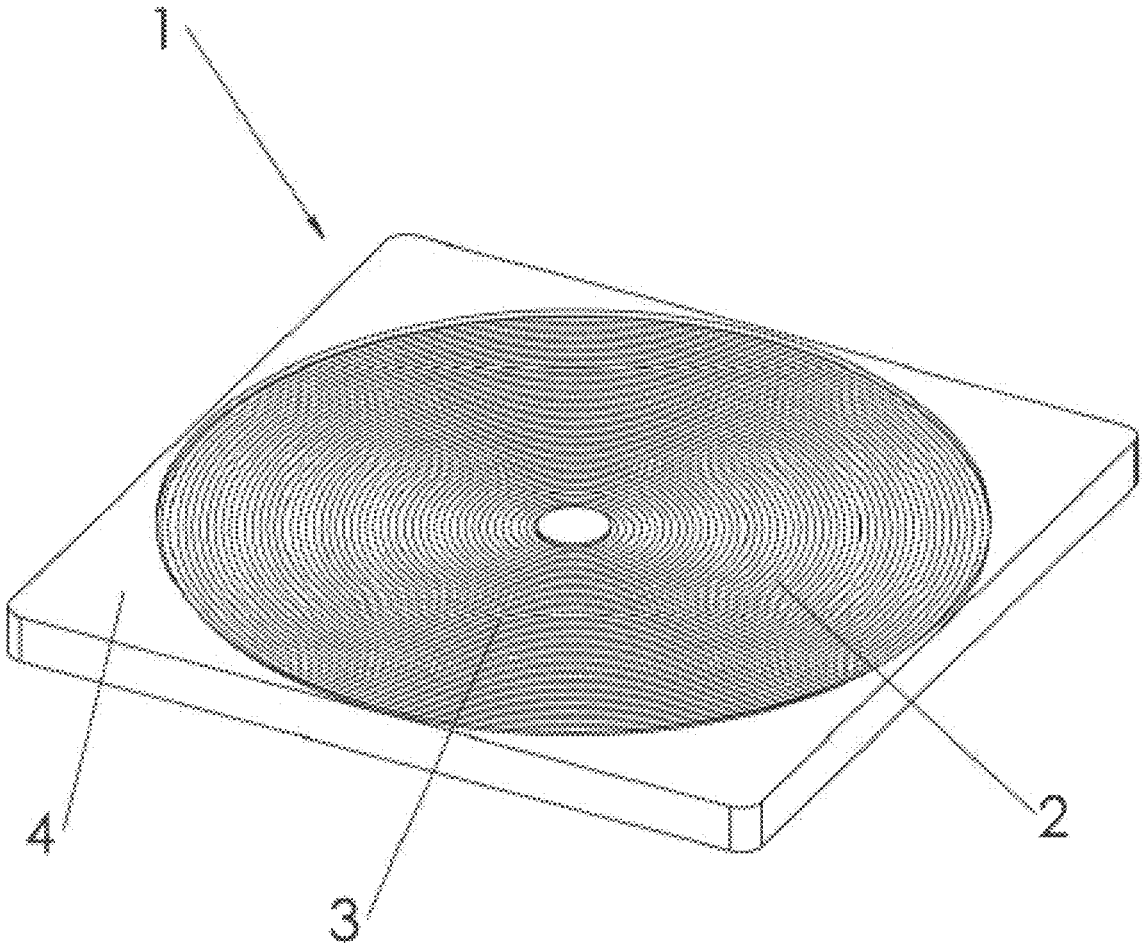
FIG. 48 is a perspective view of the filter assembly.

With reference to FIG. 48, the filter assembly 1 is shown. Fluid or gas flows into the filter assembly 1 from the top surface 3 of the filter panel 2. Fluids exit on from the bottom surface of the filter panel 2.

It should be noted that the filter fluid can be a gas, a liquid or a flow of small particles acting as a liquid. Examples of a flow of small particles are grains, seeds, sand or gravel.

The filter panel is enclosed in the frame 4. The frame 4 shown would be they of the type required to adapt the filter panel 2 for use in an automobile air filter or cabin filter. The filter panel 2 could be enclosed into different enclosures for use in other type of filter applications, such as automotive oil filters, automotive fuel filters, HVAC air filters, water treatment filters, waste water treatment filters, industrial process filters, and biological process or analysis filters. These are just few of the types of applications the filter panel 3 can be used in. Most of these would require a specific type of frame 4 for the specific application. The invention applies to the filter panel 2 and not to how it is used or housed.

Figure 49:
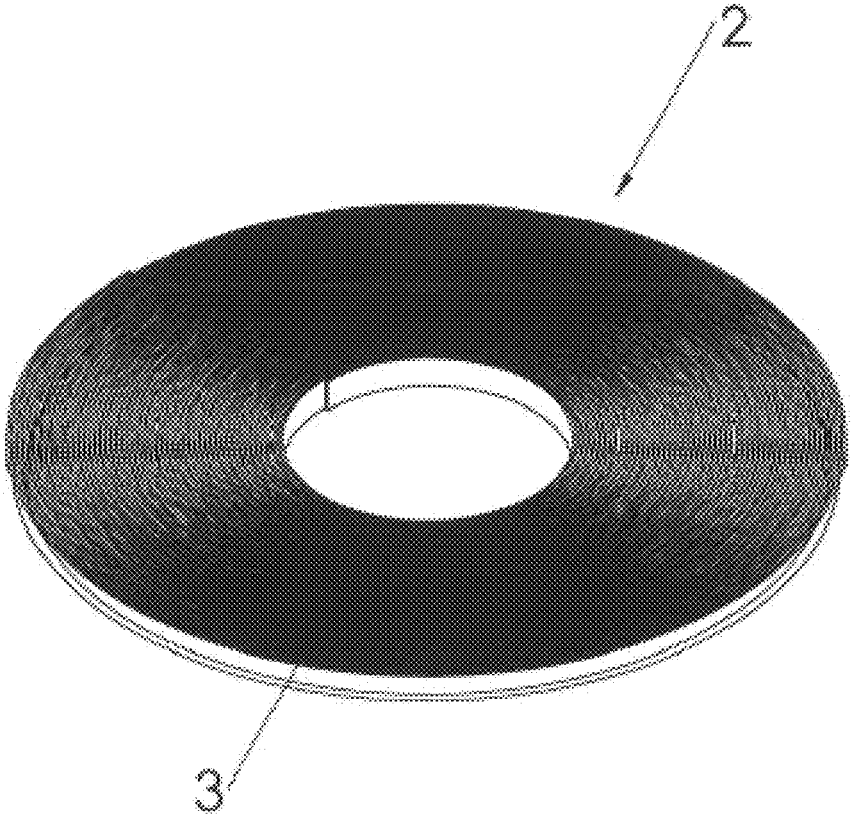
FIG. 49 is a perspective view of only the filter panel.

Referring to FIG. 49 the filter panel 2 is shown in a spiral configuration. A length of film material is rolled into a spiral to form a large area for fluid to enter the filter panel 2. The filter could be configured as a linear, cylindrical or conical geometry.

Figure 50:
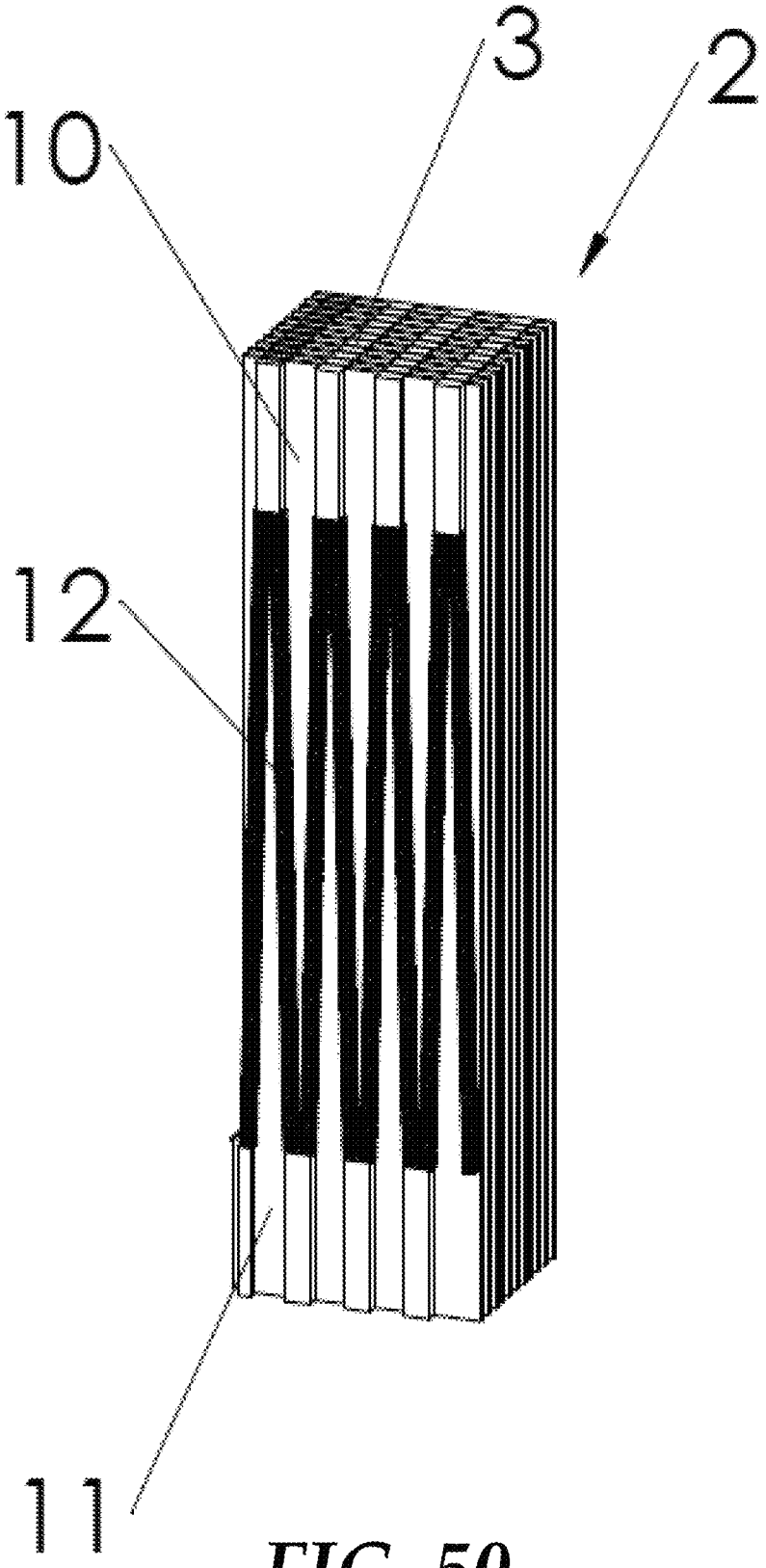
FIG. 50 is a perspective view of one small section of the filter panel.
Figure 51:
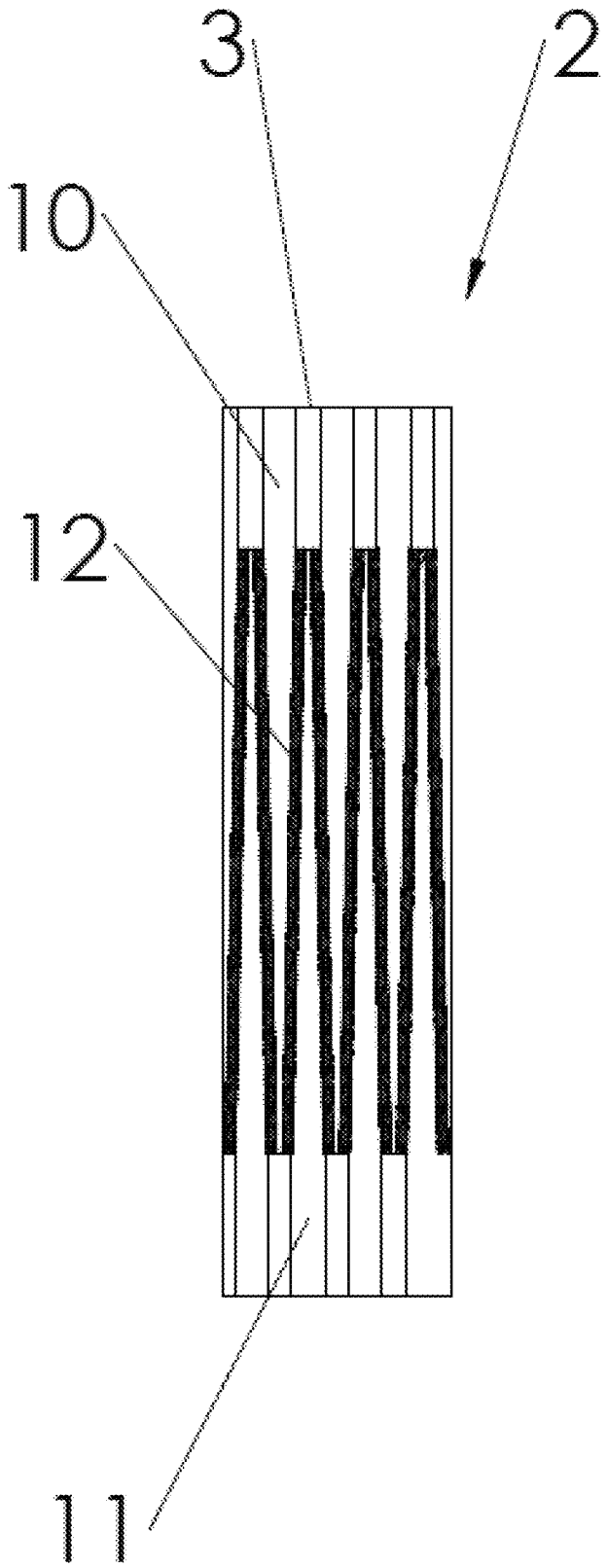
FIG. 51 is a front view of a small section of the filter panel.

Referring to FIGS. 50 and 51, a section of the filter panel 2 is shown. As discussed earlier the fluid flows in from the top surface 3 of the filter panel 2. In this close-up view the inlet channels 10 can be seen. They originate at the top surface 3, extend along the surface of the film and terminate slightly above the bottom edge of the film material. Complimentary outlet channels 11 originate at slightly below the top surface 3 of the filter panel 2 and extend and are open to the bottom of the filter panel 2. The tapered orifice channels 12 connect the inlet channels 10 to the outlet channels 11. There are large numbers of them and they are extremely small so they cannot be seen with much detail.

Figure 52:
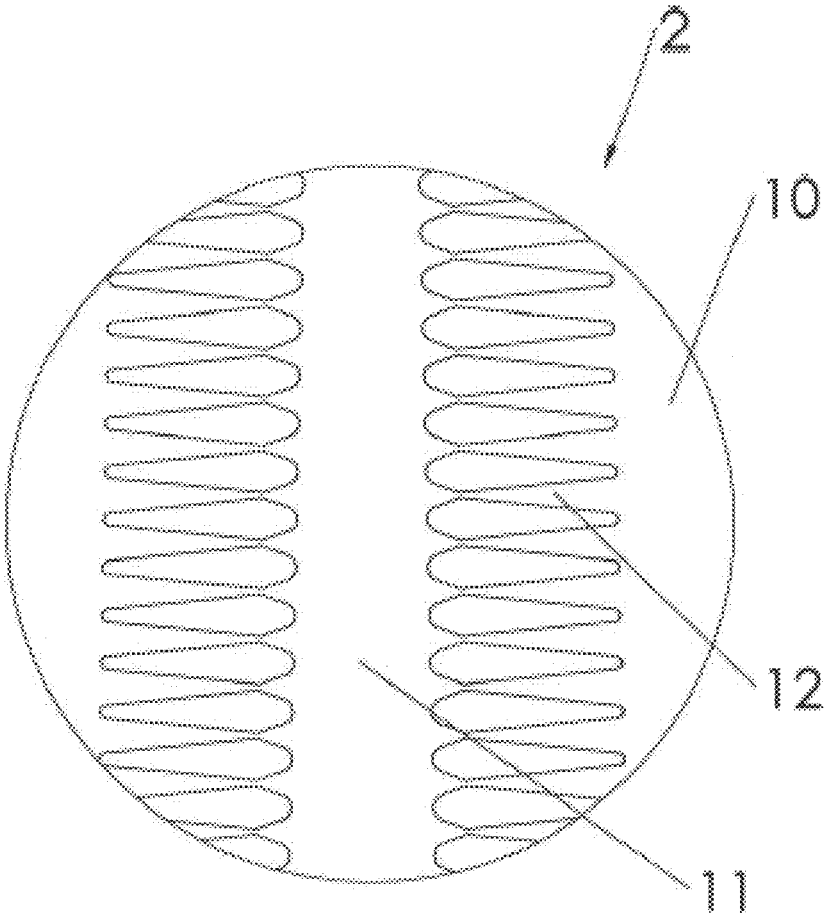
FIG. 52 is a close-up view of the of the filter panel shown in FIG. 51
Figure 53:
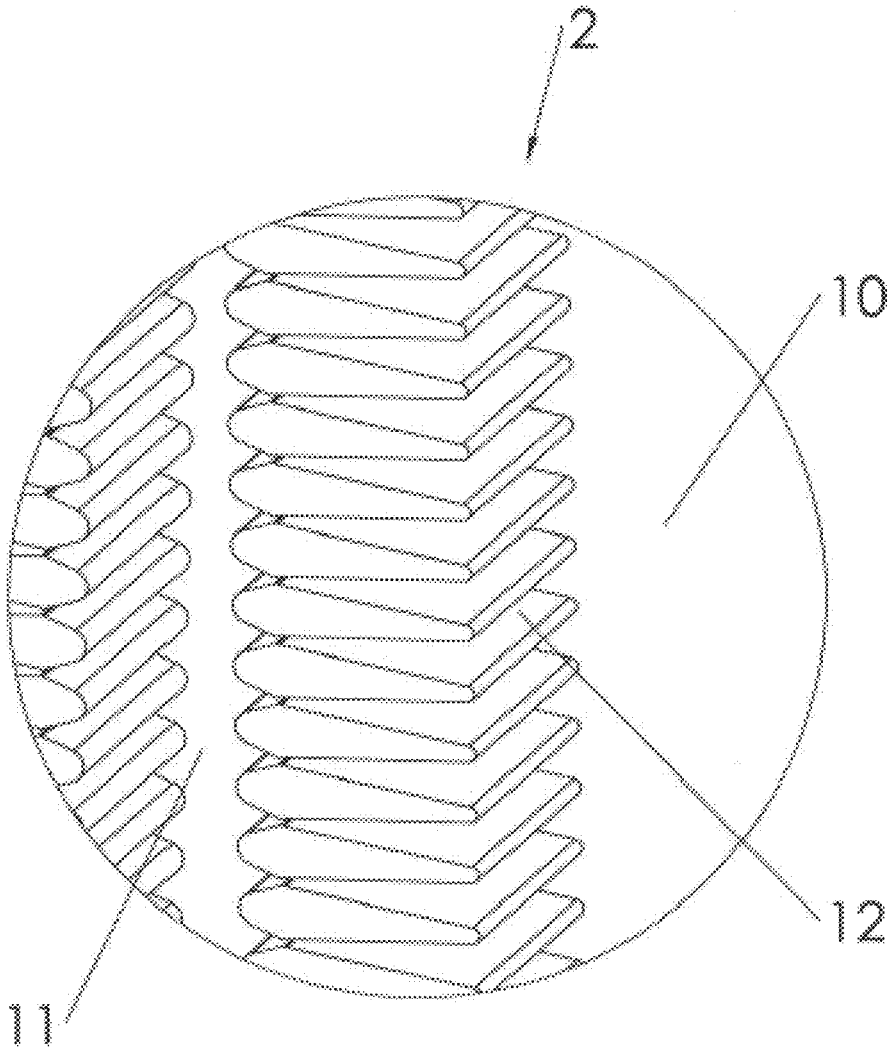
FIG. 53 is a close-up prospective view of the filter panel shown in FIG. 2.

Referring to FIGS. 52 and 53, a highly magnified section view of the filter panel 2 the detail can be seen. The tapered orifice channels 12 can be easily seen connecting the inlet channel 10 to the outlet channel 11. Flow enters from the inlet channels 10 and flows into the tapered orifice channels 12. There are hundreds of tapered orifice channels 12 located along the input channel 10. The large end of the taper is open to the inlet channel 10. The small end of the tapered orifice channel 12 is open to the outlet channel 11. The tapered orifice channels are formed by adjacent dividing walls that are substantially tear-shaped or wing-shaped.

Figure 54:
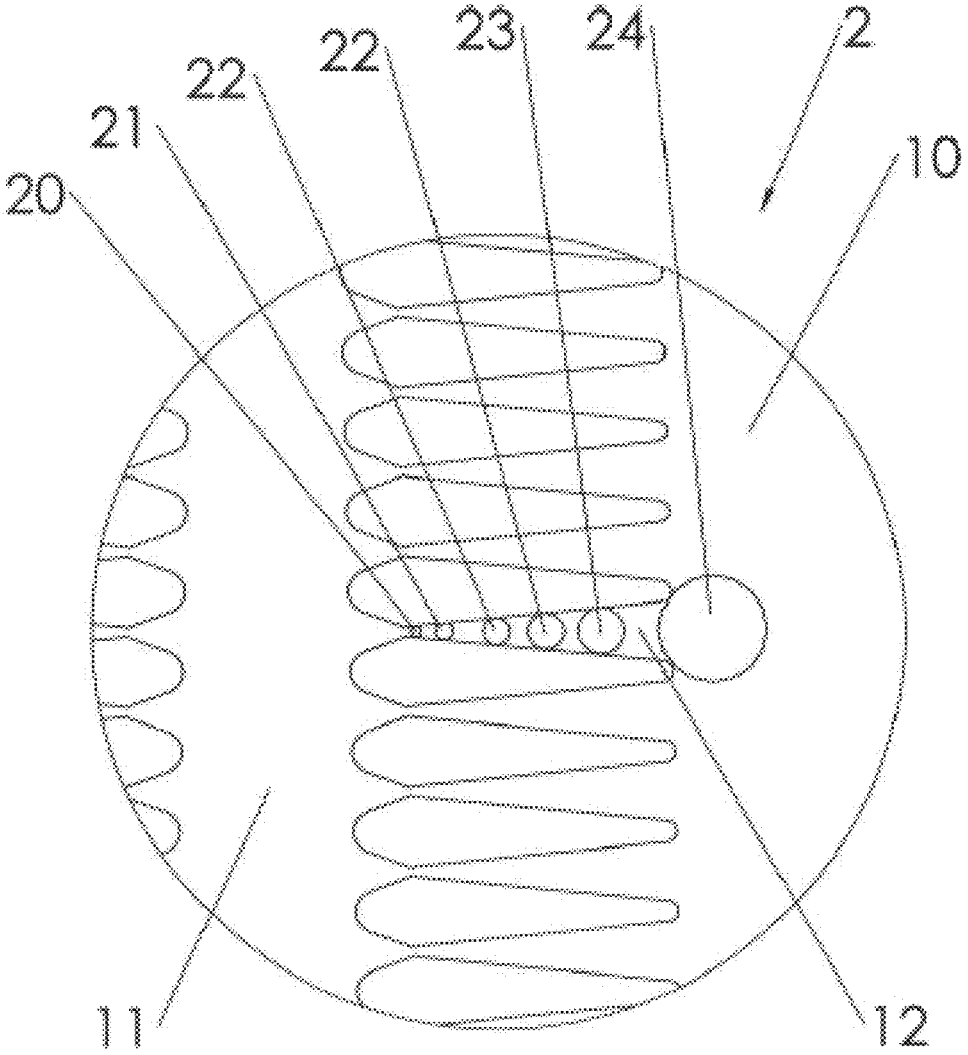
FIG. 54 is a close-up view of the filter panel shown in FIG. 53 with various sized particles.

Referring to FIG. 54 the tapered orifice channels 12 are shown with captured particles 20-25 of various sizes. By configuring the channel with a taper many more particles 20-25 can be captured without significantly restricting the flow.

Figure 55:
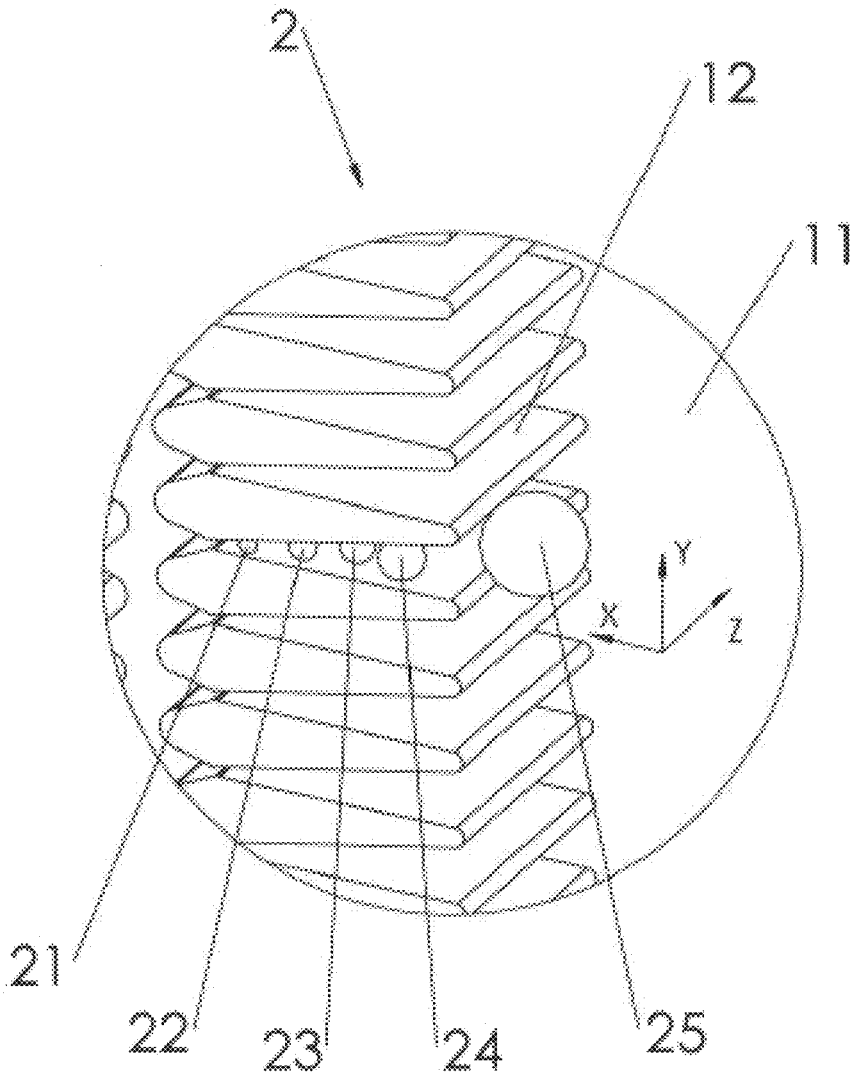
FIG. 55 is a close-up view of the filter panel shown in FIG. 54 with various sized particles.

Referring to FIG. 55 the relationship of the particles in the Z direction can be seen. From this perspective it can be seen that fluid can flow through the tapered orifice channels 12 (flow in the X direction). Only five particles 21-25 are shown to be captured in the tapered orifice channel 12. Because the tapered orifice channels 12 are much wider (Z direction) than the size of the collected particles, fluid can flow around the particles 21-25 (along the Z direction). This allows for the capture of many more particles before the flow through the channel is significantly reduced.

FIGS. 56-72 collectively illustrate fluid filters with complex flow orifices. In some embodiments, the present technology relates to filter systems for the filtering of or separation of different sized particles from a fluid. Filters type structures can be used to separate particles of a specific size or from a fluid. The process of separating bacteria from wastewater is one application of the invention. Separating different sized blood cells in a fluid is another biological filtering application. The desalination of water is one area where filter material is used to separate different sized molecules. This task requires the removal of sodium chloride molecules from water molecules. For the desalination of salt water the relative amount of sodium chloride in relationship to the water molecules is high. Because of this high ratio, a significant amount of sodium chloride is collected in the filter when processing modest amounts of water. The addition of an electric field to the fluid flow can also be part of the process.

There are many other processes that can utilize this system.

Figure 56:
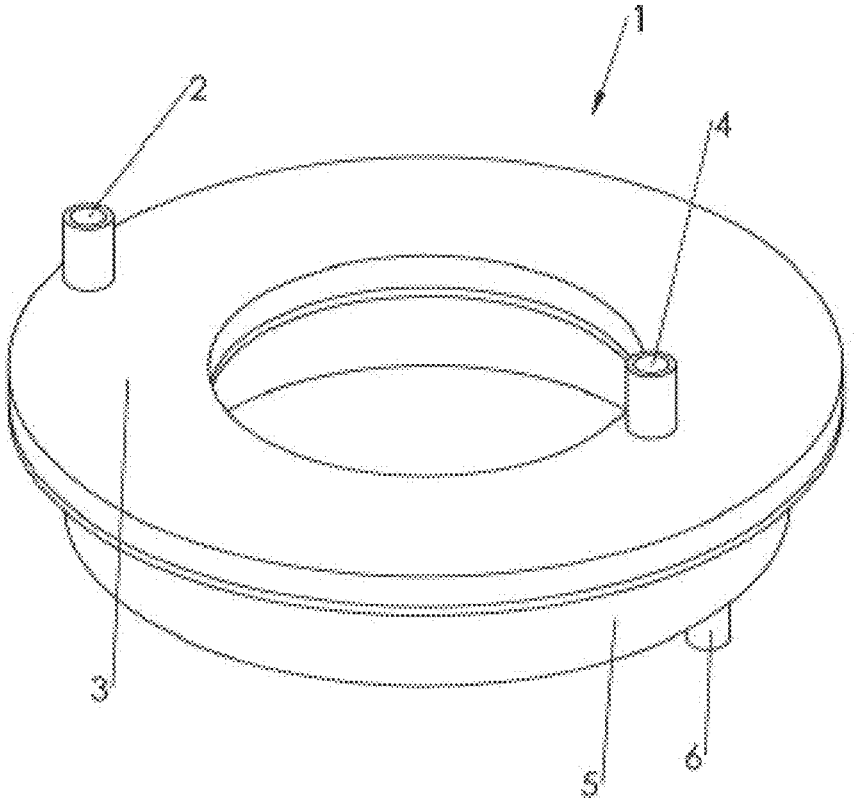
FIG. 56 is an isometric view of a filter system with complex flow orifices.

Referring first to FIG. 56, which illustrates an example of a filter system 1 that is constructed in accordance with the present technology. Fluid to be filtered flows into the filter system 1 from the inlet tube 2 or "inlet" of the filter system 1. The inlet tube 2 is fastened to the top surface of the top cover 3. Fluid passes through the both the inlet tube 2 and the top cover 3.

Fluid with a high concentration of particles exits the filter system 1 from concentrated outlet tube 4. The concentrated outlet tube 4 is also fastened to the top surface of the top cover 3. Filtered fluid exits the filter system 1 from the filtered outlet tube 6 located on the bottom surface of the bottom cover 5. The bottom cover 5 and the top cover 3 are fastened together. Both the top cover 3 and the bottom cover 5 are circular in shape with a circular hole through the center.

Figure 57:
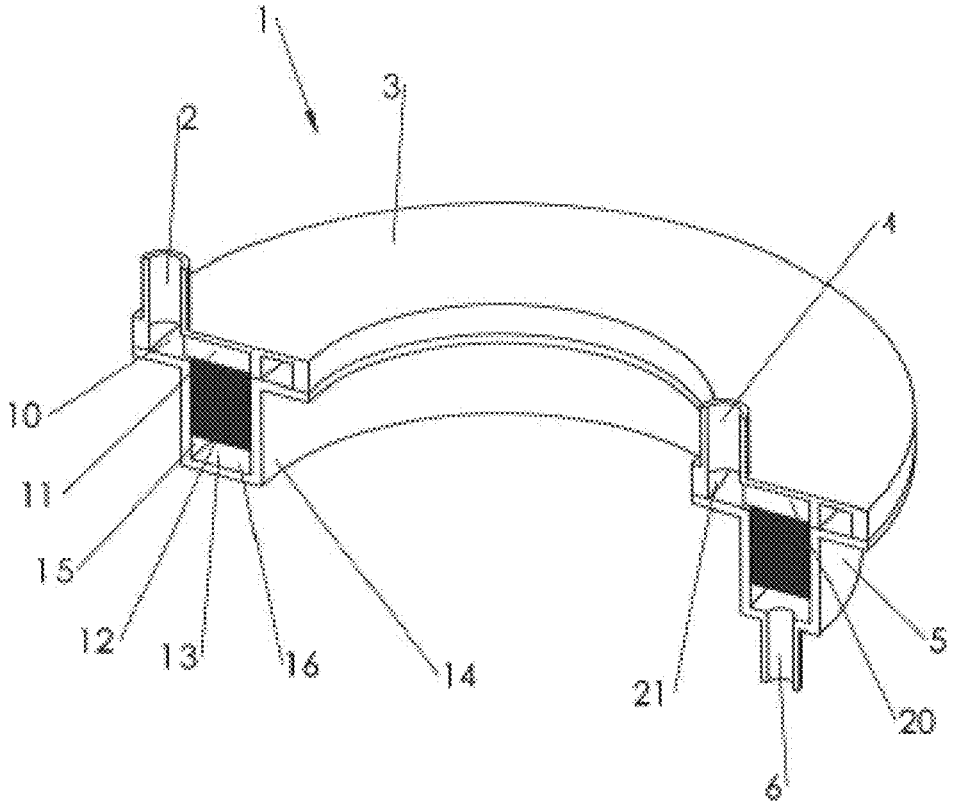
FIG. 57 is an isometric section view of the filter shown in FIG. 56.
Figure 58:
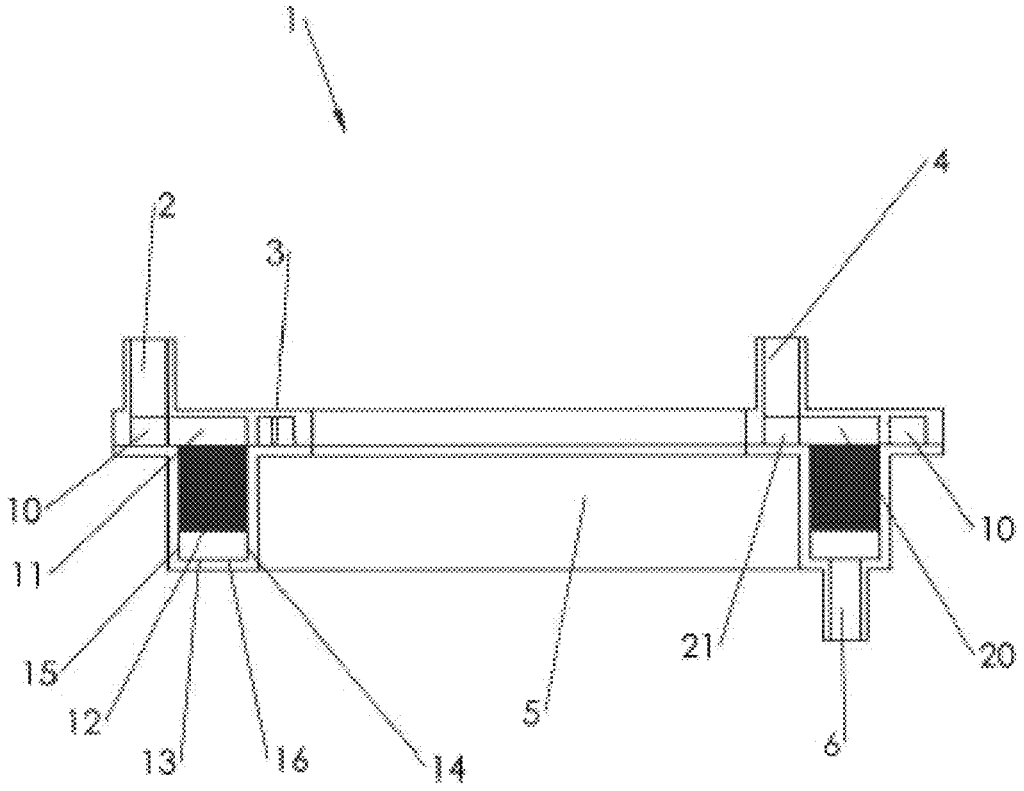
FIG. 58 is a front section view of the filter shown in FIG. 56.

Referring to FIG. 57 and FIG. 58 where a cross section of the filter system is shown, the filter disk 12 is enclosed between the top cover 3 and the bottom cover 5. The top surface of the filter disk 12 is mated to the bottom surface of the top cover 3. Fluid flow paths within the filter system can also be seen in these FIGS. Fluid from the inlet tube 2 flows into the cover inlet channel 10. The cover inlet channel 10 extends around the circular shaped top cover 3. It delivers fluid to radial inlet channels 11.

Figure 59:
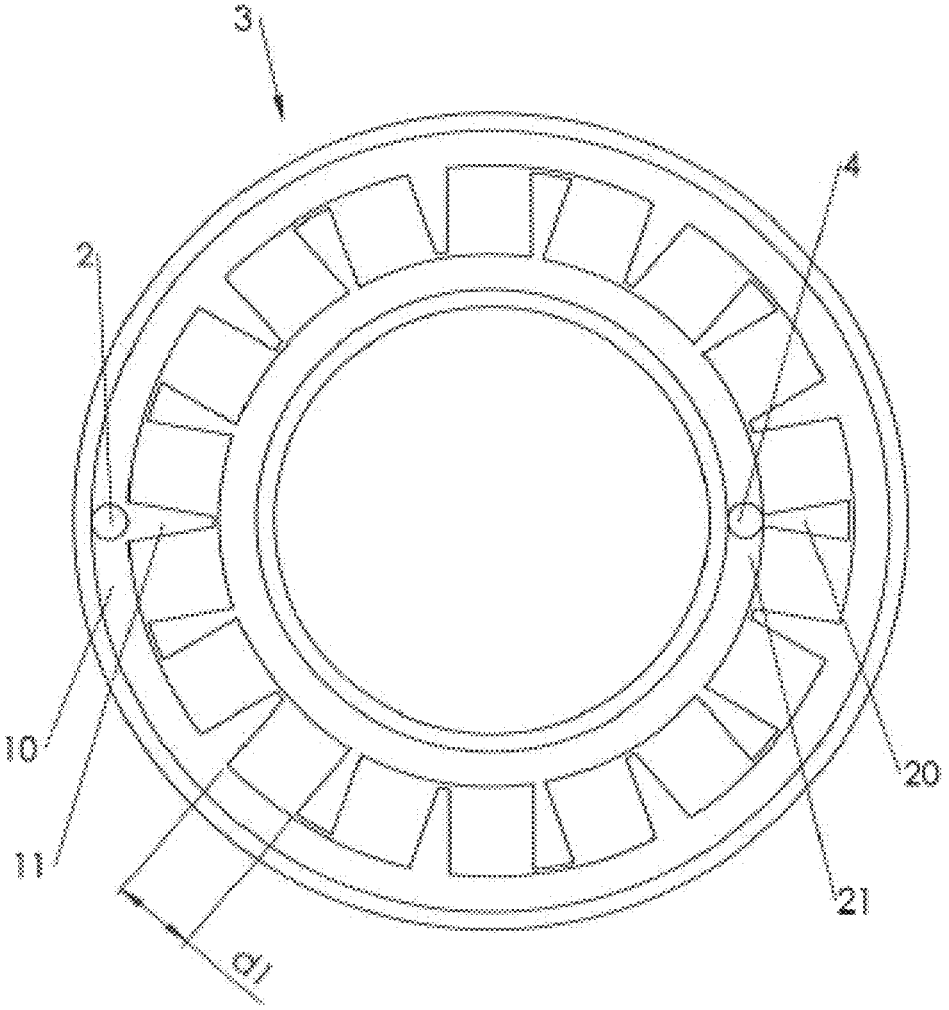
FIG. 59 is a bottom view of the filter system top cover shown in FIG. 56.

Referring to FIG. 59 where a bottom view of the top cover 3 is shown. The cover inlet channels 10 and the radial inlet channels 11 can be seen in their entirety.

There are a total of nine equally spaced radial inlet channels 11 that deliver fluid to the filter disk 12 (not shown) at only these locations. The actual number of channels and their size might be different than what is disclosed. The number would be the result of engineering for a specific application of the filter system 1. Located between the radial inlet channels 11 are the radial outlet channels 20. The radial outlet channels 20 collect concentrated fluid from the filter disk 12. They do so only at the locations directly above the filter disk 12. The radial outlet channels 20 and the radial inlet channels 11 are not directly connected. The radial outlet channels 20 are connected to the cover outlet channel 21 that is located slightly outside the hole at the center of the top cover 3. The cover outlet channel 21 is connected to and delivers the concentrated fluid to the outlet tube 4. The area between the radial inlet channel 11 and the radial outlet channel 20 is separated by a distance "d1". The relationship of this dimension to the filter disk will be discussed later in the disclosure.

Referring back to FIG. 57 the filtered outlet plenum 13 can be seen. The fluid outlet plenum 13 collects the fluid exiting the bottom of the filter disk 12. The filter disk 12 and the filtered outlet plenum 13 are constrained by the bottom surface 16, the outside wall 15 and the inside wall 14 of the bottom cover 5. The filtered fluid exits the outlet plenum 13 from the filtered fluid exit 6.

In summary the fluid to be filtered is directed to specific areas on the top surface of the filter disk 12. Concentrated fluid is allowed to exit the top surface of the filter disk 12 only at specific areas of the top surface of the filter disk 12. Filtered fluid is allowed to exit anywhere on the bottom surface of the filter disk 12. Many different covers, housings or plumbing could be engineering to perform the same function. One skilled in the art could engineer many other configurations. Further, the design would be engineered for the specific task of the filter system 1.

Figure 60:
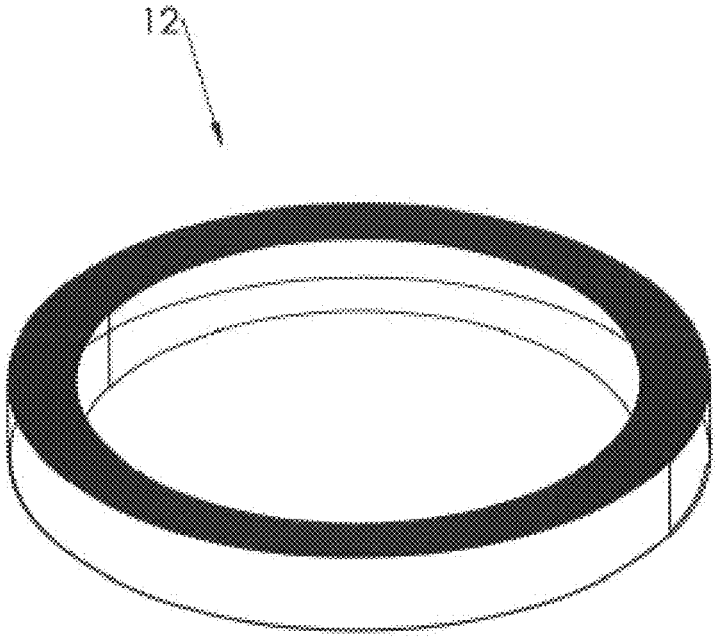
FIG. 60 is an isometric view of only the filter disk shown in FIG. 57.

Referring to FIG. 60 where only the filter disk 12 is shown. The filter disk 12 is made by rolling thin strips of filter material on top of one another many times to create a disk. The disk has a large hole in the center. The distance between the inside diameter and the outside diameter of the disk is equal to the thickness of the thin filter material multiplied by the number of times the filter material was wound around.

Figure 61:
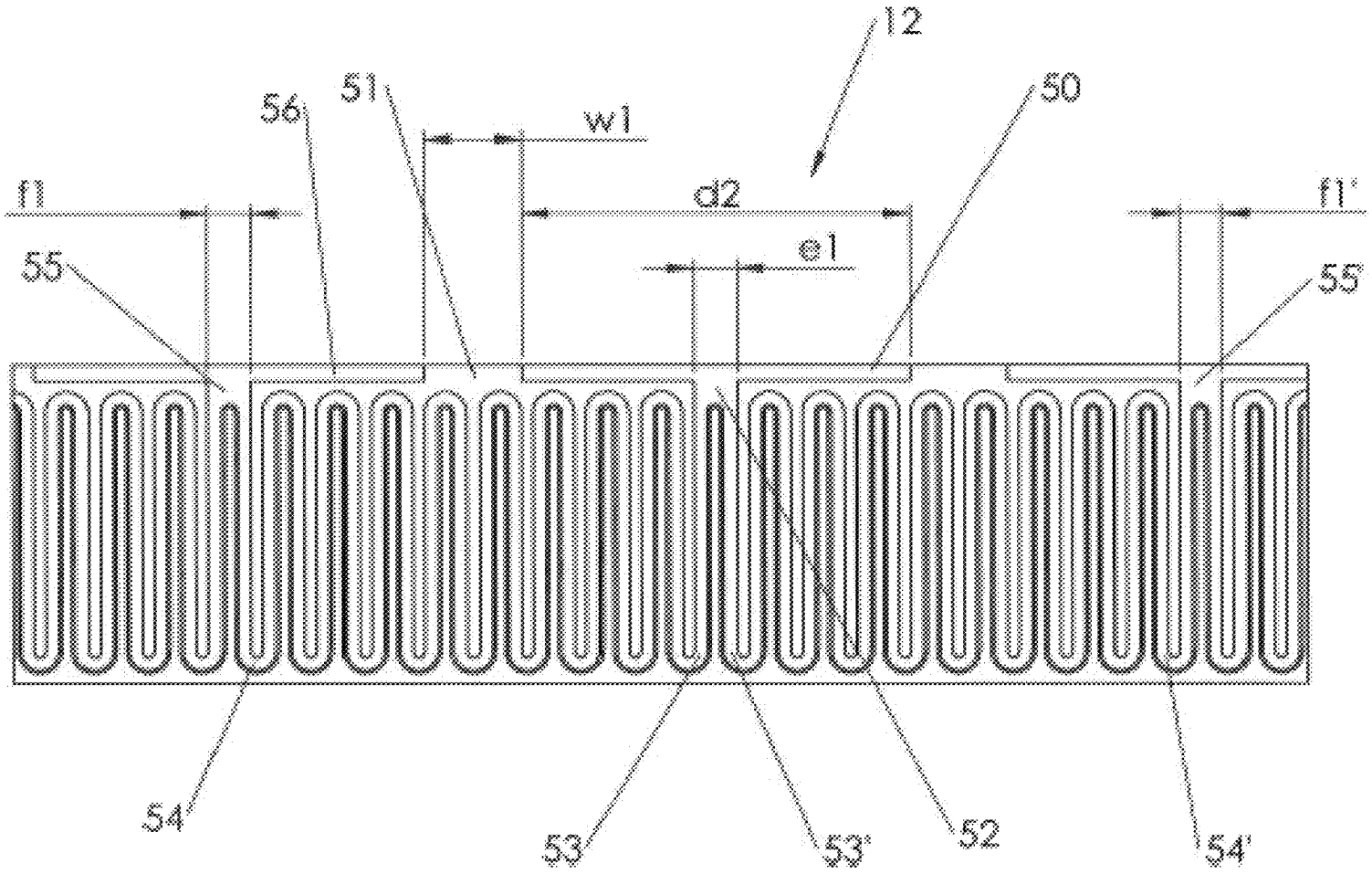
FIG. 61 is a close-up view of a section of the filter disk shown in FIG. 60.
Figure 62:
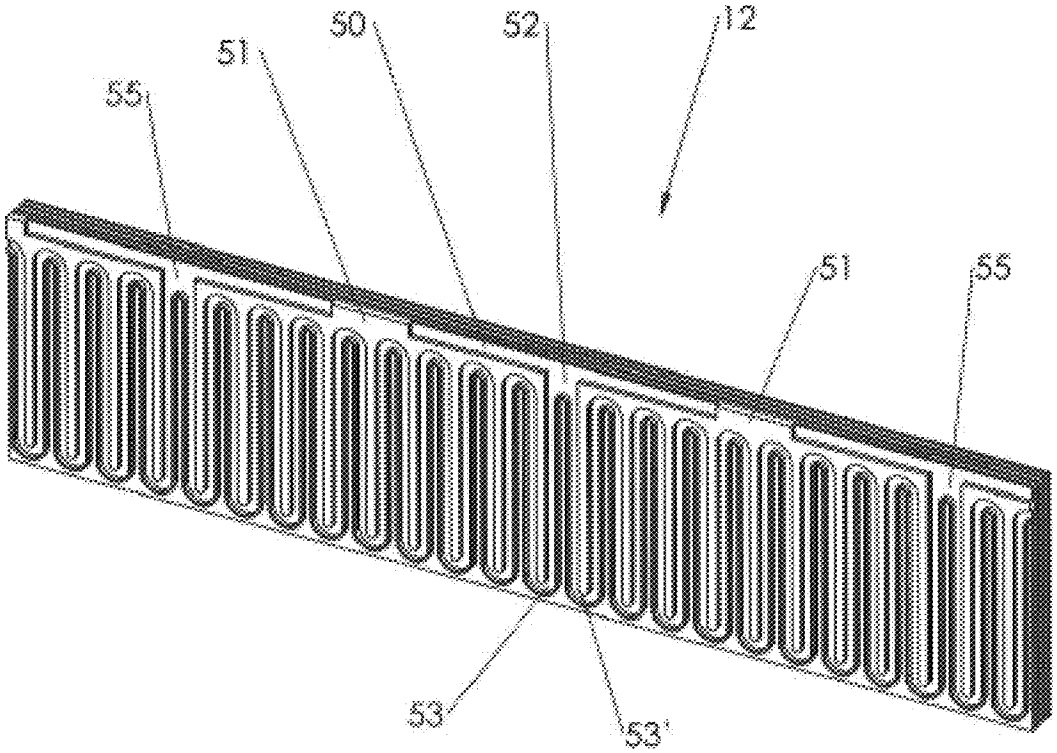
FIG. 62 is an isometric view of the filter section shown in FIG. 61.

Referring to FIGS. 61 and 62, a small section of the filter material is shown. The small section shows the entire height of the film but shows only a small length. Fluid from the radial inlet channel 11 enters the top surface of the filter material at the disk inlet area 50. The width of the disk inlet area 50 is identified by the dimension "d2". The disk inlet channels 50 are adjoined by disk walls 51. In some embodiments, the disk walls 51 form a serpentine fluid channel, such as left and right disk flow channels 53 and 53', described below. That is, the filter disk comprises a serpentine filter channel that is bounded by a thin filter wall (thin filter material). The filter wall will also be described below.

Disk outlet areas 56 are adjacent to the disk walls 51. Along the top edge of the film material the pattern of disk inlet area 50, disk wall 51 and disk outlet area 56 is repeated over and over along the entire length of the roll of filter material. The disk walls 51 are identified by the dimension "w1. The disk outlet area 56 has generally the same width, d1 as the disk inlet areas 50. The sum of d2 and w1 is less than the dimension d1 identified in FIG. 4. Fluid is constrained to flow into only one disk inlet area 50 or one disk outlet area 56 when the sum of w1 and d2 is less than d1. As the filter material is wound in a roll, the location of the disk inlet area 50 and the disk outlet areas 56 changes in relationship to the position of the radial inlet channels 11 in the top cover 3. In some cases the disk inlet area 50 or the disk outlet area 56 will not line up. In these cases there will be no flow. In a majority of the cases fluid will flow and will be restricted to only one input or one output.

The disk inlet area directs fluid to disk inlet channel 52. The disk channel 52 being aligned with an apex of the fluid flow channel. Fluid that flow into the disk inlet channel 52 can take one of two paths. It can flow to the left disk flow channel 53 or through the right disk flow channel 53'. The fluid can flow through either of these channels in a serpentine path to the left or to the right. The flow would eventually enter the flow left disk outlet channel 55 or the right disk outlet channel 55'. The fluid can then exit the disk outlet area 56. At some point above the disk outlet area 56 a radial outlet channel 20 would be located to remove concentrated fluid from the filter disk 12.

Stated otherwise, the filter disk may comprise a plurality of disk inlet channels, where each of the plurality of disk inlet channels cooperates with the serpentine filter channel to form a left disk flow channel and a right disk flow channel.

Figure 63:
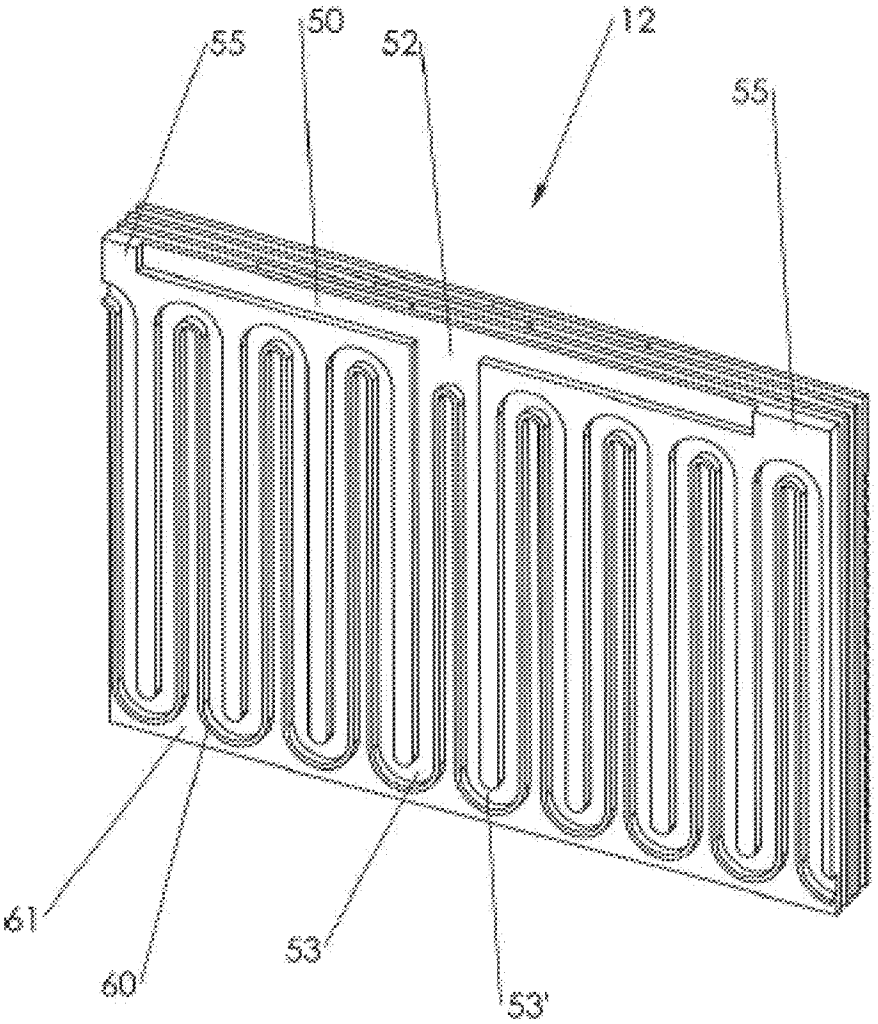
FIG. 63 is a close-up of FIG. 61.
Figure 64:
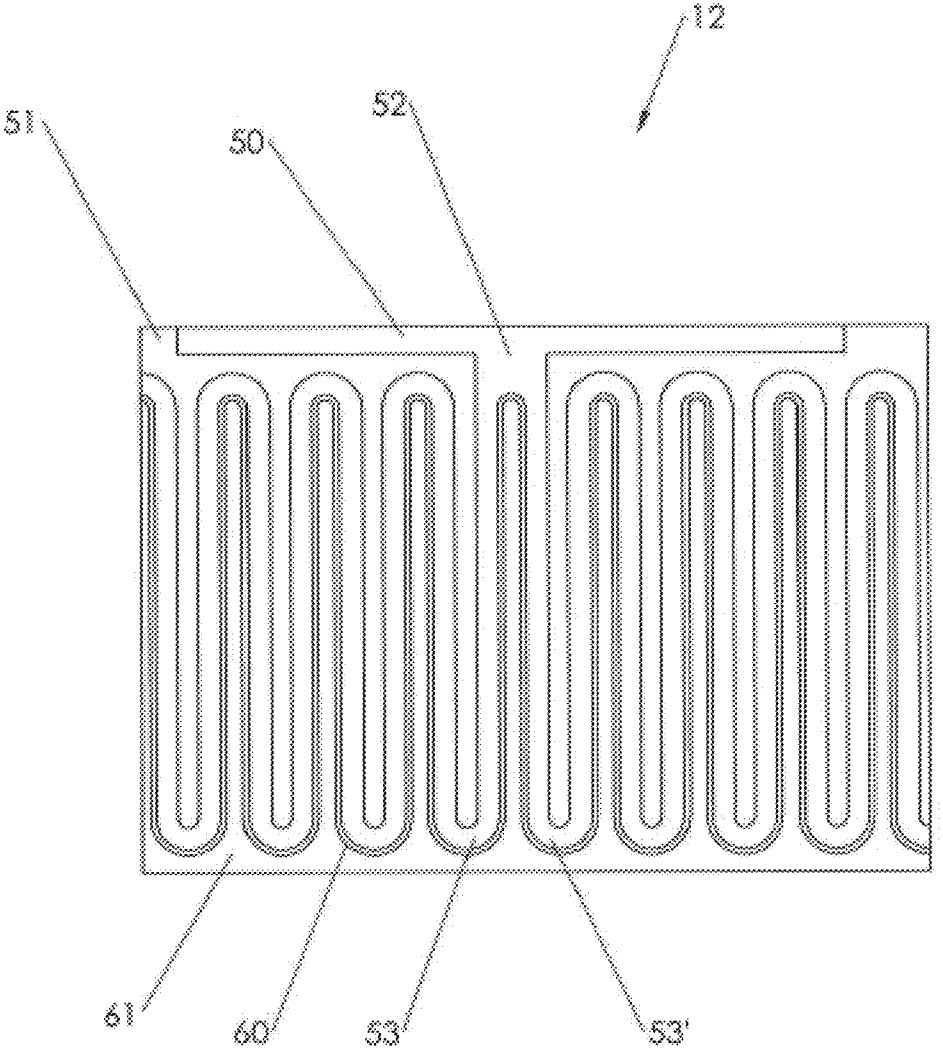
FIG. 64 is a front view of FIG. 63.

Referring to FIG. 63 and FIG. 64 the details of the filter disk 12 can be seen in a close-up view of a small section of filter material as previously described. In this view the thin channel walls 60 can be more clearly seen. These walls keep the fluid from entering the filtered region 61.

Figure 65:
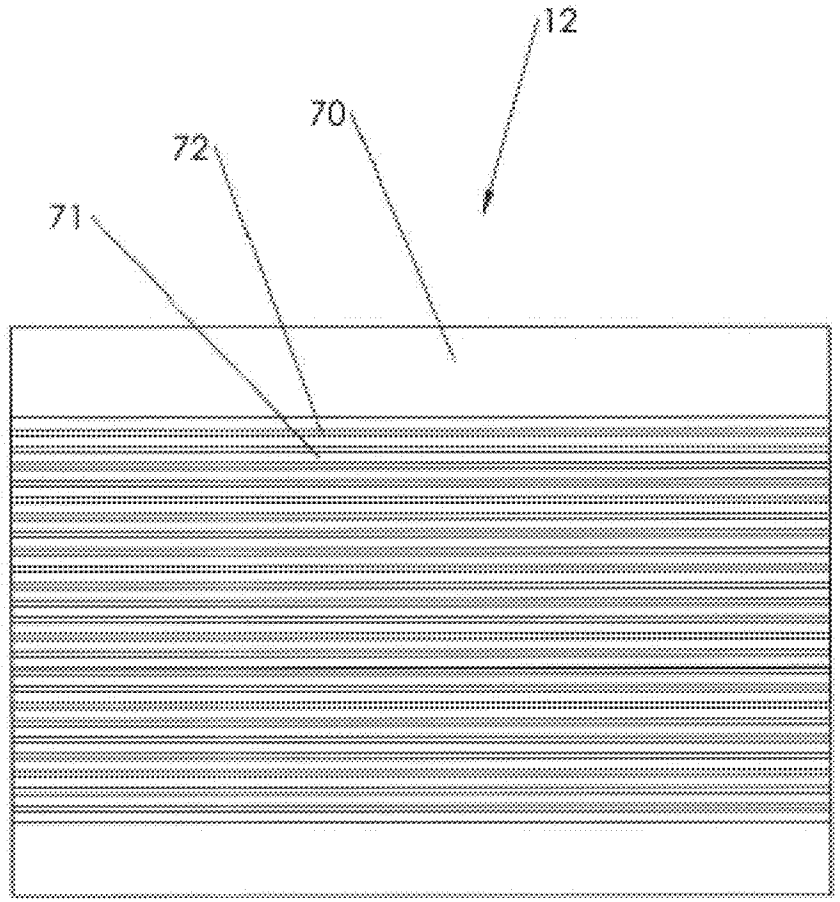
FIG. 65 is a rear view of FIG. 62.

Referring to FIG. 65 the back side of a small section of the thin filter material is shown. Extremely shallow channels are formed in the back surface of the thin filter material. These channels may only be 1/1000 of the depth as they are tall. They are spaced reasonable close together. They are shown to be spaced, center to center approximately 1.2 times their height. The entire length of the thin material would have these channels. They allow fluid to in effect "jump" the channel walls. Any particle larger than the depth of the channel would be restricted from flowing into the filtered region.

Referring back to FIG. 64, fluid that makes its way into the filtered region 61 can exit the bottom surface of the filter disk and enter the filtered outlet plenum 13.

Figure 66:
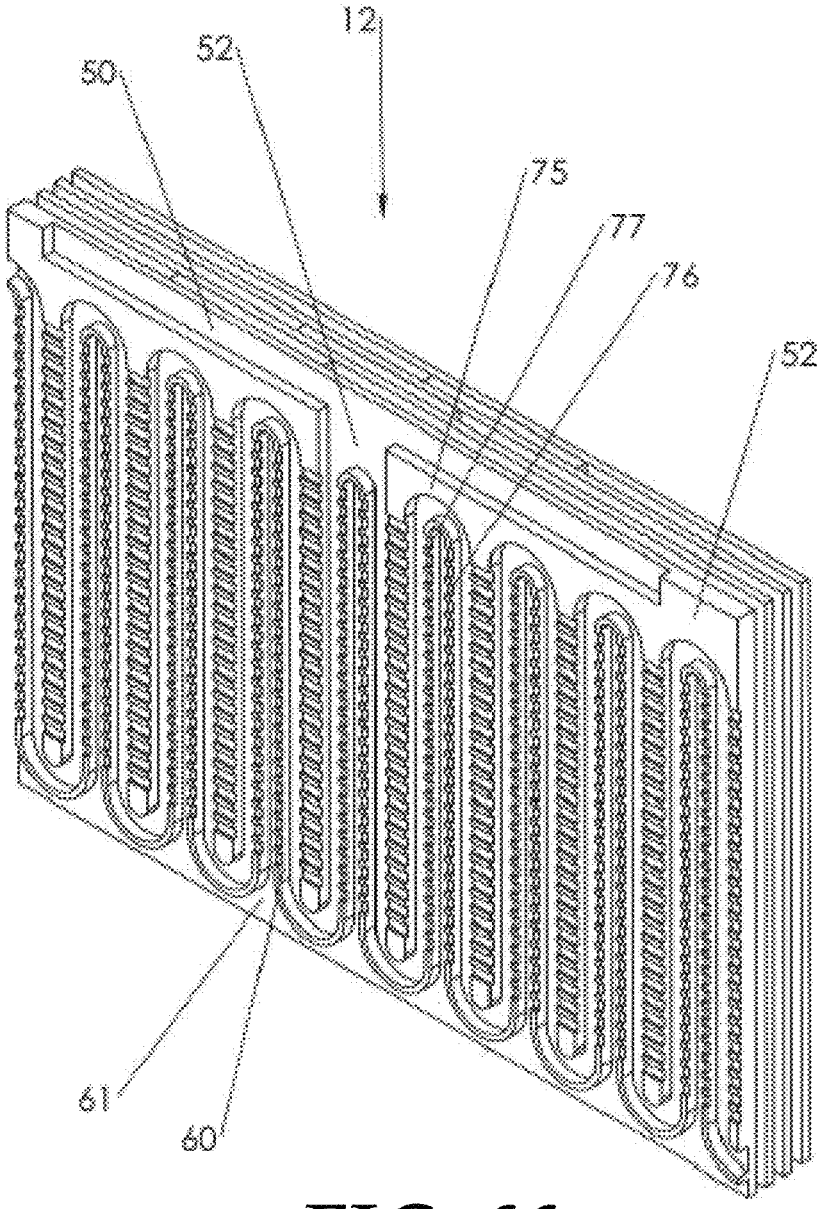
FIG. 66 is a close-up view of an alternate filter of the same prospective shown in FIG. 62.

Another configuration of a small section of the filter disk 12 is shown in FIG. 66. The thin channel wall 60 is configured with the extremely shallow channels formed by the front recessed surfaces 76. The front recessed surfaces 76 are recessed from the front surface 75 and are separated by front spacers 77. In this configuration the back side of the thin material would be flat. These extremely shallow channels are where particles are separated from the fluid.

Figure 67:
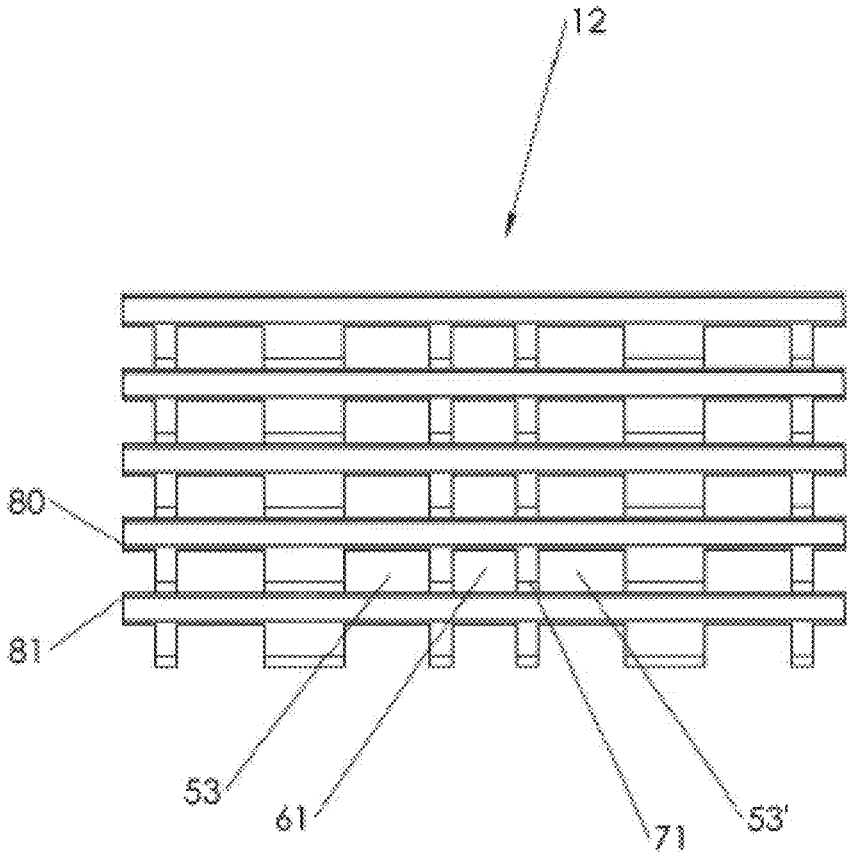
FIG. 67 is a top view of a section of the filter shown in FIG. 60.
Figure 68:
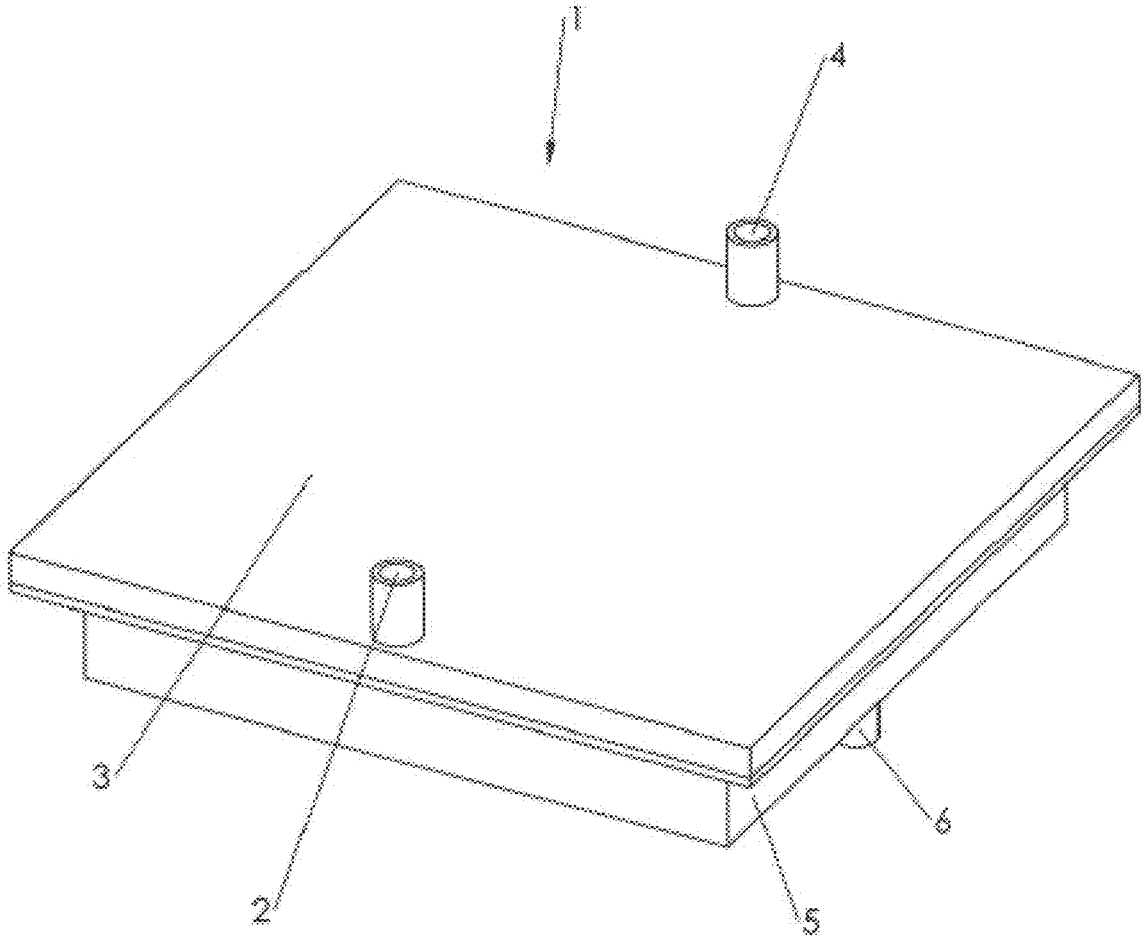
FIG. 68 is an isometric view of an alternate filter system.
Figure 69:
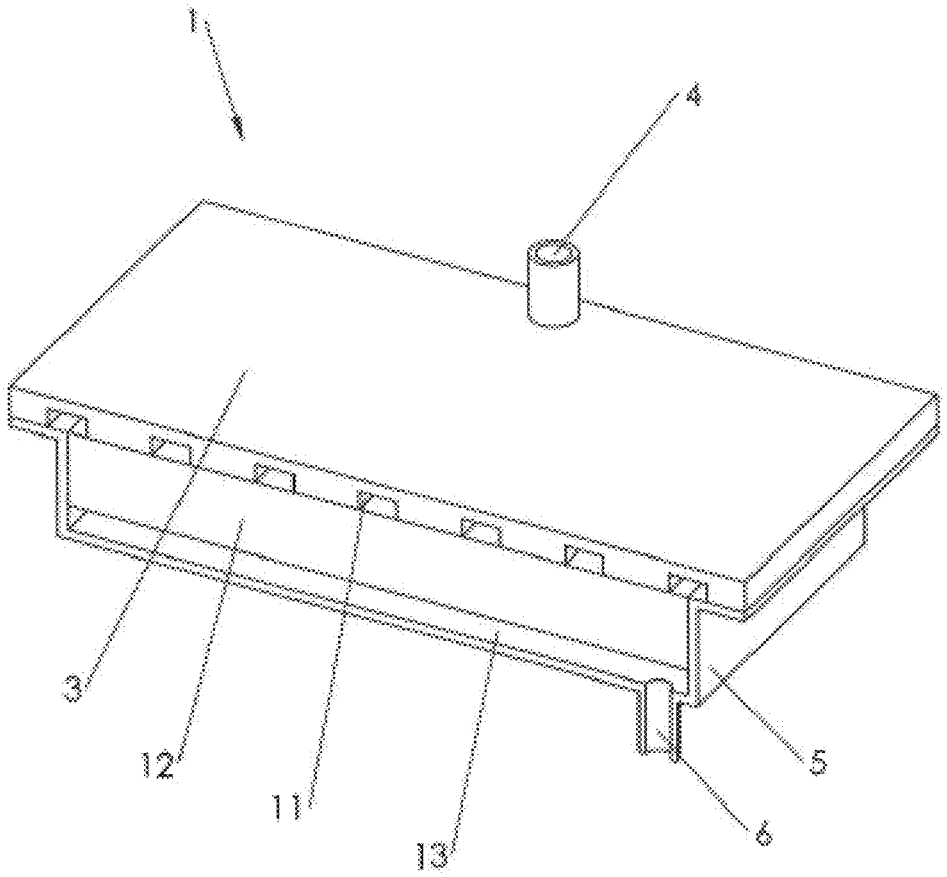
FIG. 69 is a section view of FIG. 68.
Figure 70:
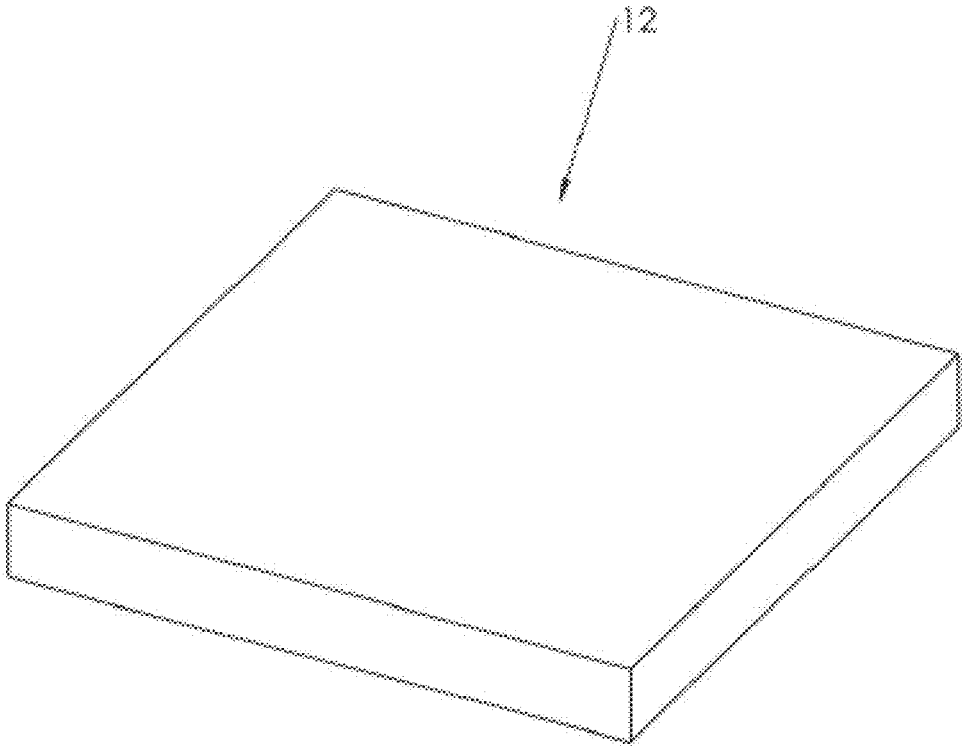
FIG. 70 is an isometric view of only the filter disk.
Figure 71:
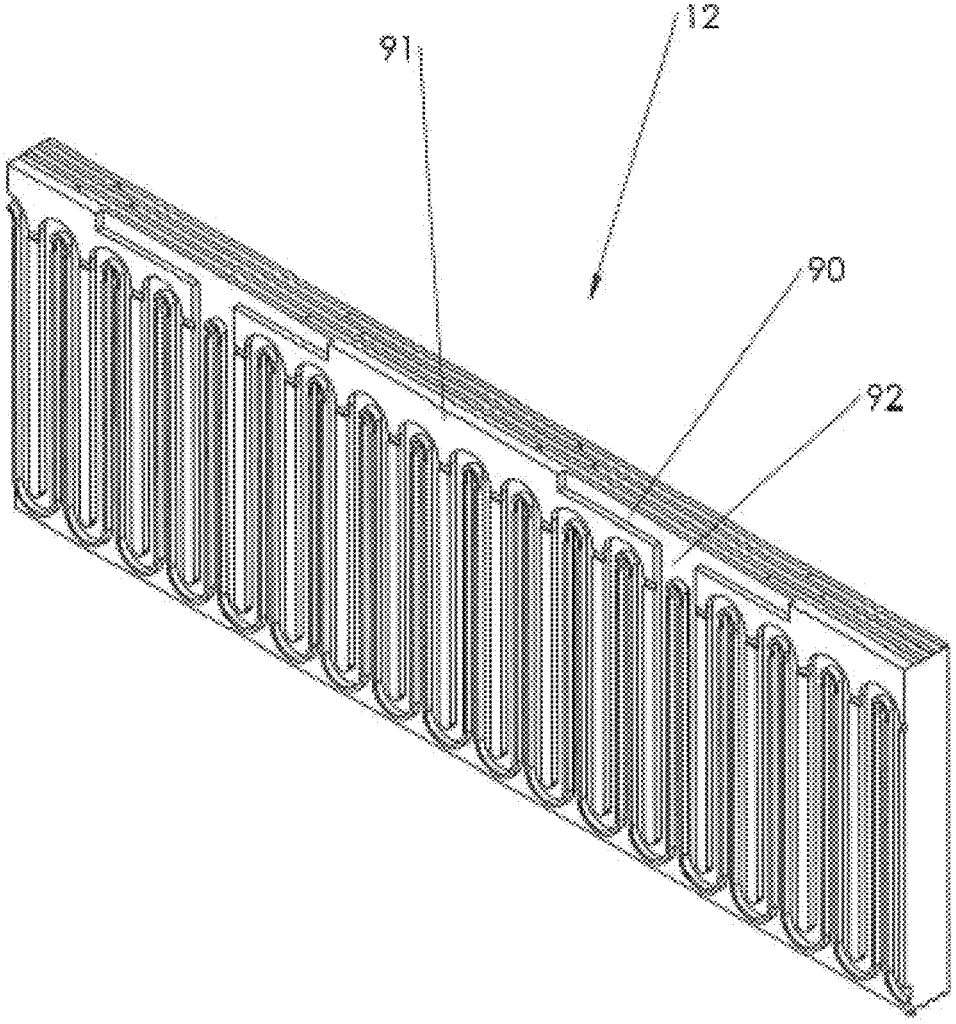
FIG. 71 is a close-up view of the filter section shown in FIG. 70.

Referring to FIG. 67 a top view of the small section of the filter disk 12 is shown. In this view charged surfaces are shown. For some applications it is desirable to create an electric field across the flow field. The front charged layer 80 is shown to be located just below the main structure of the filter material. The rear charged layer 81 is located just below the surface of the back of the filter material. These layers could alternately be located at the surface of the filter material. The exact location would be engineered for a specific application.

The front and rear surfaces could also be coated with other materials to enhance the filtering properties of the filter system. Some examples of coating are carbon particles, titanium dioxide, silicone dioxide, charged ions embedded into the filter material and many other types of materials.

Referring to FIGS. 68, 69, 70 and 71, collectively, an alternate configuration of the filter system is shown. A small section of the filter material is shown in each of FIGS. 68-71. This system is comprised of filter material layered together rather than rolled into a disk. The top and bottom covers are rectangular rather than circular. Inlet and outlet channels are linear rather than radial. The inlet channels and outlet channels mate with the disk inlet and outlet areas. This alternate configuration functions in the same way as the circular version. The relatively equal size of the film inlet area 90, the film outlet area 91 and the film wall 92 area does not required much accuracy in the placement of the thin material to align them with the channels in the top cover.

Figure 72:
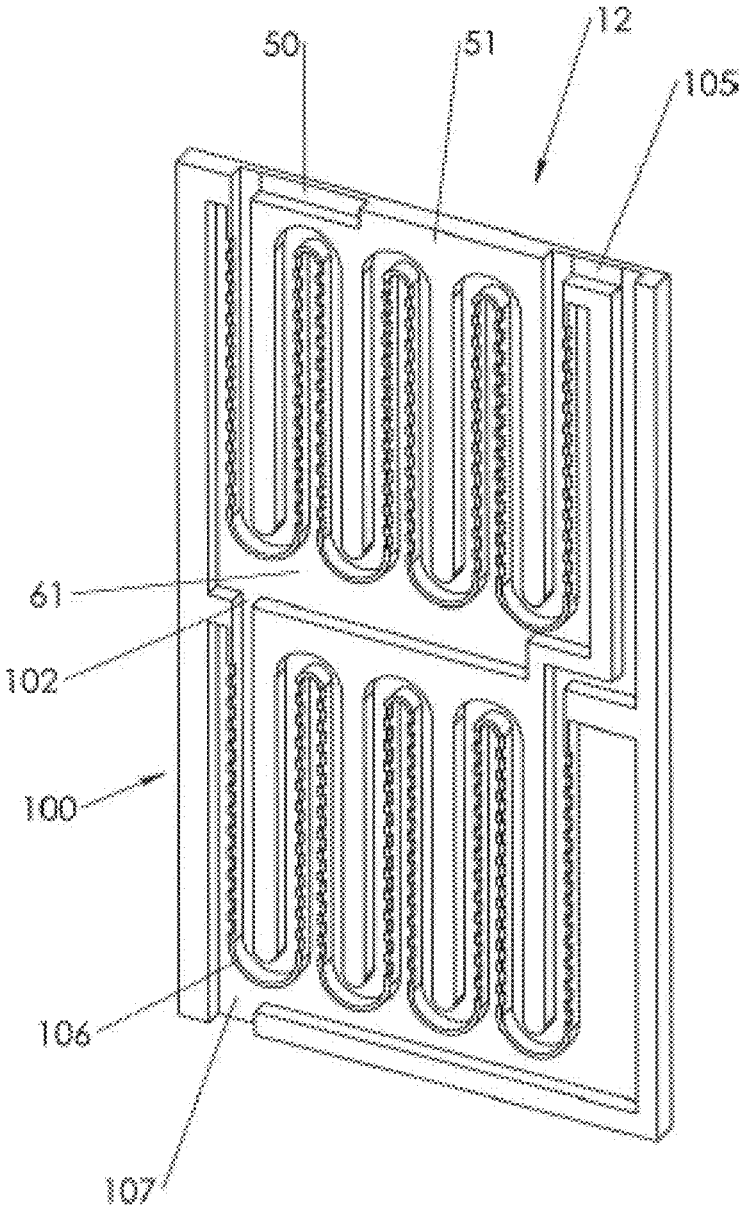
FIG. 72 is another alternate filter section of the same prospective shown in FIG. 70.

Referring to FIG. 72 a section of filter material for a two staged filter system is shown. It has all of the elements of the previously described single stage filter system.

In addition it has a second filter stage 100 configured below the single stage system. The flow from the filtered region 61 enters the second filter stage 100 at the second stage inlet 102. Concentrated fluid exiting the second filter stage 100 is delivered to the top edge of the filter material by the second stage outlet 105. Filtered fluid exits the second stage thin channel wall 106 to the second stage filtered region 107 where it is free to exit the bottom edge of the filter material onto the filtered output plenum 13.

It should be noted that a large number of configurations of filter channels and filter inlets and outlets can be configured on filter material.

The present technology is directed to filters, and more specifically, but not by way of limitation, to filters that comprise multiple staged layers which are alternatingly and transversely oriented to one another. These filters advantageously are configured to filter a particulate bearing fluid to remove particles of various sizes.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A filter, comprising:

a cylindrical housing having an inlet and an outlet;

a plurality of filter films stacked in a layered configuration, each of the plurality of filter films comprising:

a plurality of dividing walls extending from a top edge of a film to a bottom edge of the film, the plurality of dividing walls having a top portion extending from the top edge of the film, a bottom portion extending from the bottom edge of the film, and a middle portion located between the top portion and the bottom portion, the plurality of dividing walls forming a plurality of tapered inlet channels extending from the top edge of the film and located along the top portion and the middle portion of the plurality of dividing walls, the plurality of dividing walls forming a plurality of tapered output channels extending from the bottom edge of the film and located along the bottom portion and the middle portion of the plurality of dividing walls, the top portion extending up to ends of the plurality of tapered output channels, the bottom portion extending up to ends of the plurality of tapered inlet channels;

a plurality of cross channels formed along an entire length of each of the top portion, the middle portion, and the bottom portion of each of the plurality of dividing walls to allow fluid to flow between two adjacent tapered inlet channels of the plurality of tapered inlet channels in the top portion, allow the fluid to flow between two adjacent tapered output channels of the plurality of tapered output channels in the bottom portion, and allow the fluid to flow between the plurality of tapered inlet channels and the plurality of tapered output channels in the middle portion;

an inlet channel for each of the plurality of tapered inlet channels; and an outlet channel for each of the plurality of tapered output channels; and wherein the plurality of filter films are disposed within the cylindrical housing in a rolled configuration so as to orient the plurality of dividing walls perpendicularly to the inlet of the cylindrical housing, the rolled configuration defines a central aperture of the plurality of filter films, and the plurality of filter films are stacked such that a back surface of each of the plurality of filter films contacts the plurality of dividing walls of an adjacent filter film.

2. The filter according to claim 1, further comprising a conductive layer covering a front face of each of the plurality of filter films.

3. The filter according to claim 2, further comprising a conductive layer covering a back surface of each of the plurality of filter films.

4. The filter according to claim 3, wherein conductive layers of the front face and the back surface are embedded with charged particles.

5. The filter according to claim 2, further comprising an electrically insulating layer covering the conductive layer covering the front face of each of the plurality of filter films.

6. The filter according to claim 1, wherein the plurality of tapered inlet channels are substantially V-shaped.

7. The filter according to claim 6, wherein the plurality of tapered inlet channels of each of the plurality of filter films have alternating widths.

8. The filter according to claim 1, further comprising a porous electrically conductive material or texturing disposed on the plurality of cross channels of each of the plurality of dividing walls.

9. The filter according to claim 1, wherein each of the plurality of cross channels comprise a tapered configuration that is formed by adjacent dividing walls, the adjacent dividing walls being tear-shaped.

10. The filter according to claim 1, wherein the plurality of filter films are rolled into a spiral configuration.

11. The filter according to claim 1, wherein the outlet of the cylindrical housing is located centrally to the cylindrical housing.

12. The filter according to claim 11, wherein an upper cover of the cylindrical housing and a lower cover of the cylindrical housing are each centrally indented to create a radial pathway for communication of fluid from within the central aperture into the outlet of the cylindrical housing.

13. The filter according to claim 12, further comprising a second inlet on the cylindrical housing that is oriented perpendicularly to the inlet.

14. The filter according to claim 1, wherein the rolled configuration produces concentric rings from the plurality of filter films.

* * * * *